US011357263B2

(12) United States Patent
Lee et al.

(10) Patent No.: US 11,357,263 B2
(45) Date of Patent: Jun. 14, 2022

(54) DEVICE FOR CLEANING SMOKING MEMBER, AND SMOKING MEMBER SYSTEM

(71) Applicant: KT&G CORPORATION, Daejeon (KR)

(72) Inventors: Jong Sub Lee, Seongnam-si (KR); Dae Nam Han, Daejeon (KR); Jang Uk Lee, Seoul (KR); Jung Ho Han, Daejeon (KR); Hun Il Lim, Seoul (KR); Jin Young Yoon, Seoul (KR); Young Lea Kim, Seoul (KR); Ji Soo Jang, Seoul (KR); Wang Seop Lim, Anyang-si (KR); Moon Bong Lee, Seoul (KR); Soung Ho Ju, Daejeon (KR); Du Jin Park, Seoul (KR); Seong Won Yoon, Yongin-si (KR)

(73) Assignee: KT&G CORPORATION, Daejeon (KR)

( * ) Notice: Subject to any disclaimer, the term of this patent is extended or adjusted under 35 U.S.C. 154(b) by 351 days.

(21) Appl. No.: 16/604,446

(22) PCT Filed: Apr. 10, 2018

(86) PCT No.: PCT/KR2018/004172
§ 371 (c)(1),
(2) Date: Oct. 10, 2019

(87) PCT Pub. No.: WO2018/190601
PCT Pub. Date: Oct. 18, 2018

(65) Prior Publication Data

US 2020/0154775 A1 May 21, 2020

(30) Foreign Application Priority Data

Apr. 11, 2017 (KR) ..... 10-2017-0046938
Jun. 19, 2017 (KR) ..... 10-2017-0077586
Jul. 3, 2017 (KR) ..... 10-2017-0084387

(51) Int. Cl.
*A24F 13/00* (2006.01)
*A24F 40/85* (2020.01)
(Continued)

(52) U.S. Cl.
CPC ..... *A24F 40/85* (2020.01); *A24F 40/40* (2020.01); *A24F 40/90* (2020.01)

(58) Field of Classification Search
CPC ..... A24F 47/00
(Continued)

(56) References Cited

U.S. PATENT DOCUMENTS 2,638,904 A 5/1953 Mitchell
4,637,407 A 1/1987 Bonanno et al.
(Continued)

FOREIGN PATENT DOCUMENTS

CA 2973143 A1 8/2016
CH 310239 A 12/1955
(Continued)

OTHER PUBLICATIONS

Office Action dated Dec. 11, 2019 in Korean Application No. 10-2018-0010836.
(Continued)

*Primary Examiner* — Phuong K Dinh
(74) *Attorney, Agent, or Firm* — Sughrue Mion, PLLC

(57) ABSTRACT

Provided is a smoking member cleaning device formed to clean a smoking member, the smoking member cleaning device including a main body unit; an accommodating unit formed in one region of the main body unit to accommodate one region of the smoking member when the smoking member is being cleaned; a cleaning unit formed in the accommodating unit and configured to clean the smoking
(Continued)

member; a cleaning driving unit connected to the cleaning unit and configured to clean the smoking member by moving the cleaning unit; and a power supply unit configured to supply driving energy to the cleaning driving unit.

12 Claims, 28 Drawing Sheets

(51) Int. Cl.
*A24F 40/40* (2020.01)
*A24F 40/90* (2020.01)

(58) Field of Classification Search
USPC ..... 131/328–329
See application file for complete search history.

(56) References Cited

U.S. PATENT DOCUMENTS 5,144,962 A 9/1992 Counts et al.
5,240,012 A 8/1993 Ehrman et al.
5,249,586 A 10/1993 Morgan et al.
5,388,594 A 2/1995 Counts et al.
5,465,738 A 11/1995 Rowland
5,479,948 A 1/1996 Counts et al.
5,591,368 A 1/1997 Fleischhauer et al.
5,666,977 A 9/1997 Higgins et al.
5,878,752 A 3/1999 Adams et al.
6,053,176 A 4/2000 Adams et al.
6,418,938 B1 7/2002 Fleischhauer et al.
6,532,965 B1 3/2003 Abhulimen et al.
6,615,840 B1 9/2003 Fournier et al.
6,810,883 B2 11/2004 Felter et al.
7,861,726 B1 1/2011 Lukasavitz
8,375,959 B2 2/2013 Dittrich et al.
8,419,085 B2 4/2013 Kim et al.
8,752,545 B2 6/2014 Buchberger
8,851,081 B2 10/2014 Fernando et al.
8,973,587 B2 3/2015 Liu
9,078,472 B2 7/2015 Liu
9,078,473 B2 7/2015 Worm et al.
9,271,528 B2 3/2016 Liu
9,320,299 B2 4/2016 Hearn et al.
9,423,152 B2 8/2016 Ampolini et al.
9,427,023 B2 8/2016 Liu
9,497,991 B2 11/2016 Besso et al.
9,499,332 B2 11/2016 Fernando et al.
9,516,899 B2 12/2016 Plojoux et al.
9,560,883 B2 2/2017 Hawes
9,603,388 B2 3/2017 Fernando et al.
9,655,383 B2 5/2017 Holzherr et al.
9,693,587 B2 7/2017 Plojoux et al.
9,723,871 B2 8/2017 Xiang
9,795,166 B2 10/2017 Liu
9,814,263 B2 11/2017 Cochand et al.
9,854,841 B2 1/2018 Ampolini et al.
9,854,845 B2 1/2018 Plojoux et al.
9,894,934 B2 2/2018 Li et al.
9,918,494 B2 3/2018 Mironov et al.
9,955,724 B2 5/2018 Lord
9,986,760 B2 6/2018 Macko et al.
9,999,247 B2 6/2018 Ruscio et al.
10,015,990 B2 7/2018 Mironov
10,031,183 B2 7/2018 Novak, III et al.
10,070,667 B2 9/2018 Lord et al.
10,104,911 B2 10/2018 Thorens et al.
10,130,780 B2 11/2018 Talon
10,136,673 B2 11/2018 Mironov
10,159,283 B2 12/2018 Mironov
10,194,697 B2 2/2019 Fernando et al.
10,299,513 B2 5/2019 Perez et al.
10,368,584 B2 8/2019 Fernando et al.
10,433,584 B2 * 10/2019 Nettenstrom ..... B65D 25/10
10,439,419 B2 10/2019 Bernauer et al.
10,440,987 B2 10/2019 Zeng et al.
10,448,670 B2 10/2019 Talon et al.
10,492,542 B1 12/2019 Worm et al.
10,548,350 B2 2/2020 Greim et al.
10,555,553 B2 2/2020 Binassi et al.
10,588,351 B2 3/2020 Ricketts
10,645,971 B2 5/2020 Zitzke
10,668,058 B2 6/2020 Rose et al.
10,716,329 B2 7/2020 Matsumoto et al.
10,813,174 B2 10/2020 Schneider et al.
10,881,143 B2 1/2021 Suzuki et al.
11,039,642 B2 6/2021 Zuber et al.
11,147,316 B2 10/2021 Farine et al.
2004/0261802 A1 12/2004 Griffin et al.
2005/0045198 A1 3/2005 Larson et al.
2005/0172976 A1 8/2005 Newman et al.
2006/0030214 A1 2/2006 Katou et al.
2008/0001052 A1 1/2008 Kalous et al.
2010/0001538 A1 1/2010 Kim et al.
2010/0307518 A1 12/2010 Wang
2011/0155151 A1 6/2011 Newman et al.
2011/0209717 A1 9/2011 Han
2011/0290248 A1 12/2011 Schennum
2011/0290269 A1 12/2011 Shimizu
2012/0247494 A1 10/2012 Oglesby et al.
2013/0037041 A1 2/2013 Worm et al.
2013/0213419 A1 8/2013 Tucker et al.
2013/0284192 A1 10/2013 Peleg et al.
2013/0319439 A1 12/2013 Gorelick et al.
2013/0340775 A1 12/2013 Juster et al.
2014/0020698 A1 1/2014 Fiebelkorn
2014/0096782 A1 4/2014 Ampolini et al.
2014/0116455 A1 5/2014 Youn
2014/0246035 A1 9/2014 Minskoff et al.
2014/0299137 A1 10/2014 Kieckbusch et al.
2014/0301721 A1 10/2014 Ruscio et al.
2014/0305448 A1 10/2014 Zuber et al.
2014/0318559 A1 10/2014 Thorens et al.
2014/0345633 A1 11/2014 Talon et al.
2014/0345634 A1 11/2014 Zuber et al.
2014/0363145 A1 12/2014 Plojoux et al.
2014/0378790 A1 * 12/2014 Cohen ..... A61B 5/486 600/309
2015/0007838 A1 1/2015 Fernando et al.
2015/0013696 A1 1/2015 Plojoux et al.
2015/0020832 A1 1/2015 Greim et al.
2015/0024355 A1 1/2015 Ghofrani et al.
2015/0027474 A1 1/2015 Zuber et al.
2015/0100441 A1 4/2015 Alarcon et al.
2015/0136124 A1 5/2015 Aronie et al.
2015/0136154 A1 5/2015 Mitrev et al.
2015/0201676 A1 7/2015 Shin
2015/0208725 A1 7/2015 Tsai
2015/0245654 A1 9/2015 Memari et al.
2015/0257445 A1 9/2015 Henry, Jr. et al.
2015/0272211 A1 10/2015 Chung
2016/0150824 A1 6/2016 Memari et al.
2016/0205998 A1 7/2016 Matsumoto et al.
2016/0270437 A1 9/2016 Nappi
2016/0286861 A1 10/2016 Liu
2016/0302488 A1 10/2016 Fernando et al.
2016/0031032 A1 11/2016 Malgat et al.
2016/0331032 A1 11/2016 Malgat et al.
2016/0345629 A1 12/2016 Mironov
2016/0366946 A1 12/2016 Murison et al.
2016/0374402 A1 12/2016 Fernando et al.
2017/0006916 A1 1/2017 Liu
2017/0006919 A1 1/2017 Liu
2017/0027229 A1 2/2017 Cameron
2017/0027234 A1 2/2017 Farine et al.
2017/0042243 A1 2/2017 Plojoux et al.
2017/0042251 A1 2/2017 Yamada et al.
2017/0055580 A1 3/2017 Blandino et al.
2017/0065002 A1 3/2017 Fernando et al.
2017/0071251 A1 3/2017 Goch
2017/0095006 A1 4/2017 Egoyants et al.
2017/0150757 A1 6/2017 Worm et al.
2017/0164659 A1 6/2017 Schneider et al.
2017/0172214 A1 6/2017 Li et al.
2017/0172215 A1 6/2017 Li et al.

(56) References Cited

U.S. PATENT DOCUMENTS

| | | | |
|---|---|---|---|
| 2017/0188634 | A1 | 7/2017 | Plojoux et al. |
| 2017/0238596 | A1 | 8/2017 | Matsumoto et al. |
| 2018/0177234 | A1 | 6/2018 | Lee |
| 2018/0206556 | A1 | 7/2018 | Thorens et al. |
| 2018/0235283 | A1 | 8/2018 | Zuber et al. |
| 2019/0014826 | A1 | 1/2019 | Thorens et al. |
| 2019/0075849 | A1 | 3/2019 | Hawes |
| 2019/0320719 | A1 | 10/2019 | Liu et al. |
| 2019/0364975 | A1 | 12/2019 | Fernando et al. |
| 2020/0006950 | A1 | 1/2020 | Holzherr |
| 2020/0120983 | A1 | 4/2020 | Chen |
| 2020/0232766 | A1 | 7/2020 | Flick |
| 2020/0305508 | A1 | 10/2020 | Talon |
| 2020/0352224 | A1 | 11/2020 | Plojoux et al. |
| 2020/0413495 | A1 | 12/2020 | Schneider et al. |
| 2021/0000182 | A1 | 1/2021 | Ruscio et al. |
| 2021/0120875 | A1 | 4/2021 | Mironov |

FOREIGN PATENT DOCUMENTS

| | | | |
|---|---|---|---|
| CN | 1102964 | A | 5/1995 |
| CN | 1209731 | A | 3/1999 |
| CN | 1973706 | A | 6/2007 |
| CN | 101043827 | A | 9/2007 |
| CN | 101444335 | A | 6/2009 |
| CN | 102006790 | A | 4/2011 |
| CN | 102438470 | A | 5/2012 |
| CN | 202407082 | U | 9/2012 |
| CN | 202774134 | U | 3/2013 |
| CN | 103096741 | A | 5/2013 |
| CN | 103281920 | A | 9/2013 |
| CN | 103338665 | A | 10/2013 |
| CN | 203457802 | U | 3/2014 |
| CN | 103859606 | A | 6/2014 |
| CN | 203633505 | U | 6/2014 |
| CN | 203646503 | U | 6/2014 |
| CN | 103929988 | A | 7/2014 |
| CN | 203689071 | U | 7/2014 |
| CN | 103974640 | A | 8/2014 |
| CN | 103997921 | A | 8/2014 |
| CN | 103997922 | A | 8/2014 |
| CN | 203789137 | U | 8/2014 |
| CN | 104023568 | A | 9/2014 |
| CN | 104023574 | A | 9/2014 |
| CN | 104039183 | A | 9/2014 |
| CN | 104095295 | A | 10/2014 |
| CN | 104106842 | A | 10/2014 |
| CN | 203943078 | U | 11/2014 |
| CN | 204070570 | U | 1/2015 |
| CN | 204146338 | U | 2/2015 |
| CN | 104382237 | A | 3/2015 |
| CN | 104470387 | A | 3/2015 |
| CN | 104489933 | A | 4/2015 |
| CN | 104544559 | A | 4/2015 |
| CN | 204317494 | U | 5/2015 |
| CN | 204317504 | U | 5/2015 |
| CN | 205197003 | U | 5/2015 |
| CN | 104754964 | A | 7/2015 |
| CN | 104770878 | A | 7/2015 |
| CN | 104812260 | A | 7/2015 |
| CN | 204444239 | U | 7/2015 |
| CN | 204763414 | U | 11/2015 |
| CN | 105163610 | A | 12/2015 |
| CN | 105208882 | A | 12/2015 |
| CN | 105208884 | A | 12/2015 |
| CN | 105341993 | A | 2/2016 |
| CN | 105357994 | A | 2/2016 |
| CN | 205018293 | U | 2/2016 |
| CN | 105361250 | A | 3/2016 |
| CN | 105453598 | A | 3/2016 |
| CN | 205180371 | U | 4/2016 |
| CN | 205337598 | U | 6/2016 |
| CN | 105747281 | A | 7/2016 |
| CN | 105831812 | A | 8/2016 |
| CN | 105848503 | A | 8/2016 |
| CN | 105876869 | A | 8/2016 |
| CN | 205512358 | U | 8/2016 |
| CN | 205597118 | U | 9/2016 |
| CN | 106037014 | A | 10/2016 |
| CN | 205648910 | U | 10/2016 |
| CN | 106102492 | A | 11/2016 |
| CN | 106132217 | A | 11/2016 |
| CN | 106163307 | A | 11/2016 |
| CN | 205728067 | U | 11/2016 |
| CN | 106174699 | A | 12/2016 |
| CN | 106231934 | A | 12/2016 |
| CN | 205831062 | U | 12/2016 |
| CN | 106413439 | A | 2/2017 |
| CN | 106413444 | A | 2/2017 |
| CN | 106455708 | A | 2/2017 |
| CN | 106455714 | A | 2/2017 |
| CN | 106455716 | A | 2/2017 |
| CN | 106473233 | A | 3/2017 |
| CN | 106901404 | A | 6/2017 |
| CN | 206312988 | U | 7/2017 |
| CN | 105342011 | B | 6/2018 |
| DE | 3302518 | A1 | 7/1984 |
| EA | 012169 | B1 | 8/2009 |
| EA | 026076 | B1 | 2/2017 |
| EP | 1119267 | B1 | 7/2004 |
| EP | 2113178 | A1 | 11/2009 |
| EP | 2 201 850 | A1 | 6/2010 |
| EP | 2253233 | A1 | 11/2010 |
| EP | 2316286 | A1 | 5/2011 |
| EP | 2 531 053 | B1 | 9/2015 |
| EP | 3 098 738 | A1 | 11/2016 |
| EP | 2 432 339 | B1 | 3/2017 |
| EP | 3 179 828 | A1 | 6/2017 |
| EP | 3 275 319 | B1 | 8/2020 |
| GB | 2542018 | A | 3/2017 |
| JP | 3-232481 | A | 10/1991 |
| JP | 7-184627 | A | 7/1995 |
| JP | 11-40122 | A | 2/1999 |
| JP | 11-164679 | A | 6/1999 |
| JP | 3645921 | B2 | 5/2005 |
| JP | 2006-320286 | A | 11/2006 |
| JP | 4278306 | B2 | 6/2009 |
| JP | 2010-178730 | A | 8/2010 |
| JP | 2010-526553 | A | 8/2010 |
| JP | 2011-87569 | A | 5/2011 |
| JP | 2011-518567 | A | 6/2011 |
| JP | 4739433 | B2 | 8/2011 |
| JP | 2012-527222 | A | 11/2012 |
| JP | 2014-500017 | A | 1/2014 |
| JP | 2014-521419 | A | 8/2014 |
| JP | 2014-525237 | A | 9/2014 |
| JP | 2014-533513 | A | 12/2014 |
| JP | 2014-534813 | A | 12/2014 |
| JP | 2015-503916 | A | 2/2015 |
| JP | 2015-506170 | A | 3/2015 |
| JP | 2015-507477 | A | 3/2015 |
| JP | 2015-508996 | A | 3/2015 |
| JP | 2015-524261 | A | 8/2015 |
| JP | 2015-180214 | A | 10/2015 |
| JP | 2015-529458 | A | 10/2015 |
| JP | 2015-204833 | A | 11/2015 |
| JP | 2016-528910 | A | 9/2016 |
| JP | 3207506 | U | 11/2016 |
| JP | 2017-51189 | A | 3/2017 |
| JP | 2017-70297 | A | 4/2017 |
| JP | 2017-514463 | A | 6/2017 |
| KR | 10-0304044 | B1 | 11/2001 |
| KR | 10-0636287 | B1 | 10/2006 |
| KR | 10-0806461 | B1 | 2/2008 |
| KR | 10-0965099 | B1 | 6/2010 |
| KR | 10-1001077 | B1 | 12/2010 |
| KR | 10-2011-0096548 | A | 8/2011 |
| KR | 20-2011-0009632 | U | 10/2011 |
| KR | 10-1098112 | B1 | 12/2011 |
| KR | 10-2012-0027029 | A | 3/2012 |
| KR | 10-2012-0101637 | A | 9/2012 |
| KR | 10-1184499 | B1 | 9/2012 |
| KR | 10-2012-0109634 | A | 10/2012 |
| KR | 10-2012-0114333 | A | 10/2012 |

(56) References Cited

FOREIGN PATENT DOCUMENTS

| | | | |
|---|---|---|---|
| KR | 10-2012-0121314 | A | 11/2012 |
| KR | 10-2013-0027909 | A | 3/2013 |
| KR | 20-0466757 | Y1 | 5/2013 |
| KR | 10-2013-0081238 | A | 7/2013 |
| KR | 10-2013-0139296 | A | 12/2013 |
| KR | 10-2014-0015774 | A | 2/2014 |
| KR | 10-1383577 | B1 | 4/2014 |
| KR | 10-2014-0068203 | A | 6/2014 |
| KR | 10-2014-0092312 | A | 7/2014 |
| KR | 10-2014-0116055 | A | 10/2014 |
| KR | 10-2014-0118983 | A | 10/2014 |
| KR | 10-2014-0119072 | A | 10/2014 |
| KR | 10-2014-0135774 | A | 11/2014 |
| KR | 10-2015-0030409 | A | 3/2015 |
| KR | 10-2015-0033617 | A | 4/2015 |
| KR | 10-2015-0058569 | A | 5/2015 |
| KR | 10-1516304 | B1 | 5/2015 |
| KR | 10-1523088 | B1 | 5/2015 |
| KR | 10-1523088 | B2 | 5/2015 |
| KR | 10-2015-0099704 | A | 9/2015 |
| KR | 10-2015-0099771 | A | 9/2015 |
| KR | 10-2016-0009678 | A | 1/2016 |
| KR | 10-2016-0012110 | A | 2/2016 |
| KR | 10-2016-0012329 | A | 2/2016 |
| KR | 10-2016-0015144 | A | 2/2016 |
| KR | 10-2016-0040643 | A | 4/2016 |
| KR | 10-1609715 | B1 | 4/2016 |
| KR | 10-2016-0052607 | A | 5/2016 |
| KR | 10-2016-0060006 | A | 5/2016 |
| KR | 10-1619032 | B1 | 5/2016 |
| KR | 20-2016-0001476 | U | 5/2016 |
| KR | 10-2016-0088163 | A | 7/2016 |
| KR | 10-2016-0094938 | A | 8/2016 |
| KR | 10-2016-0096744 | A | 8/2016 |
| KR | 10-2016-0108855 | A | 9/2016 |
| KR | 10-1656061 | B1 | 9/2016 |
| KR | 10-2016-0114743 | A | 10/2016 |
| KR | 10-2016-0124091 | A | 10/2016 |
| KR | 10-1667124 | B1 | 10/2016 |
| KR | 10-1668175 | B1 | 10/2016 |
| KR | 10-2016-0129024 | A | 11/2016 |
| KR | 10-2016-0131035 | A | 11/2016 |
| KR | 10-2016-0133665 | A | 11/2016 |
| KR | 10-2016-0137627 | A | 11/2016 |
| KR | 10-1679489 | B1 | 11/2016 |
| KR | 10-2016-0140608 | A | 12/2016 |
| KR | 10-2016-0142896 | A | 12/2016 |
| KR | 10-2016-0147253 | A | 12/2016 |
| KR | 10-1690389 | B1 | 12/2016 |
| KR | 10-2017-0006282 | A | 1/2017 |
| KR | 10-2017-0007262 | A | 1/2017 |
| KR | 10-2017-0044158 | A | 4/2017 |
| KR | 10-2017-0071486 | A | 6/2017 |
| KR | 10-2017-0074898 | A | 6/2017 |
| KR | 10-1740160 | B1 | 6/2017 |
| RU | 2302806 | C2 | 7/2007 |
| RU | 2425608 | C2 | 8/2011 |
| RU | 2 531 890 | C2 | 10/2014 |
| RU | 2564600 | C1 | 10/2015 |
| RU | 2014 125 232 | A | 12/2015 |
| RU | 2581999 | C2 | 4/2016 |
| RU | 2589437 | C2 | 7/2016 |
| RU | 2594557 | C2 | 8/2016 |
| RU | 2595593 | C2 | 8/2016 |
| RU | 2 602 053 | C2 | 11/2016 |
| RU | 2 602 962 | C2 | 11/2016 |
| RU | 2 603 559 | C2 | 11/2016 |
| RU | 2 604 012 | C2 | 12/2016 |
| RU | 2604012 | C2 | 12/2016 |
| WO | 94/06314 | A1 | 3/1994 |
| WO | 98/23171 | A1 | 6/1998 |
| WO | 0027232 | A1 | 5/2000 |
| WO | 2010/133342 | A1 | 11/2010 |
| WO | 2011/028372 | A1 | 3/2011 |
| WO | 2011/050964 | A1 | 5/2011 |
| WO | 2011/095781 | A1 | 8/2011 |
| WO | 2012/072264 | A1 | 6/2012 |
| WO | 2012/123702 | A1 | 9/2012 |
| WO | 2013/034458 | A1 | 3/2013 |
| WO | 2013/060743 | A2 | 5/2013 |
| WO | 2013/076098 | A2 | 5/2013 |
| WO | 2013/098395 | A1 | 7/2013 |
| WO | 2013/098398 | A3 | 7/2013 |
| WO | 2013/098409 | A1 | 7/2013 |
| WO | 2013/102609 | A2 | 7/2013 |
| WO | 2013/102612 | A2 | 7/2013 |
| WO | 2013102609 | A2 | 7/2013 |
| WO | 2013/120565 | A3 | 8/2013 |
| WO | 2013/126777 | A2 | 8/2013 |
| WO | 2013/137084 | A1 | 9/2013 |
| WO | 2013/171217 | A1 | 11/2013 |
| WO | 2013/190036 | A1 | 12/2013 |
| WO | 2014/029880 | A2 | 2/2014 |
| WO | 2015/046386 | A1 | 4/2015 |
| WO | 2015/088744 | A1 | 6/2015 |
| WO | 2015/128665 | A1 | 9/2015 |
| WO | 2015155289 | A1 | 10/2015 |
| WO | 2015/165813 | A1 | 11/2015 |
| WO | 2015/177044 | A1 | 11/2015 |
| WO | 2015197627 | A1 | 12/2015 |
| WO | 2016/059073 | A1 | 4/2016 |
| WO | 2016/075028 | A1 | 5/2016 |
| WO | 2016/076147 | A1 | 5/2016 |
| WO | 2016/107766 | A1 | 7/2016 |
| WO | 2016/124550 | A1 | 8/2016 |
| WO | 2016/124552 | A1 | 8/2016 |
| WO | 2016/150019 | A1 | 9/2016 |
| WO | 2016/156103 | A1 | 10/2016 |
| WO | 2016/156219 | A1 | 10/2016 |
| WO | 2016/159013 | A1 | 10/2016 |
| WO | 2016/166064 | A1 | 10/2016 |
| WO | 2016/178377 | A1 | 11/2016 |
| WO | 2017/029088 | A1 | 2/2017 |
| WO | 2017/029089 | A1 | 2/2017 |
| WO | 2017/037457 | A1 | 3/2017 |
| WO | 2017/042297 | A1 | 3/2017 |
| WO | 2017/075759 | A1 | 5/2017 |
| WO | 2017/139963 | A1 | 8/2017 |
| WO | 2018/050449 | A1 | 3/2018 |
| WO | 2018/189195 | A1 | 10/2018 |
| WO | 2019/020826 | A1 | 1/2019 |
| WO | 2019/030172 | A1 | 2/2019 |
| WO | 2019/095268 | A1 | 5/2019 |

OTHER PUBLICATIONS

Office Action dated Dec. 11, 2019 in Korean Application No. 10-2018-0010841.

Office Action dated Dec. 19, 2019 in Korean Application No. 10-2018-0090910.

Office Action dated Jan. 3, 2020 in Korean Application No. 10-2018-0012456.

Office Action dated Jan. 3, 2020 in Korean Application No. 10-2017-0084389.

Office Action dated Jan. 3, 2020 in Korean Application No. 10-2017-0084386.

Office Action dated Jan. 3, 2020 in Korean Application No. 10-2018-0018693.

Office Action dated Jan. 8, 2020 in Korean Application No. 10-2017-0128293.

Office Action dated Jan. 8, 2020 in Korean Application No. 10-2017-0119664.

Office Action dated Jan. 16, 2020 in Korean Application No. 10-2017-0084388.

Office Action dated Jan. 16, 2020 in Korean Application No. 10-2017-0084387.

Office Action dated Feb. 11, 2020 in Korean Application No. 10-2018-0010834.

Office Action dated Feb. 11, 2020 in Korean Application No. 10-2018-0010835.

Office Action dated Feb. 13, 2020 in Korean Application No. 10-2018-0010837.

(56) References Cited

OTHER PUBLICATIONS

Office Action dated Feb. 18, 2020 in Russian Application No. 2019121813.
Office Action dated Nov. 14, 2019 in Korean Application No. 10-2017-0084385.
Office Action dated Nov. 14, 2019 in Korean Application No. 10-2017-0147605.
Extended European Search Report dated Jan. 14, 2021 in European Application No. 18783776.0.
Extended European Search Report dated Jan. 25, 2021 in European Application No. 18785166.2.
Extended European Search Report dated Jan. 29, 2021 in European Application No. 18784464.2.
Extended European Search Report dated Mar. 15, 2021 in European Application No. 18785061.5.
Extended European Search Report dated Mar. 19, 2021 in European Application No. 18784164.8.
Extended European Search Report dated Mar. 24, 2021 in European Application No. 18784268.7.
Extended European Search Report dated Mar. 25, 2021 in European Application No. 18784370.1.
Extended European Search Report dated Mar. 25, 2021 in European Application No. 18784841.1.
Office Action dated Feb. 24, 2021 in Japanese Application No. 2019-555168.
Office Action dated Feb. 24, 2021 in Japanese Application No. 2019-555203.
Office Action dated Feb. 24, 2021 in Japanese Application No. 2019-555204.
Office Action dated Feb. 4, 2021 in Russian Application No. 2020124609.
Office Action dated Feb. 9, 2021 in Japanese Application No. 2019-555184.
Office Action dated Jan. 26, 2021 in Japanese Application No. 2020-501521.
Office Action dated Mar. 2, 2021 in Japanese Application No. 2019-555170.
Office Action dated Mar. 2, 2021 in Japanese Application No. 2019-555182.
Office Action dated Mar. 30, 2021 in Japanese Application No. 2020-501377.
Office Action dated Jan. 19, 2021 in Indonesian Application No. P00201906007.
Office Action dated Jul. 27, 2021 in Chinese Patent Application No. 201780084891.5.
Office Action dated Aug. 16, 2021 in Chinese Patent Application No. 201880024006.9.
Office Action dated Aug. 26, 2021 in Chinese Patent Application No. 201880024107.6.
Office Action dated Aug. 4, 2021 in Chinese Patent Application No. 201880024289.7.
Office Action dated Jul. 26, 2021 in Chinese Patent Application No. 201880024059.0.
Office Action dated Jul. 16, 2021 in Chinese Patent Application No. 201880024367.3.
Office Action dated Jul. 19, 2021 Chinese Patent Application No. 201880024070.7.
Office Action dated Sep. 17, 2021 in Chinese Patent Application No. 201880030699.2.
Office Action dated Jul. 22, 2021 in Korean Application No. 10-2021-0051359.
Extended European Search Report dated Apr. 1, 2021 in European Application No. 18805933.1.
Extended European Search Report dated Jan. 15, 2021 in European Application No. 20188949.0.
Extended European Search Report dated Jul. 1, 2021 in European Application No. 18854661.8.
Extended European Search Report dated Jun. 14, 2021 in European Application No. 18842951.8.
Extended European Search Report dated Jun. 16, 2021 in European Application No. 18853434.1.
International Search Report dated Aug. 29, 2018 in International Application No. PCT/KR2018/005945.
International Search Report dated Dec. 4, 2018 in International Application No. PCT/KR2018/006747.
International Search Report dated Feb. 28, 2019 in International Application No. PCT/KR2018/009100.
International Search Report dated Nov. 26, 2018 in International Application No. PCT/KR2018/009094.
International Search Report dated Nov. 30, 2018 in International Application No. PCT/KR2018/006702.
Office Action dated Apr. 25, 2019 in Korean Application No. 10-2019-0033784.
Office Action dated Apr. 4, 2019 in Korean Application No. 10-2019-0019194.
Office Action dated Apr. 4, 2019 in Korean Application No. 10-2019-0019195.
Office Action dated Apr. 5, 2019 in Korean Application No. 10-2019-0027638.
Office Action dated Apr. 9, 2021 in Korean Application No. 10-2020-0116256.
Office Action dated Jun. 10, 2021 in Russian Application No. 2020124657.
Office Action dated Jun. 10, 2021 in Russian Application No. 2020124658.
Office Action dated Jun. 29, 2021 in Chinese Application No. 201880022072.2.
Office Action dated May 5, 2021 in Canadian Application No. 3,047,236.
Extended European Search Report dated Dec. 11, 2020 in European Application No. 20188967.2.
Extended European Search Report dated Dec. 16, 2020 in European Application No. 20188985.4.
Office Action dated Dec. 30, 2020 in Russian Application No. 2020124651.
Office Action dated Dec. 28, 2020 in Russian Application No. 2020124652.
Office Action dated Dec. 11, 2020 in Russian Application No. 2020124653.
Office Action dated Jan. 22, 2021 in Russian Application No. 2020124657.
Office Action dated Jan. 22, 2021 in Russian Application No. 2020124658.
Extended European Search Report dated Dec. 18, 2020 in European Application No. 18775504.6.
Office Action dated Jan. 19, 2021 in Japanese Application No. 2019-553569.
Extended European Search Report dated Jan. 14, 2021 in European Application No. 18784738.9.
Extended European Search Report dated Dec. 10, 2020 in European Application No. 20188932.6.
Office Action dated Jan. 12, 2021 in Japanese Application No. 2019-555201.
Office Action dated Jan. 12, 2021 in Japanese Application No. 2019-555169.
Office Action dated Jan. 5, 2021 in Japanese Application No. 2019-558557.
Extended European Search Report dated Nov. 19, 2020 in European Application No. 20188792.4.
Office Action dated Dec. 1, 2020 in Japanese Application No. 2020-501188.
Extended European Search Report dated Dec. 18, 2020 in European Application No. 20188926.8.
Office Action dated Jan. 19, 2021 in Japanese Application No. 2020-501514.
Office Action dated Sep. 24, 2020 in Korean Application No. 10-2018-0012456.
Office Action dated May 28, 2020 in Korean Application No. 10-2017-0147605.
Office Action dated Aug. 7, 2019 for Korean Patent Application No. 10-2018-0067035, and its English translation provided by Applicants foreign counsel.

(56) References Cited

OTHER PUBLICATIONS

Office Action dated Jun. 27, 2019 for Korean Patent Application No. 10-2018-0063759, and its English translation provided by Applicants foreign counsel.
Office Action dated Jul. 2, 2019 for Korean Patent Application No. 10-2019-0018815, and its English translation provided by Applicants foreign counsel.
Office Action dated Jul. 3, 2019 for Korean Patent Application No. 10-2019-0017391, and its English translation provided by Applicants foreign counsel.
International Preliminary Report on Patentability (Chapter I) dated Jun. 18, 2019 for PCT/KR2017/012486 and its English translation from WIPO.
Written Opinion of the International Searching Authority for PCT/KR2017/012486 dated May 29, 2018 and its English translation by Google Translate (now published as WO 2018/110834).
Partial supplementary European search report dated Aug. 3, 2020 in Application No. 17880867.1.
Extended European search report dated Nov. 4, 2020 by the European Patent Office in Application No. 17880867.1.
Office Action dated Oct. 29, 2020 by the Korean Patent Office in Application No. 10-2018-0010837.
Office Action dated Nov. 4, 2020 by the Japanese Patent Office in Application No. 2019-554453.
Office Action dated Nov. 4, 2020 by the Japanese Patent Office in Application No. 2020-128346.
Decision on Grant dated Nov. 26, 2020 by the Russian Federal Service For Intellectual Property Patent Application No. 2020124607.
Office Action dated Nov. 26, 2020 by Russian Federal Service For Intellectual Property Office Patent Application No. 2020124609.
Decision on Grant dated Oct. 26, 2020 by Russian Federal Service For Intellectual Property in Application No. 2020124610.
Office Action dated Jun. 29, 2020 by the Korean Patent Office in Application No. 10-2018-0010836.
Extended European Search Report dated Oct. 27, 2021 in European Application No. 18844735.3.
Office Action dated Oct. 28, 2021 in Chinese Application No. 201880046418.2.
Office Action dated Sep. 24, 2021 in Chinese Application No. 201880024010.5.
Office Action dated Sep. 29, 2021 in Chinese Application No. 201880024276.X.
Office Action dated Sep. 29, 2021 in Chinese Application No. 201880024311.8.
Office Action dated Nov. 25, 2021 in Chinese Application No. 201880047174.X.
Office Action dated Dec. 1, 2021 in Chinese Application No. 201880046367.3.
International Search Report dated Jul. 24, 2018 in International Application No. PCT/KR2018/003691.
Office Action dated Jul. 2, 2019 in Korean Application No. 10-2019-0018815.
Office Action dated Jul. 3, 2019 in Korean Application No. 10-2019-0017391.
International Search Report dated Oct. 29, 2018 in International Application No. PCT/KR2018/004181.
International Search Report dated Sep. 6, 2018 in International Application No. PCT/KR2018/004179.
International Search Report dated Nov. 6, 2018 in International Application No. PCT/KR2018/004178.
International Search Report dated Sep. 6, 2018 in International Application No. PCT/KR2018/004176.
International Search Report dated Sep. 7, 2018 in International Application No. PCT/KR2018/004172.
International Search Report dated Sep. 7, 2018 in International Application No. PCT/KR2018/004171.
International Search Report dated Nov. 6, 2018 in International Application No. PCT/KR2018/004130.
International Search Report dated Nov. 6, 2018 in International Application No. PCT/KR2018/004129.
International Search Report dated Nov. 14, 2018 in International Application No. PCT/KR2018/004118.
International Search Report dated May 29, 2018 in International Application No. PCT/KR2017/012486.
Office Action dated Feb. 28, 2022 in Chinese Application No. 201880050526.7.
Office Action dated Mar. 14, 2022 in Chinese Application No. 201880024059.0.

* cited by examiner

DEVICE FOR CLEANING SMOKING MEMBER, AND SMOKING MEMBER SYSTEM

CROSS REFERENCE TO RELATED APPLICATIONS

This application is a National Stage of International Application No. PCT/KR2018/004172 filed Apr. 10, 2018, claiming priority based on Korean Patent Application No. 10-2017-0046938, filed Apr. 11, 2017, Korean Patent Application No. 10-2017-0077586, filed Jun. 19, 2017, and Korean Patent Application No. 10-2017-0084387, filed Jul. 3, 2017.

TECHNICAL FIELD

The present disclosure relates to a smoking member cleaning device and a smoking member system.

BACKGROUND ART

From long ago, people have used various items for smoking. For example, rod-like cigarettes including filter members have been made and used.

On the other hand, various types of articles for smoking are being developed, and various smoking environments are becoming available to users by partially or completely inserting smoking materials into smoking members.

In many cases, it is difficult for users to handle and maintain such smoking members, and because it is difficult to maintain smoking members especially after smoking using the smoking members, there is a limit to improving user convenience.

BRIEF SUMMARY OF THE INVENTION

The present disclosure relates to a smoking member cleaning device and a smoking member system capable of improving user convenience for smoking and maintenance of a smoking member.

According to an aspect of the present disclosure, there is provided a smoking member cleaning device formed to perform cleaning on a smoking member, the smoking member cleaning device including a main body unit; an accommodating unit formed in one region of the main body unit to accommodate one region of the smoking member when the smoking member is being cleaned; a cleaning unit formed in the accommodating unit and configured to clean the smoking member; a cleaning driving unit connected to the cleaning unit and configured to clean the smoking member by moving the cleaning unit; and a power supply unit configured to supply driving energy to the cleaning driving unit.

In the present embodiment, the power supply unit may be formed to be connected to an external power supply.

In the present embodiment, the smoking member may includes a main region and an insertion groove formed to be connected to one end of the main region, and the cleaning unit may correspond to the insertion groove during the cleaning of the smoking member.

In the present embodiment, the smoking member cleaning device may further include a heater unit arranged in the insertion groove and configured to heat a smoking material, and the cleaning unit may contact the heater unit during the cleaning of the smoking member.

In the present embodiment, the cleaning unit may have a brush-like form comprising a plurality of fiber strands.

In the present embodiment, the power supply unit may be connected to a connecting unit arranged in a smoking member supporting device including a mounting unit for mounting the smoking member, and the smoking member may be cleaned as driving energy is transferred from the power supply unit to the cleaning driving unit through the connecting unit.

In the present embodiment, the smoking member cleaning device may be arranged in a smoking member supporting device including a mounting unit for mounting the smoking member and a connecting unit corresponding to the smoking member and the power supply unit is connected to a connecting member which is apart from the connecting unit, and the smoking member may be cleaned as driving energy is transferred from the power supply unit to the cleaning driving unit through the connecting member.

In the present embodiment, the power supply unit may be connected to a connecting unit arranged in a smoking member accommodating device including an accommodating region for accommodating the smoking member, and the smoking member may be cleaned as driving energy is transferred from the power supply unit to the cleaning driving unit through the connecting unit.

In the present embodiment, the smoking member cleaning device may be arranged in a smoking member accommodating device including an accommodating region for accommodating the smoking member and a connecting unit corresponding to the smoking member and the power supply unit is connected to a connecting member which is apart from the connecting unit, and the smoking member may be cleaned as driving energy is transferred from the power supply unit to the cleaning driving unit through the connecting member.

In the present embodiment, the smoking member cleaning device may be arranged in a smoking member accommodating device including an accommodating region for accommodating the smoking member and a connecting unit corresponding to the smoking member, and the power supply unit is connected to a connecting member which is apart from the connecting unit, and the smoking member may be cleaned as driving energy is transferred from the power supply unit to the cleaning driving unit through the connecting member.

In the present embodiment, the smoking member cleaning device may further include a protruding region protruding from the main body unit, and the power supply unit may be formed in the protruding region.

According to another aspect of the present disclosure, there is provided a smoking member system including a smoking member cleaning device configured to clean a smoking member and a smoking member supporting device for mounting the smoking member, wherein the smoking member cleaning device includes a main body unit; an accommodating unit formed in one region of the main body unit to accommodate one region of the smoking member when the smoking member is being cleaned; a cleaning unit formed in the accommodating unit and configured to clean the smoking member; a cleaning driving unit connected to the cleaning unit and configured to clean the smoking member by moving the cleaning unit; and a power supply unit configured to supply driving energy to the cleaning driving unit, the smoking member supporting device includes a base unit; a mounting unit formed in the base unit and configured to mount the smoking member thereon; and a connecting unit configured to be connected to the power supply unit, and the smoking member is cleaned as driving energy is transferred from the power supply unit to the cleaning driving unit through the connecting unit.

According to another aspect of the present disclosure, there is provided a smoking member system including a smoking member cleaning device configured to clean a smoking member and a smoking member accommodating device for accommodating the smoking member, wherein the smoking member cleaning device includes a main body unit; an accommodating unit formed in one region of the main body unit to accommodate one region of the smoking member when the smoking member is being cleaned; a cleaning unit formed in the accommodating unit and configured to clean the smoking member; a cleaning driving unit connected to the cleaning unit and configured to clean the smoking member by moving the cleaning unit; and a power supply unit configured to supply driving energy to the cleaning driving unit, the smoking member accommodating device includes an accommodation housing; an accommodating region formed in the accommodation housing and configured to accommodate the smoking member; and a connecting unit configured to be connected to the power supply unit, and the smoking member is cleaned as driving energy is transferred from the power supply unit to the cleaning driving unit through the connecting unit.

Other aspects, features, and advantages will become apparent from the following drawings, claims, and detailed description of the disclosure.

A smoking member cleaning device and a smoking member system according to embodiments of the present disclosure may improve user convenience for smoking and maintaining a smoking member.

BRIEF DESCRIPTION OF THE DRAWINGS

FIGS. 20A and 22B are diagrams showing examples in which a holder is inserted into a cradle.

DETAILED DESCRIPTION OF THE INVENTION

Figure 1:
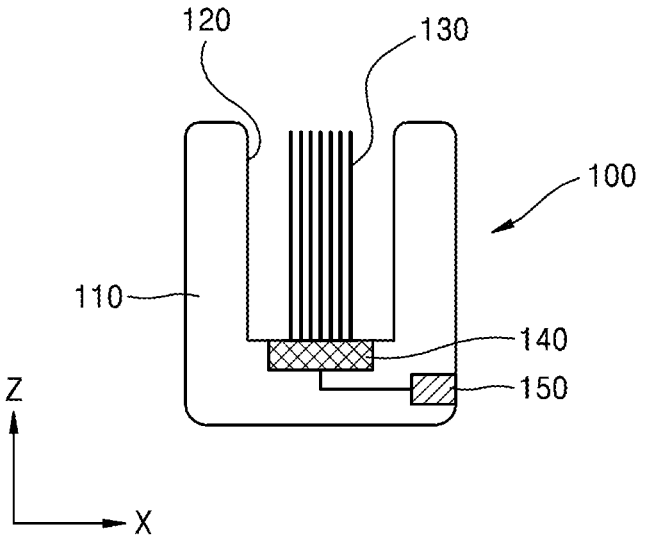
FIG. 1 is a diagram schematically showing a smoking member cleaning device according to an embodiment of the present disclosure.

According to an aspect of the present disclosure, there is provided a smoking member cleaning device formed to perform cleaning on a smoking member, the smoking member cleaning device including a main body unit; an accommodating unit formed in one region of the main body unit to accommodate one region of the smoking member when the smoking member is being cleaned; a cleaning unit formed in the accommodating unit and configured to perform cleaning on the smoking member; a cleaning driving unit connected to the cleaning unit and configured to perform cleaning on the smoking member by moving the cleaning unit; and a power supply unit configured to supply driving energy to the cleaning driving unit.

The present disclosure may include various embodiments and modifications, and embodiments thereof will be illustrated in the drawings and will be described herein in detail. The effects and features of the present disclosure and the accompanying methods thereof will become apparent from the following description of the embodiments, taken in conjunction with the accompanying drawings. However, the present disclosure is not limited to the embodiments described below, and may be embodied in various modes.

Reference will now be made in detail to embodiments, examples of which are illustrated in the accompanying drawings. In the drawings, the same elements are denoted by the same reference numerals, and a repeated explanation thereof will not be given.

It will be understood that although the terms "first", "second", etc. may be used herein to describe various elements, these elements should not be limited by these terms. These elements are only used to distinguish one element from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Sizes of elements in the drawings may be exaggerated for convenience of explanation. In other words, since sizes and thicknesses of components in the drawings are arbitrarily illustrated for convenience of explanation, the following embodiments are not limited thereto.

In the following examples, the x-axis, the y-axis and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

When a certain embodiment may be implemented differently, a specific process order may be performed differently from the described order. For example, two consecutively described processes may be performed substantially at the same time or performed in an order opposite to the described order.

FIG. 1 is a diagram schematically showing a smoking member cleaning device according to an embodiment of the present disclosure.

Figure 2A:
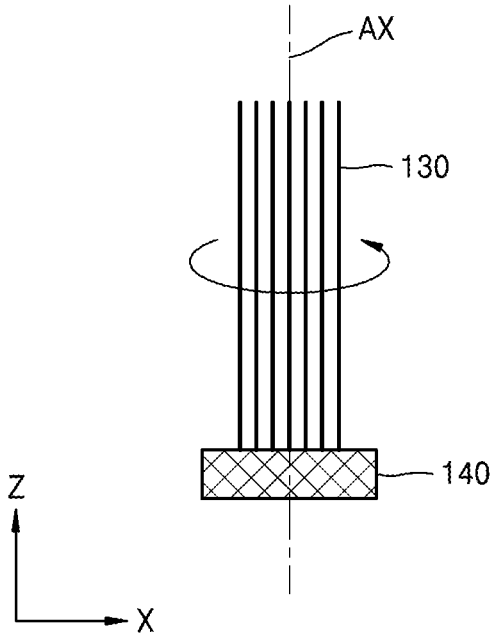
FIGS. 2A to 2C are diagrams showing specific modifications of a cleaning unit and a cleaning driving unit of the smoking member cleaning device of FIG. 1.
Figure 2B:
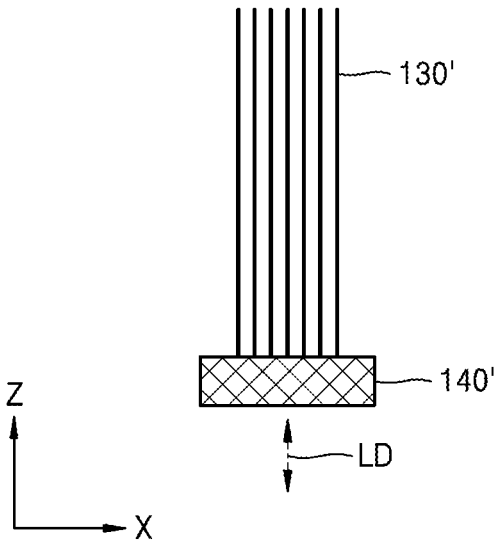
Figure 2C:
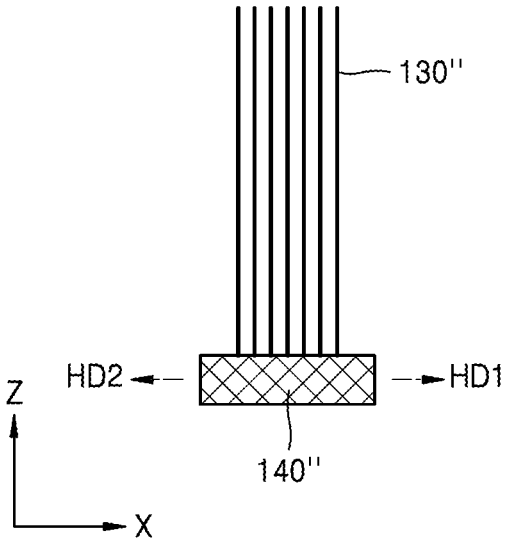

FIGS. 2A to 2C are diagrams showing specific modifications of a cleaning unit and a cleaning driving unit of the smoking member cleaning device of FIG. 1.

Figure 3:
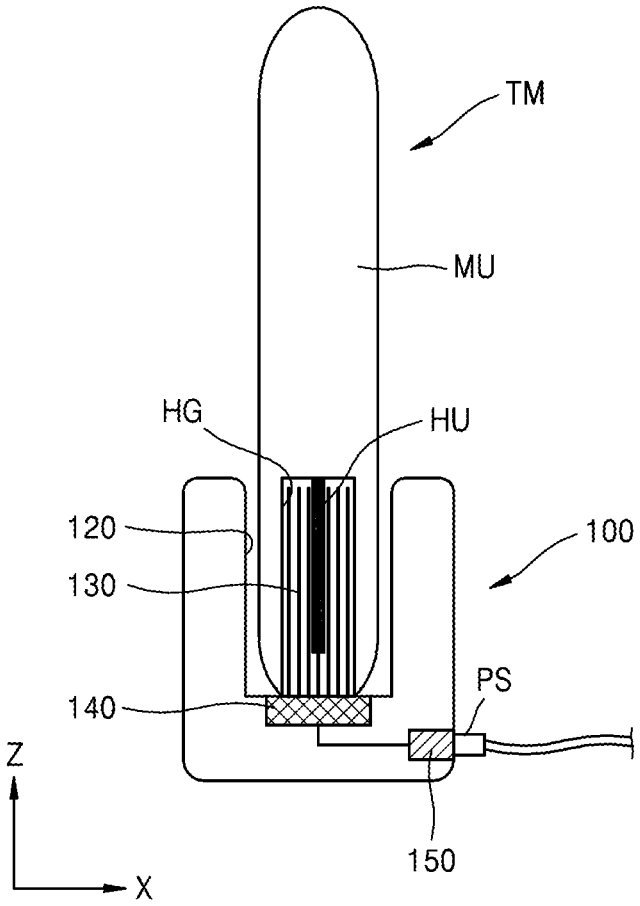
FIG. 3 is a diagram showing an example of an operation for cleaning a smoking member by using the smoking member cleaning device of FIG. 1.

FIG. 3 is a diagram showing an example of an operation for cleaning a smoking member by using the smoking member cleaning device of FIG. 1.

Referring to FIGS. 1 to 3, the smoking member cleaning device 100 according to the present embodiment may include a main body unit 110, an accommodating unit 120, a cleaning unit 130, a cleaning driving unit 140, and a power supply unit 150.

The main body unit 110 constitutes the main area of the smoking member cleaning device 100 and may be formed of a durable material to facilitate handling and storage of the smoking member cleaning device 100.

For example, the main body unit 110 may include a resin-based material. In another example, the main body unit 110 may include a ceramic material. In another example, the main body unit 110 may include a metal.

In some embodiments, the main body unit 110 may have a cylinder-like shape having an appropriate width to facilitate handling by a user, e.g., a cuboidal shape or a cylindrical shape.

The main body unit 110 may have a long shape extending in one direction, wherein the length of the main body unit 110 may be smaller than the length of the smoking member TM for user convenience.

The accommodating unit 120 may be formed to accommodate at least one region of the smoking member TM to perform a cleaning operation on the smoking member TM. The accommodating unit 120 may have a groove-like shape having a certain depth.

The accommodating unit 120 may be formed to have a width larger than the width of the smoking member TM in one direction as shown in FIG. 3 to accommodate the smoking member TM.

At least one region of the accommodating unit 120 may be surrounded by the main body unit 110. For example, the inner side surface of accommodating unit 120 may be surrounded by the main body unit 110.

Also, in some embodiments, one inner region of the accommodating unit 120 may be surrounded by the main body unit 110, and another region of the accommodating unit 120 may be opened without being surrounded by the main body unit 110.

The cleaning unit 130 may be formed in the accommodating unit 120. The cleaning unit 130 is formed to perform cleaning on the smoking member TM.

Referring to FIG. 3, the smoking member TM may include a main region MU and an insertion groove HG to be connected to one end of the main region MU.

A heater unit HU may be disposed in the insertion groove HG.

A smoking material for a user to smoke may be inserted into the insertion groove HG, and the smoking material may be heated by the heater unit HU to allow the user to perform a smoking process.

In some embodiments, the cleaning unit 130 may have a brush-like shape and include a plurality of fiber strands. Here, the plurality of fiber strands may include various materials. In some embodiments, the plurality of fiber strands may include synthetic fiber-based materials like resins to have an appropriate strength to clean while contacting the space of the smoking member TM, e.g., the inner side surface of the insertion groove HG or the heater unit HU, and to prevent or detect damage to the smoking member TM.

The direction in which the cleaning unit 130 extends may be parallel to the depthwise direction of the accommodating unit 120. Also, in another example, the cleaning unit 130 may include a portion formed in a diagonal direction crossing the depthwise direction of the accommodating unit 120.

Also, the cleaning unit 130 may contact the heater unit HU of the smoking member TM and clean the heater unit HU via the contact with the heater unit HU of the smoking member TM.

For example, a smoking material for smoking is inserted into the insertion groove HG as described above, and the smoking material is heated by the heater unit HU for a user to perform a smoking process. Therefore, residues or by-products of the smoking material may be present in the insertion groove HG after the smoking process, and more residues or by-products may be present at the heater unit HU. The residues or by-products may affect subsequent smoking processes and reduce user satisfaction or the safety of the smoking member TM.

The cleaning unit 130 may facilitate the cleaning of the insertion groove HG and the heater unit HU.

For example, after a smoking process using the smoking member TM and before a next smoking process, the smoking member (TM), and more particularly, the insertion groove HG and the heater unit HU may be easily cleaned by using the cleaning unit 130. At this time, the cleaning unit 130 may contact and easily clean the insertion groove HG and the heater unit HU.

The cleaning driving unit 140 may be connected to the cleaning unit 130, and the cleaning unit 130 may be moved by the cleaning driving unit 140.

For example, as shown in FIG. 2A, the cleaning unit 130 may perform a rotational movement around a rotation axis AX by rotational driving of the cleaning driving unit 140.

In some embodiments, the cleaning unit 130 may rotate at least once, that is, at least 360 degrees.

In another example, the cleaning unit 130 may perform an angular movement of less than 360 degrees.

The rotation axis AX may be parallel to the lengthwise direction of the cleaning unit 130. Also, the rotation axis AX may be in a direction parallel to the insertion groove HG of the smoking member TM when the smoking member TM is accommodated in the accommodating unit 120.

As a result, the cleaning unit 130 may clean the insertion groove HG in the insertion groove HG without leaving the insertion groove HG.

In particular, the cleaning of the insertion groove HG and the heater unit HU may be easily performed through the rotational movement of the cleaning unit 130.

In another example, referring to FIG. 2B, a cleaning unit 130' may be connected to a cleaning driving unit 140' and moved by the cleaning driving unit 140'. Specifically, the cleaning unit 130' may move unidirectionally or bidirectionally in a movement direction LD by linear movement of the cleaning driving unit 140'.

In some embodiments, the movement direction LD may be parallel to the lengthwise direction of the cleaning unit 130'. Also, the movement direction LD may be in a direction parallel to the insertion groove HG of the smoking member TM when the smoking member TM is accommodated in the accommodating unit 120. As a result, the cleaning unit 130' may clean the insertion groove HG in the insertion groove HG without leaving the insertion groove HG.

Also, in another example, referring to FIG. 2C, a cleaning unit 130" may be connected to a cleaning driving unit 140" and moved by the cleaning driving unit 140". Specifically, the cleaning unit 130" may move unidirectionally or bidirectionally in a movement direction HD1 or a movement direction HD2 by lateral driving of the cleaning driving unit 140".

In some embodiments, the movement direction HD1 or the movement direction HD2 may be parallel to the widthwise direction of the accommodating unit 120. Also, the movement direction HD1 or the movement direction HD2 may be a direction toward the inner side surface of the insertion groove HG of the smoking member TM when the smoking member TM is accommodated in the accommodating unit 120. In this case, the cleaning unit 130" may contact the inner side surface of the insertion groove HG, but a moving distance of the cleaning unit 130" in the movement direction HD1 or the movement direction HD2 may be restricted so as not to apply excessive force.

Although not shown, the movement of a cleaning unit through a cleaning driving unit may be in another form. For example, the cleaning of the insertion groove HG and the heater unit HU may be performed easily through a vibration movement of the cleaning unit through the cleaning driving unit.

Through this driving of the cleaning driving unit 140, in order to ensure effective cleaning characteristics during cleaning through the movement of the cleaning unit 130, the smoking member TM may be fixed without movement in the accommodating unit 120 during the cleaning.

To this end, a pressurizing member (not shown) having a shape similar to a protrusion for supporting through friction with the smoking member TM in the accommodating unit 120 may be formed.

In another embodiment, a protrusion may be formed in the accommodating unit 120 and a recess may be formed in a region of the smoking member TM corresponding to the protrusion, or vice versa.

In another embodiment, the smoking member TM may be fixed without movement in the accommodating unit 120 by using a physical method or an electrical method.

Also, the smoking member TM may be fixed without movement in the accommodating unit 120 by using a magnetic force.

The fixation of the smoking member TM in the accommodating unit 120 may be selectively applied to all the embodiments described below without a specific description.

The power supply unit 150 may be configured to supply energy needed for driving the cleaning driving unit 140, e.g., electrical energy.

The power supply unit 150 may be electrically connected to, for example, the cleaning driving unit 140.

The power supply unit 150 may be in various forms.

In some embodiment, the power supply unit 150 may receive electrical energy from a separate external power source and transfer the electrical energy to the cleaning driving unit 140, thereby supplying energy needed for the movement of the cleaning unit 130.

In this case, the smoking power supply unit 150 may be connected to a cable member PS as shown in FIG. 3, such as a power cable or a USB cable. To this end, the power supply unit 150 may include a power terminal, a USB terminal, etc.

In some other embodiment, the power supply unit 150 may be wirelessly connected to an external power source and receive energy through a wireless communication method. To this end, the power supply unit 150 may include a wireless communication module.

The operation and the action of the smoking member cleaning device of the present embodiment will be briefly described.

The smoking member cleaning device 100 of the present embodiment includes the cleaning unit 130 disposed in the accommodating unit 120, and the cleaning unit 130 may be moved by the cleaning driving unit 140. Through this, cleaning of the smoking member TM may be easily performed.

For example, as shown in FIG. 3, the smoking member TM may include the insertion groove HG and the heater unit HU disposed in the insertion groove HG, and the smoking member TM may be disposed in the accommodating unit 120, such that an open inlet region of the insertion groove HG corresponds to the cleaning unit 130.

At this time, the cleaning unit 130 may correspond to the insertion groove HG of the smoking member TM. For example, the entire cleaning unit 130 may be accommodated in the insertion groove HG.

Residue of a smoking material or by-products after smoking may remain in the insertion groove HG and the heater unit HU through a smoking process, and the insertion groove HG and heater unit HU may be cleaned through the cleaning unit 130.

At this time, the effect of cleaning the smoking member TM may be improved through a rotational movement, a linear movement, a lateral movement, or a vibration movement of the cleaning unit 130 by the cleaning driving unit 140.

The cleaning operation of the cleaning unit 130 through the cleaning driving unit 140 may be based on a selection of a user. In other words, when a user presses a selection button after the smoking member TM is accommodated in the accommodating unit 120 and external power is connected to the cleaning driving unit 140 through the power supply unit 150, cleaning may be performed.

In some embodiments, the cleaning operation of the cleaning unit 130 through the cleaning driving unit 140 may be automatically performed without a selection of a user. In other words, when the smoking member TM is accommodated in the accommodating unit 120, the smoking member cleaning device 100 detects the accommodation, and when external power is connected to the cleaning driving unit 140 through the power supply unit 150, the smoking member cleaning device 100 may perform cleaning.

To this end, the smoking member cleaning device 100 may further include an accommodation detector (not shown), and the accommodation detector may be disposed in the accommodating unit 120 to electrically, optically, or physically detect accommodation of the smoking member TM in the accommodating unit 120.

Also, in some other embodiments, the cleaning operation of the cleaning unit 130 through the cleaning driving unit 140 may be automatically performed without a selection of a user. For example, when external power is connected to the cleaning driving unit 140 through the power supply unit 150, the movement of the cleaning driving unit 140 may be performed regardless of accommodation of the smoking member TM.

Figure 4:
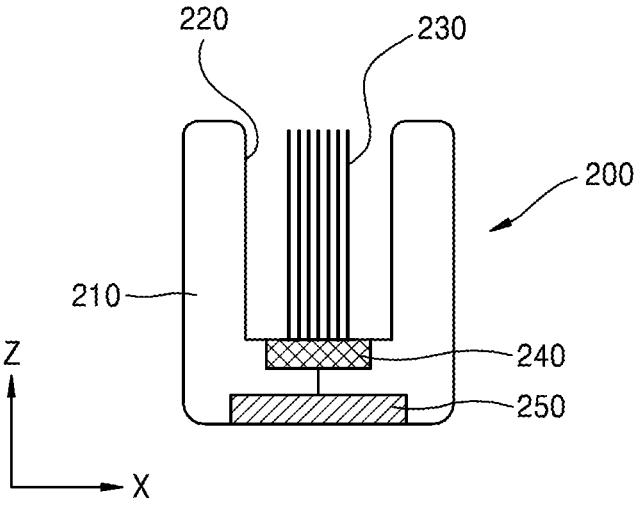
FIG. 4 is a diagram schematically showing a smoking member cleaning device according to another embodiment of the present disclosure.

FIG. 4 is a diagram schematically showing a smoking member cleaning device according to another embodiment of the present disclosure.

Referring to FIG. 4, a smoking member cleaning device 200 according to the present embodiment may include a main body unit 210, an accommodating unit 220, a cleaning unit 230, a cleaning driving unit 240, and a power supply unit 250.

Also, the examples of a cleaning driving unit of FIGS. 2A to 2C may be selectively applied.

For convenience of explanation, descriptions below will focus on differences from the above-described embodiment.

Since the main body unit 210, the accommodating unit 220, the cleaning unit 230, and the cleaning driving unit 240 of the present embodiment are the same as or similar to those of the above-described embodiments, detailed descriptions thereof will be omitted.

The power supply unit 250 may be configured to supply energy needed for driving the cleaning driving unit 240, e.g., electrical energy.

The power supply unit 250 may be electrically connected to, for example, the cleaning driving unit 240.

The power supply unit 250 may be in various forms. The power supply unit 250 may include a power supply and may include, for example, a battery.

In some embodiments, the power supply unit 250 may include a battery exchange unit and, to this end, may include a battery accommodating space and an exchange cover.

Also, in another example, the power supply unit 250 may include a rechargeable battery unit, may replace the rechargeable battery unit, and may be connected to an external power source while a rechargeable battery unit is fixed.

As the operation and the action of the smoking member cleaning device of the present embodiment are similar to those of the embodiment described above, detailed descriptions thereof will be briefly given.

The smoking member cleaning device 200 of the present embodiment includes the cleaning unit 230 disposed in the accommodating unit 220, and the cleaning unit 230 may be moved by the cleaning driving unit 240. Through this, cleaning of the smoking member TM may be easily performed.

At this time, the effect of cleaning the smoking member TM may be improved through a rotational movement, a linear movement, a lateral movement, or a vibration movement of the cleaning unit 230 by the cleaning driving unit 240.

The power supply unit 250 may supply electrical energy to the cleaning driving unit 240, through which the smoking member cleaning device 200 may perform a cleaning operation without being connected to an external power source. Therefore, portability of the smoking member cleaning device 200 may be improved.

Figure 5:
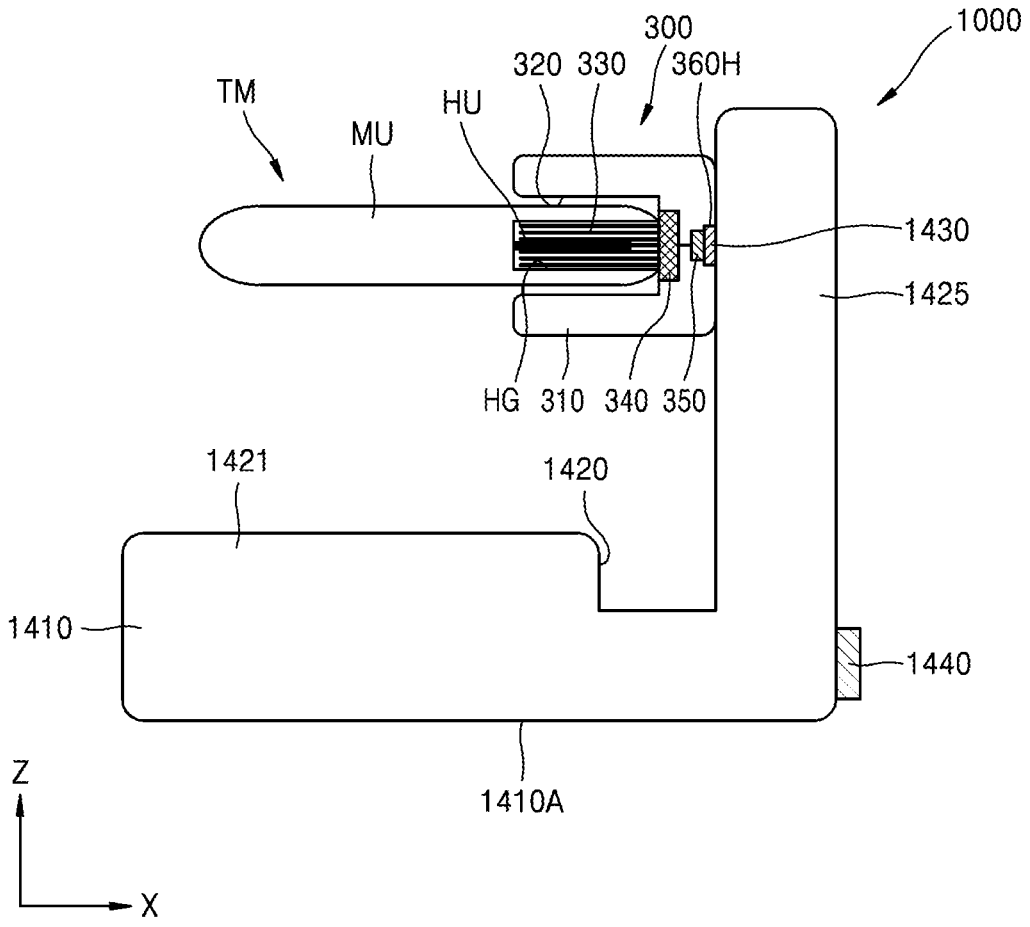
FIG. 5 is a diagram showing that a smoking member cleaning device according to an embodiment of the present disclosure is connected to a smoking member supporting device.

FIG. 5 is a diagram showing that a smoking member cleaning device according to an embodiment of the present disclosure is connected to a smoking member supporting device.

Referring to FIG. 5, the present embodiment may provide a smoking member cleaning device 300. The smoking member cleaning device 300 is connected to a smoking member supporting device 1000.

Referring to FIG. 5, the smoking member cleaning device 300 according to the present embodiment may include a main body unit 310, an accommodating unit 320, a cleaning unit 330, a cleaning driving unit 340, and a power supply unit 350.

For convenience of explanation, descriptions below will focus on differences from the above-described embodiments.

The main body unit 310 constitutes the main area of the smoking member cleaning device 300 and may be formed of a durable material to facilitate handling and storage of the smoking member cleaning device 300.

The accommodating unit 320 may be formed to accommodate at least one region of the smoking member TM to perform a cleaning operation on the smoking member TM. The accommodating unit 320 may have a groove-like shape having a certain depth.

The cleaning unit 330 may be formed in the accommodating unit 320. The cleaning unit 330 is formed to perform cleaning on the smoking member TM.

The smoking member TM may include a main region MU and an insertion groove HG to be connected to one end of the main region MU. A heater unit HU may be disposed in the insertion groove HG.

The cleaning driving unit 340 may be connected to the cleaning unit 330, and the cleaning unit 330 may be moved by the cleaning driving unit 340. Also, the examples of FIGS. 2A to 2C regarding the driving of the cleaning driving unit 340 may be selectively applied.

The power supply unit 350 may be configured to supply energy needed for driving the cleaning driving unit 340, e.g., electrical energy.

The power supply unit 350 may be electrically connected to, for example, the cleaning driving unit 340.

The power supply unit 350 may be connected to a connecting unit 1430 of the smoking member supporting device 1000. Detailed descriptions thereof will be given below.

The smoking member supporting device 1000 of the present embodiment may include a base unit 1410, a mounting unit 1420, a hook unit 1421, a supporting unit 1425, and a connecting unit 1430.

The base unit 1410 may have an arrangement surface 1410A to arrange the smoking member supporting device 1000 in an arrangement space. The arrangement surface 1410A is a region corresponding to an arrangement region when a user places the smoking member supporting device 1000 in an arrangement space and, in some embodiments, may have a flat surface.

The mounting unit 1420 may have a shape for accommodating the smoking member TM to mount the smoking member TM thereon. In some embodiments, the mounting unit 1420 may have a groove-like shape having a certain thickness or depth.

The hook unit 1421 may be formed at an edge of a region of the mounting unit 1420 and define a region of the mounting unit 1420.

The supporting unit 1425 is connected to the base unit 1410 and may have a long shape extending to correspond to the main body region MU of the smoking member TM when the smoking member TM is accommodated in the mounting unit 1420. For example, the supporting unit 1425 may have a shape that protrudes in the lengthwise direction of the smoking member TM when the smoking member TM is accommodated.

In some embodiments, the supporting unit 1425 may be formed to be adjacent to one region of the mounting unit 1420. For example, the supporting unit 1425 may be formed to correspond to at least one region from among regions of the mounting unit 1420 that does not correspond to the hook unit 1421.

In some embodiments, the supporting unit 1425 may have a shape protruding longer than the hook unit 1421 in the lengthwise direction of the smoking member TM.

When the smoking member TM is mounted on the smoking member supporting device 1000, the supporting unit 1425 may correspond to the main body region MU of the smoking member TM. For example, the supporting unit 425 may protrude to have an appropriate length, such that the main body region MU does not exceed the supporting unit 1425.

Figure 6:
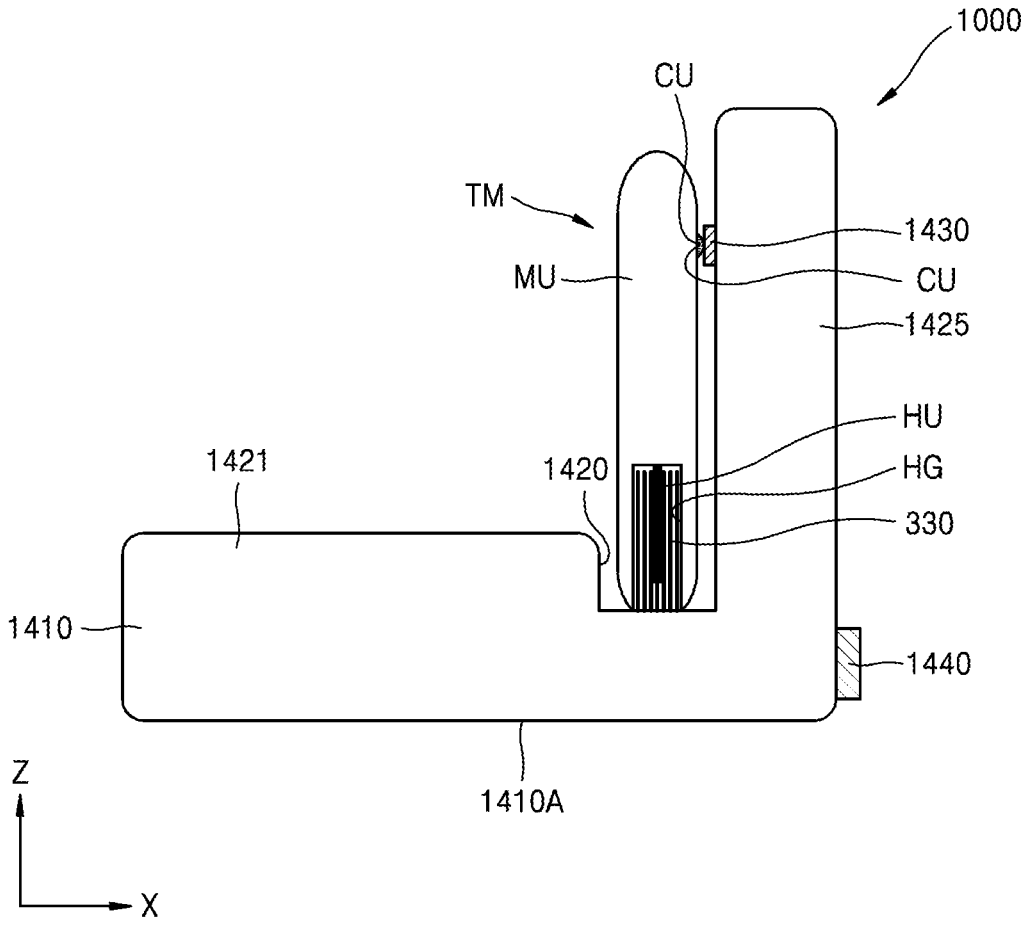
FIG. 6 is a diagram showing a state in which a smoking member mounted on the smoking member supporting device of FIG. 5.

Accordingly, as shown in FIG. 6, when the smoking member TM is accommodated in the mounting unit 1420, the supporting unit 1425 may easily support the smoking member TM, may improve mounting stability by reducing or preventing movement, shaking, or detachment of the smoking member TM when the smoking member TM is mounted by using the smoking member supporting device 1000, and may improve the stability of power supply through the connecting unit 1430.

As shown in FIG. 6, the smoking member TM is accommodated in the mounting unit 1420 by inserting the smoking member TM into the mounting unit 1420 in a direction parallel to the lengthwise direction of the main body region MU of the smoking member TM, and thus the smoking member TM may be mounted on the smoking member supporting device 1000.

For example, the mounting unit 1420 may have a groove-like shape having a depth in a direction parallel to the lengthwise direction of the smoking member TM, and the supporting unit 1425 may have a long shape extending to correspond to at least one region of the main body region MU of the smoking member TM (in another example, an edge of the smoking member TM).

The connecting unit 1430 may be formed to be connected to the power supply unit 350 of the smoking member cleaning device 300.

In some embodiments, the connecting unit 1430 may be formed on a surface of the supporting unit 1425.

The smoking member cleaning device 300 may be approached toward the supporting unit 1425, such that the power supply unit 350 of the smoking member cleaning device 300 is connected to the connecting unit 1430.

In some embodiments, the smoking member cleaning device 300 may include a groove 360H so as to correspond to the connecting unit 1430, and the power supply unit 350 may be disposed to be adjacent to the groove 360H. Therefore, the power supply unit 350 and the connecting unit 1430 may be connected in the groove 360H.

In some embodiments, the power supply unit 350 of the smoking member cleaning device 300 may use magnetic force to facilitate maintenance of a state in which the power supply unit 350 is connected to the connecting unit 1430. One region of at least one of the smoking member cleaning device 300 and the smoking member supporting device 1000 may include a magnetic member, and one region of the other may include a magnetic material capable of interacting with the magnetic member.

For example, a magnetic member such as a permanent magnet may be used, and a magnetic material such as iron and nickel that interacts with the magnetic member may be used.

At this time, the arrangement positions of the magnetic member and the magnetic material may be adjusted between the smoking member cleaning device 300 and the smoking member supporting device 1000, such that the connecting unit 1430 and the power supply unit 350 match each other.

For example, the magnetic member may be disposed in one of the power supply unit 350 and the connecting unit 1430, and the magnetic material may be included in the other.

The power supply unit 350 may be connected to the connecting unit 1430 and energy needed for driving the cleaning driving unit 340 may be supplied through the connecting unit 1430.

As a result, as shown in FIG. 5, while the power supply unit 350 of the smoking member cleaning device 300 is connected to the connecting unit 1430, the cleaning for the smoking member TM, e.g., the cleaning of the insertion groove HG and the heater unit HU, may be performed, specifically by the driving of the cleaning unit 330 through the cleaning driving unit 340.

Also, in some embodiments, as shown in FIG. 6, the connecting unit 1430 may be arranged to face the smoking member TM when the smoking member TM is accommodated in the mounting unit 1420 to supply energy to the smoking member TM.

In some embodiments, when the smoking member TM is accommodated in the mounting unit 1420, the connecting unit 1430 may be formed to correspond to a terminal region CU of the smoking member TM.

In other words, when the smoking member TM is accommodated in the mounting unit 1420, the depth of the mounting unit 1420, the position of the connecting unit 1430 at the supporting unit 1425, and the position and the size of the terminal region CU may be controlled, such that the connecting unit 1430 corresponds to the terminal region CU without a further control of a user.

In some embodiments, magnetic force may be used to facilitate the correspondence between the connecting unit 1430 and the terminal region CU.

In some embodiments, a plurality of connecting units 1430 may be arranged in the supporting unit 1425, and the smoking member TM may also have a plurality of terminal regions CU in correspondence thereto.

Also, a plurality of power supply units 350 of the smoking member cleaning device 300 may be provided.

In some embodiments, the smoking member supporting device 1000 may further include a connecting unit 1440.

The connecting unit 1440 may be formed on one surface of the base unit 1410, and more particularly, may be formed on an outer surface of the base unit 1410 other than the arrangement surface 1410A of the base unit 1410. For example, the connecting unit 1440 may be formed on a side surface of the base unit 1410.

The connecting unit 1440 may be a region connected to a separate external power source when the external power source is connected to the smoking member supporting device 1000, and a cable may be connected to the connecting unit 1440.

An external power source and the connecting unit 1430 may be connected through the connecting unit 1440, and electrical energy may be transferred to the cleaning driving unit 340 of the smoking member cleaning device 300 or the terminal region CU of the smoking member TM.

At this time, the connecting unit 1440 may be connected to a power cable, a USB cable, or the like. To this end, the connecting unit 1440 may include a power terminal, a USB terminal, or the like.

In some other embodiments, the connecting unit 1440 may be wirelessly connected to an external power source and receive energy through a wireless communication method. To this end, the connecting unit 1440 may include a wireless communication module.

The operation and the action of the smoking member cleaning device of the present embodiment will be briefly described.

The smoking member cleaning device 300 of the present embodiment includes the cleaning unit 330 disposed in the accommodating unit 320, and the cleaning unit 330 may be moved by the cleaning driving unit 340. Through this, cleaning of the smoking member TM may be easily performed.

For example, as shown in FIG. 5, the smoking member cleaning device 300 may be connected to the smoking member supporting device 1000. More particularly, the power supply unit 350 may be connected to the connecting unit 1430. While the power supply unit 350 is connected to the connecting unit 1430, the smoking member TM may be accommodated in the accommodating unit 320, such that the open inlet region of the insertion groove HG of the smoking member TM corresponds to the cleaning unit 330.

At this time, the cleaning unit 330 may correspond to the insertion groove HG of the smoking member TM. For example, the entire cleaning unit 330 may be accommodated in the insertion groove HG.

The insertion groove HG and the heater unit HU of the smoking member TM may be cleaned through the cleaning unit 330.

At this time, the effect of cleaning the smoking member TM may be improved through a rotational movement, a linear movement, a lateral movement, or a vibration movement of the cleaning unit 330 by the cleaning driving unit 340.

The driving of the cleaning driving unit 340 may be based on the energy transferred through the connecting unit 1430 of the smoking member supporting device 1000.

Also, after a cleaning operation by the cleaning unit 330 is performed, the smoking member TM may be accommodated in the mounting unit 1420 of the smoking member supporting device 1000 and stably mounted thereon, and the supporting unit 1425 may improve stable supporting characteristics.

Also, when the smoking member TM is mounted on the smoking member supporting device 1000, the connecting unit 1430 is connected to the terminal region CU of the smoking member TM, and thus the smoking member TM may be charged or pre-heated.

For example, the smoking member TM performs a smoking operation by heating a smoking material by using the heater unit HU, wherein energy as a heating source needed for heating the heater unit HU may be charged through the connecting unit 1430.

In another example, the smoking member TM may perform a pre-heating process for smoking and receive energy for the pre-heating process from the connecting unit 1430 of the smoking member supporting device 1000. Such a pre-heating process may be necessary before a user starts smoking. In other words, the pre-heating process may be a process for raising the temperature of a heater used for heating the smoking material to an appropriate temperature.

The cleaning operation of the cleaning unit 330 may be performed based on a selection of a user. In other words, after the smoking member TM is accommodated in the accommodating unit 320, when the power supply unit 350 is connected to the connecting unit 1430 and energy is transferred to the cleaning driving unit 340 through the connecting unit 1430, the user may press a selection button or the like to perform cleaning. Here, the selection button may be formed at the smoking member cleaning device 300 or the smoking member supporting device 1000.

In some embodiments, the cleaning operation of the cleaning unit 330 through the cleaning driving unit 340 may be automatically performed without a selection of a user. In other words, after the smoking member TM is accommodated in the accommodating unit 320, when the power supply unit 350 is connected to the connecting unit 1430 and energy is transferred to the cleaning driving unit 340 through the connecting unit 1430 and the accommodation of the smoking member TM in the accommodating unit 320 of the smoking member cleaning device 300 is detected, cleaning may be performed.

To this end, the smoking member cleaning device 300 may further include an accommodation detector (not shown), and the accommodation detector may be disposed in the accommodating unit 320 to electrically, optically, or physically detect accommodation of the smoking member TM in the accommodating unit 320.

Also, in some other embodiment, the cleaning operation of the cleaning unit 330 through the cleaning driving unit 340 may be automatically performed without a selection of a user. For example, the power supply unit 350 is connected to the connecting unit 1430 and energy is transferred to the cleaning driving unit 340, the movement of the cleaning driving unit 340 may be performed regardless of accommodation of the smoking member TM.

In this embodiment, the smoking member cleaning device 300 may be connected to the smoking member supporting device 1000 for mounting the smoking member TM and perform cleaning. Also, while the smoking member cleaning device 300 is not being used, the smoking member TM may be mounted on the smoking member supporting device 1000 to facilitate handling of the smoking member TM and improve the convenience of supplying energy.

Figure 7:
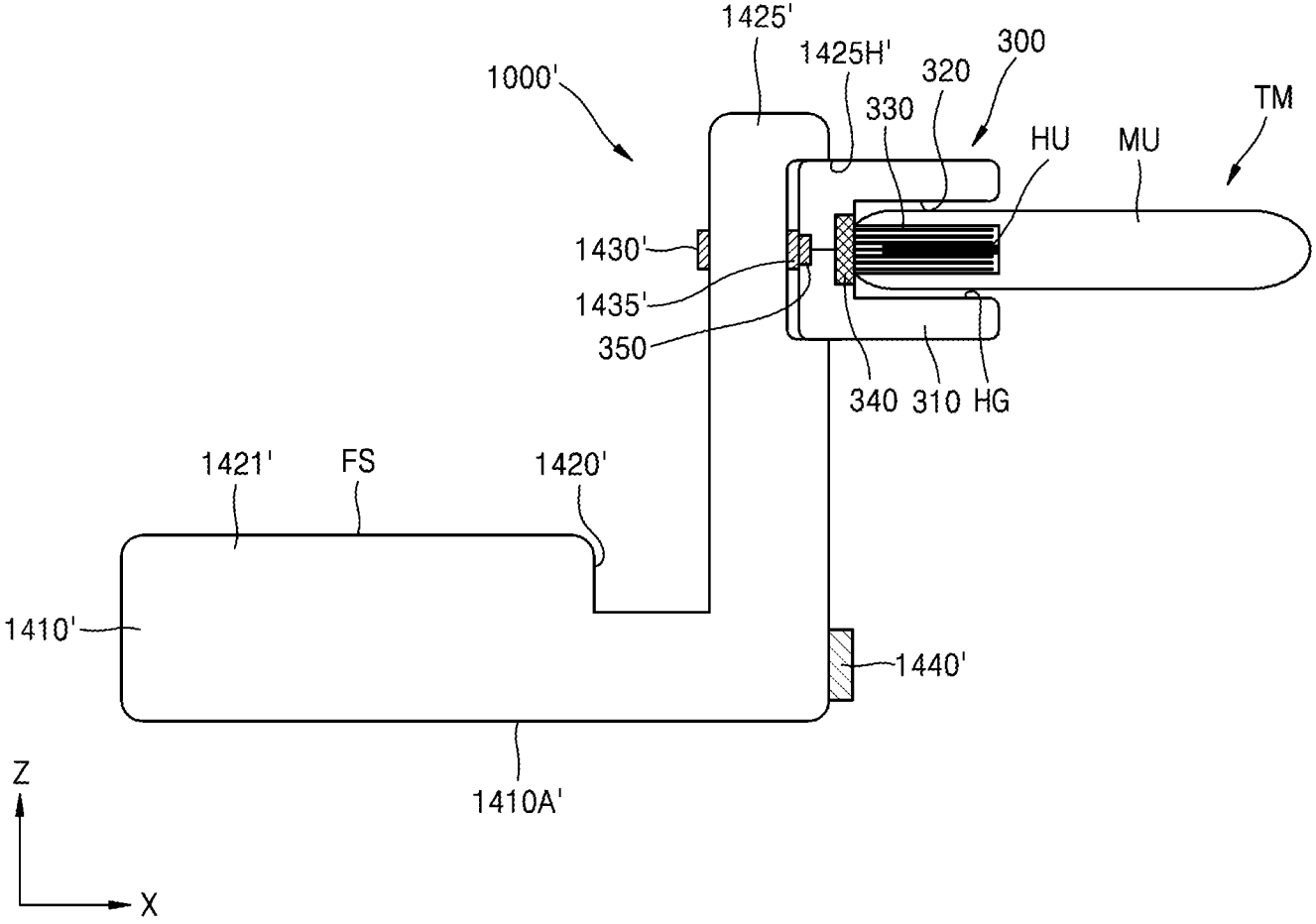
FIG. 7 is a diagram showing that a smoking member cleaning device according to an embodiment of the present disclosure is connected to a smoking member supporting device.

FIG. 7 is a diagram showing that a smoking member cleaning device according to an embodiment of the present disclosure is connected to a smoking member supporting device.

Referring to FIG. 7, the present embodiment may provide a smoking member cleaning device 300. The smoking member cleaning device 300 is connected to a smoking member supporting device 1000'.

For convenience of explanation, descriptions below will focus on differences from the embodiment of FIG. 6.

Referring to FIG. 7, the smoking member cleaning device 300 according to the present embodiment may include a main body unit 310, an accommodating unit 320, a cleaning unit 330, a cleaning driving unit 340, and a power supply unit 350.

The smoking member cleaning device 300 of the present embodiment may be the same as that described above with reference to FIG. 6.

The smoking member cleaning device 300 of the present embodiment may not include a groove. Although not shown, in another example, as shown in FIG. 6, a groove may also be provided in the present embodiment.

The main body unit 310, the accommodating unit 320, the cleaning unit 330, the cleaning driving unit 340, and the power supply unit 350 of the present embodiment are the same as or appropriate modifications of those described in the embodiment described above with reference to FIG. 6, detailed descriptions thereof will be omitted.

The smoking member supporting device 1000' of the present embodiment may include a base unit 1410', a mounting unit 1420', a hook unit 1421', a supporting unit 1425', a connecting unit 1430', and a connecting member 1435'.

As the base unit 1410', the mounting unit 1420', the hook unit 1421', the supporting unit 1425', and the connecting unit 1430' may be the same as or similar to those described in the embodiment described above with reference to FIG. 6, detailed descriptions thereof will be omitted.

The connecting member 1435' may be formed on a surface of the supporting unit 1425'.

In some embodiments, the connecting member 1435' may be formed on a surface of the supporting unit 1425' to be apart from the connecting unit 1430'.

In some embodiments, the connecting member 1435' may be formed on a surface different from the surface on which the connecting unit 1430' is disposed. In detail, the connecting member 1435' may be formed on a surface of the supporting unit 1425' opposite to the surface on which the connecting unit 1430' is disposed.

The connecting member 1435' may be formed to be connected to the power supply unit 350 of the smoking member cleaning device 300. For example, the smoking member cleaning device 300 may be approached toward the supporting unit 1425', such that the power supply unit 350 of the smoking member cleaning device 300 is connected to the connecting member 1435'.

In some embodiments, a groove 1425H' may be formed on a surface of the supporting unit 1425' on which the connecting member 1435' is disposed. For example, a groove 1425H' may be formed on a surface of the supporting unit 1425' opposite to the surface on which the connecting unit 1430' is formed, and the connecting member 1435' may be formed in the groove 1425H'.

In some embodiments, the power supply unit 350 of the smoking member cleaning device 300 may use magnetic force to facilitate maintenance of a state in which the power supply unit 350 is connected to the connecting member 1435'. One region of at least one of the smoking member cleaning device 300 and the smoking member supporting device 1000' may include a magnetic member, and one region of the other may include a magnetic material capable of interacting with the magnetic member.

For example, a magnetic member such as a permanent magnet may be used, and a magnetic material such as iron and nickel that interacts with the magnetic member may be used.

At this time, the arrangement positions of the magnetic member and the magnetic material may be adjusted between the smoking member cleaning device 300 and the smoking member supporting device 1000', such that the connecting member 1435' and the power supply unit 350 match each other.

For example, the magnetic member may be disposed in one of the power supply unit 350 and the connecting member 1435', and the magnetic material may be included in the other.

The power supply unit 350 may be connected to the connecting member 1435' and energy needed for driving the cleaning driving unit 340 may be supplied through the connecting member 1435'.

In some other embodiments, the connecting member 1435' may be formed on another surface of the smoking member supporting device 1000'. For example, the connecting member 1435' may be formed on a front surface FS, which is a surface of the smoking member supporting device 1000' other than the mounting unit 1420', is adjacent to the mounting unit 1420', and is apart from the supporting unit 1425'.

Also, the connecting unit 1430 may be arranged to face the smoking member TM when the smoking member TM is accommodated in the mounting unit 1420' to supply energy to the smoking member TM.

In some embodiments, when the smoking member TM is accommodated in the mounting unit 1420', the connecting unit 1430' may be formed to correspond to the terminal region CU of the smoking member TM.

In some embodiments, as described above, the smoking member supporting device 1000 may further include a connecting unit 1440'.

The operation and the action of the smoking member cleaning device of the present embodiment will be briefly described.

The smoking member cleaning device 300 of the present embodiment includes the cleaning unit 330 disposed in the accommodating unit 320, and the cleaning unit 330 may be moved by the cleaning driving unit 340. Through this, cleaning of the smoking member TM may be easily performed.

For example, as shown in FIG. 5, the smoking member cleaning device 300 may be connected to the smoking member supporting device 1000'. More particularly, the power supply unit 350 may be connected to the connecting member 1435'. While the power supply unit 350 is connected to the connecting member 1435', the smoking member TM may be accommodated in the accommodating unit 320, such that the open inlet region of the insertion groove HG of the smoking member TM corresponds to the cleaning unit 330.

At this time, the cleaning unit 330 may correspond to the insertion groove HG of the smoking member TM. For example, the entire cleaning unit 330 may be accommodated in the insertion groove HG.

The insertion groove HG and the heater unit HU of the smoking member TM may be cleaned through the cleaning unit 330.

At this time, the effect of cleaning the smoking member TM may be improved through a rotational movement, a linear movement, a lateral movement, or a vibration movement of the cleaning unit 330 by the cleaning driving unit 340.

The driving of the cleaning driving unit 340 may be based on the energy transferred through the connecting member 1435' of the smoking member supporting device 1000'.

Also, after a cleaning operation by the cleaning unit 330 is performed, the smoking member TM may be accommodated in the mounting unit 1420' of the smoking member supporting device 1000' and stably mounted thereon, and the supporting unit 1425' may improve stable supporting characteristics.

Also, when the smoking member TM is mounted on the smoking member supporting device 1000', the connecting unit 1430' is connected to the terminal region CU of the smoking member TM, and thus the smoking member TM may be charged or pre-heated.

Details of charging and pre-heating are the same as those in the above-described embodiment, and thus detailed descriptions thereof will be omitted.

In this embodiment, the smoking member cleaning device 300 may be connected to the smoking member supporting device 1000' for mounting the smoking member TM and perform cleaning. Also, while the smoking member cleaning device 300 is not being used, the smoking member TM may be mounted on the smoking member supporting device 1000' to facilitate handling of the smoking member TM and improve the convenience of supplying energy.

Also, the connecting unit 1430' for charging or pre-heating the smoking member TM when the smoking member TM is mounted on the smoking member supporting device 1000' and the connecting member 1435 for cleaning the smoking member cleaning device 300 may be separately formed (e.g., formed in different regions) to improve convenience of electrical control.

FIG. 7 is a diagram showing that a smoking member cleaning device according to an embodiment of the present disclosure is connected to a smoking member accommodating device.

Referring to FIG. 7, the present embodiment may provide a smoking member cleaning device 400. The smoking member cleaning device 400 is connected to the smoking member accommodating device 2000.

Figure 8:
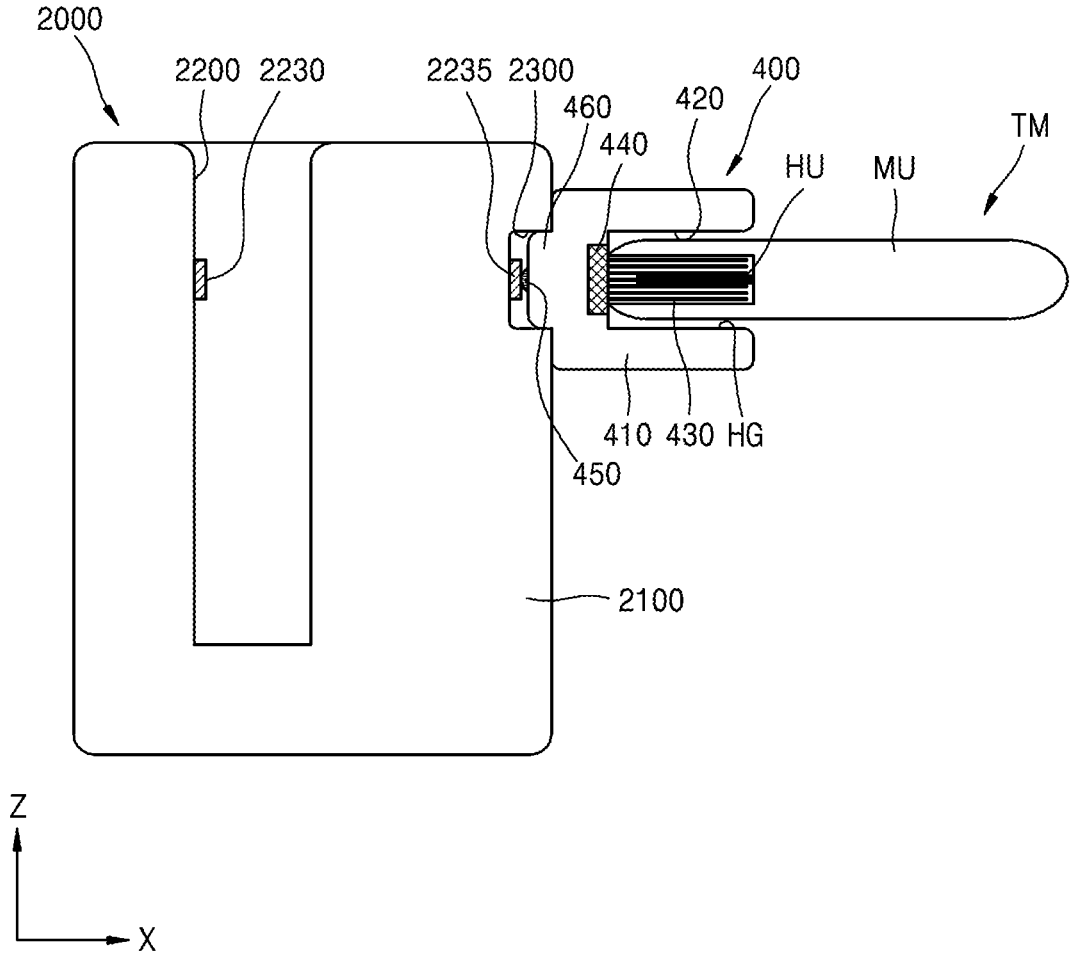
FIG. 8 is a diagram showing a smoking member cleaning device according to an embodiment of the present disclosure connected to a smoking member accommodating device.

Referring to FIG. 8, the smoking member cleaning device 400 according to the present embodiment may include a main body unit 410, an accommodating unit 420, a cleaning unit 430, a cleaning driving unit 440, and a power supply unit 450.

For convenience of explanation, descriptions below will focus on differences from the above-described embodiments.

The main body unit 410 constitutes the main area of the smoking member cleaning device 400 and may be formed of a durable material to facilitate handling and storage of the smoking member cleaning device 400.

The accommodating unit 420 may be formed to accommodate at least one region of the smoking member TM to perform a cleaning operation on the smoking member TM. The accommodating unit 420 may have a groove-like shape having a certain depth.

The cleaning unit 430 may be formed in the accommodating unit 420. The cleaning unit 430 is formed to perform cleaning on the smoking member TM.

The smoking member TM may include a main region MU and an insertion groove HG to be connected to one end of the main region MU. A heater unit HU may be disposed in the insertion groove HG.

The cleaning driving unit 440 may be connected to the cleaning unit 430, and the cleaning unit 430 may be moved by the cleaning driving unit 440. Also, the examples of FIGS. 2A to 2C regarding the driving of the cleaning driving unit 440 may be selectively applied.

The power supply unit 450 may be configured to supply energy needed for driving the cleaning driving unit 440, e.g., electrical energy.

The power supply unit 450 may be electrically connected to, for example, the cleaning driving unit 440.

In some embodiments, the smoking member cleaning device 400 may include a protruding region 460 protruding from the main body unit 410, and the power supply unit 450 may be formed in the protruding region 460.

The protruding region 460 may protrude from one surface of the main body unit 410 in a direction away from the inlet of the accommodating unit 420.

The power supply unit 450 may be connected to a connecting member 2235 of the smoking member accommodating device 2000. Detailed descriptions thereof will be given below.

The smoking member accommodating device 2000 of the present embodiment may include an accommodation housing 2100, an accommodating region 2200, a connecting unit 2230, and the connecting member 2235.

The smoking member accommodating device 2000 may be used in various forms. For example, a user may use the smoking member accommodating device 2000 to accommodate the smoking member TM therein to carry the smoking member TM around.

The accommodation housing 2100 constitutes the main area of the smoking member accommodating device 2000 and may include the outer appearance of the smoking member accommodating device 2000. The accommodation housing 2100 may have a size and a shape for easy grip of a user for convenient carry.

The accommodating region 2200 may have a shape for accommodating the smoking member TM to accommodate the smoking member TM therein. In some embodiments, the accommodating region 2200 may have a shape formed by removing one region from the accommodation housing 2100 and may have a groove-like shape having predetermined thickness and depth. For example, the accommodating region 2200 may have a width and a length at least corresponding to or greater than those of the smoking member TM.

The connecting unit 2230 may be arranged to face the smoking member TM when the smoking member TM is accommodated in the accommodating region 2200 to supply energy to the smoking member TM.

In some embodiments, when the smoking member TM is accommodated in the accommodating region 2200, the connecting unit 2230 may be formed to correspond to a terminal region (not shown) of the smoking member TM.

The connecting member 2235 may be formed to be connected to the power supply unit 450 of the smoking member cleaning device 400.

In some embodiments, the smoking member accommodating device 2000 may have a groove 2300 formed on one surface thereof and the connecting member 2235 may be formed in the groove 2300. In this case, the protruding region 460 of the above-described embodiment may correspond to the groove 2300.

This may facilitate a process for connecting the smoking member cleaning device 400 to the smoking member accommodating device 2000 and a process for maintaining a state in which the power supply unit 450 and the connecting member 2235 are connected.

The smoking member cleaning device 400 may be approached toward the connecting member 2235, such that the power supply unit 450 of the smoking member cleaning device 400 is connected to the connecting member 2235.

In some embodiments, the power supply unit 450 of the smoking member cleaning device 400 may use magnetic force to facilitate maintenance of a state in which the power supply unit 450 is connected to the connecting member 2235. One region of at least one of the smoking member cleaning device 400 and the smoking member accommodating device 2000 may include a magnetic member, and one region of the other may include a magnetic material capable of interacting with the magnetic member.

For example, a magnetic member such as a permanent magnet may be used, and a magnetic material such as iron and nickel that interacts with the magnetic member may be used.

At this time, the arrangement positions of the magnetic member and the magnetic material may be adjusted between the smoking member cleaning device 400 and the smoking member accommodating device 2000, such that the connecting member 2235 and the power supply unit 450 match each other.

For example, the magnetic member may be disposed in one of the power supply unit 450 and the connecting member 2235, and the magnetic material may be included in the other.

The power supply unit 450 may be connected to the connecting member 2235 and energy needed for driving the cleaning driving unit 440 may be supplied through the connecting member 2235.

As a result, while a state in which the power supply unit 450 of the smoking member cleaning device 400 is connected to the connecting member 2235 is easily maintained, the cleaning for the smoking member TM, e.g., the cleaning of the insertion groove HG and the heater unit HU, may be performed, specifically by the driving of the cleaning unit 430 through the cleaning driving unit 440.

In some embodiments, the smoking member accommodating device 2000 may further include a connecting unit (not shown).

The connecting unit (not shown) may be a region connected to a separate external power source when the external power source is connected to the smoking member accommodating device 2000, and a cable may be connected to the connecting unit.

An external power source and a smoking member accommodating device 2000 may be connected to each other through a connecting unit (not shown), and thus energy may be transferred through the connecting unit 2230 or the connecting member 2235.

In some embodiments, the smoking member accommodating device 2000 may be connected to an external power source and be charged through a connecting unit (not shown).

The operation and the action of the smoking member cleaning device of the present embodiment will be briefly described.

The smoking member cleaning device 400 of the present embodiment includes the cleaning unit 430 disposed in the accommodating unit 420, and the cleaning unit 430 may be moved by the cleaning driving unit 440. Through this, cleaning of the smoking member TM may be easily performed.

For example, the smoking member cleaning device 400 may be connected to the smoking member accommodating device 2000. More particularly, the power supply unit 450 may be connected to the connecting member 2235. While the power supply unit 450 is connected to the connecting member 2235, the smoking member TM may be accommodated in the accommodating unit 420, such that the open inlet region of the insertion groove HG of the smoking member TM corresponds to the cleaning unit 430.

At this time, the cleaning unit 430 may correspond to the insertion groove HG of the smoking member TM. For example, the entire cleaning unit 430 may be accommodated in the insertion groove HG.

The insertion groove HG and the heater unit HU of the smoking member TM may be cleaned through the cleaning unit 430.

At this time, the effect of cleaning the smoking member TM may be improved through a rotational movement, a linear movement, a lateral movement, or a vibration movement of the cleaning unit 430 by the cleaning driving unit 440.

The driving of the cleaning driving unit 440 may be based on the energy transferred through the connecting member 2235 of the smoking member accommodating device 2000.

Also, after a cleaning operation through the cleaning unit 430, the smoking member TM may be accommodated in the accommodating region 2200 of the smoking member accommodating device 2000. When the smoking member TM is accommodated in the smoking member accommodating device 2000, the connecting unit 2230 is connected to a terminal region (not shown) of the smoking member TM, and charging or pre-heating the smoking member TM may be performed therethrough.

The cleaning operation of the cleaning unit 430 may be performed based on a selection of a user. In other words, after the smoking member TM is accommodated in the accommodating unit 420, when the power supply unit 450 is connected to the connecting member 2235 and energy is transferred to the cleaning driving unit 440 through the connecting member 2235, the user may press a selection button or the like to perform cleaning. Here, the selection button may be formed at the smoking member cleaning device 400 or the smoking member accommodating device 2000.

In some embodiment, the cleaning operation of the cleaning unit 430 through the cleaning driving unit 440 may be automatically performed without a selection of a user. In other words, after the smoking member TM is accommodated in the accommodating unit 420, when the power supply unit 450 is connected to the connecting member 2235 and energy is transferred to the cleaning driving unit 440 through the connecting member 2235 and the accommodation of the smoking member TM in the accommodating unit 420 of the smoking member cleaning device 400 is detected, cleaning may be performed.

To this end, the smoking member cleaning device 400 may further include an accommodation detector (not shown), and the accommodation detector may be disposed in the accommodating unit 420 to electrically, optically, or physically detect accommodation of the smoking member TM in the accommodating unit 420.

Also, in some other embodiment, the cleaning operation of the cleaning unit 430 through the cleaning driving unit 440 may be automatically performed without a selection of a user. For example, the power supply unit 350 is connected to the connecting member 2235 and energy is transferred to the cleaning driving unit 440 through the connecting member 2235, the movement of the cleaning driving unit 440 may be performed regardless of accommodation of the smoking member TM.

In this embodiment, the smoking member cleaning device 400 may be connected to the smoking member accommodating device 2000 for accommodating the smoking member TM and perform cleaning. Also, while the smoking member cleaning device 400 is not being used, the smoking member TM may be accommodated to the smoking member accommodating device 2000 to facilitate handling of the smoking member TM and improve the convenience of supplying energy.

Figure 9:
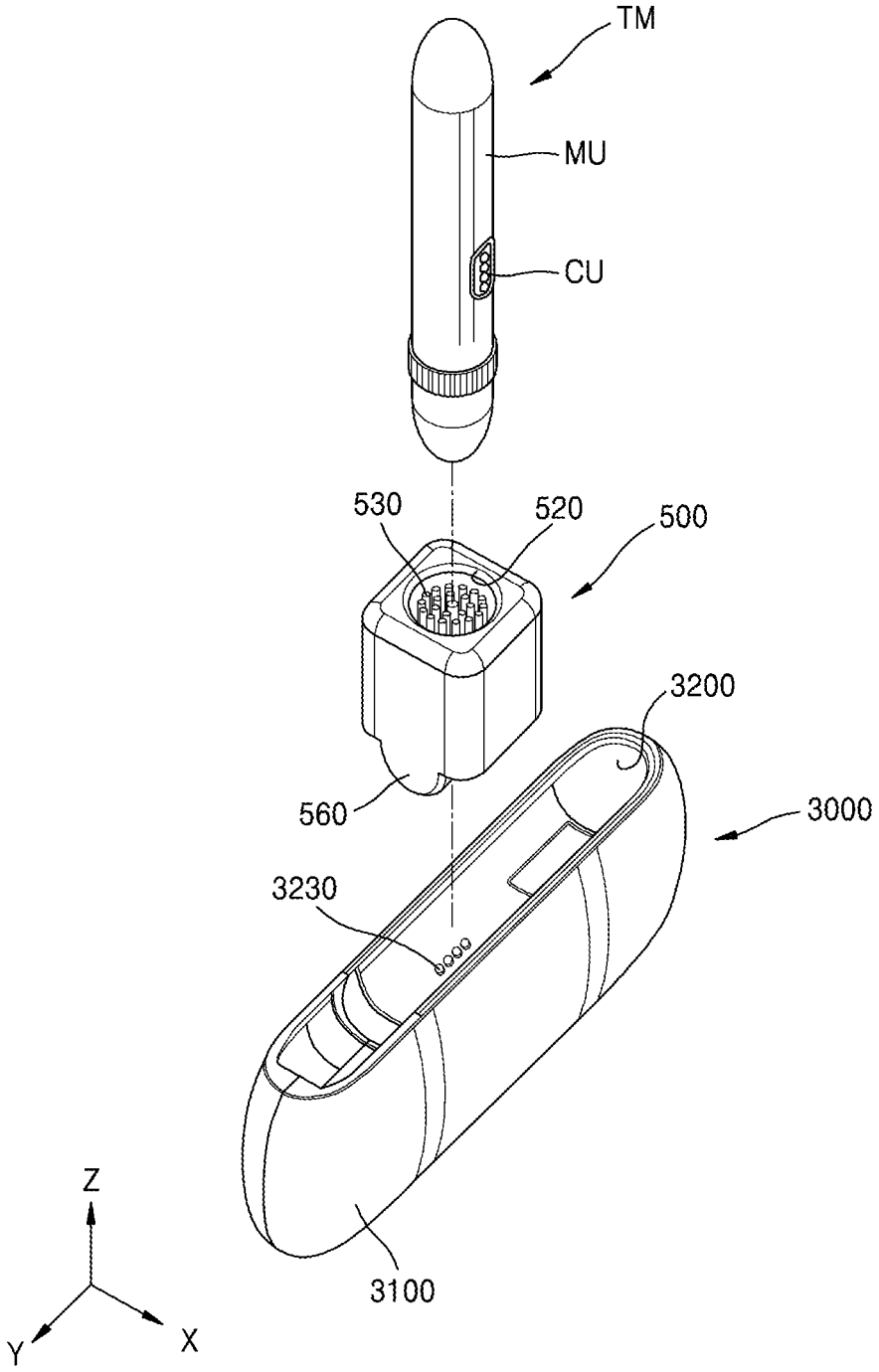
FIG. 9 is a diagram showing a process in which a smoking member cleaning device according to an embodiment of the present disclosure is connected to a smoking member accommodating device.
Figure 10:
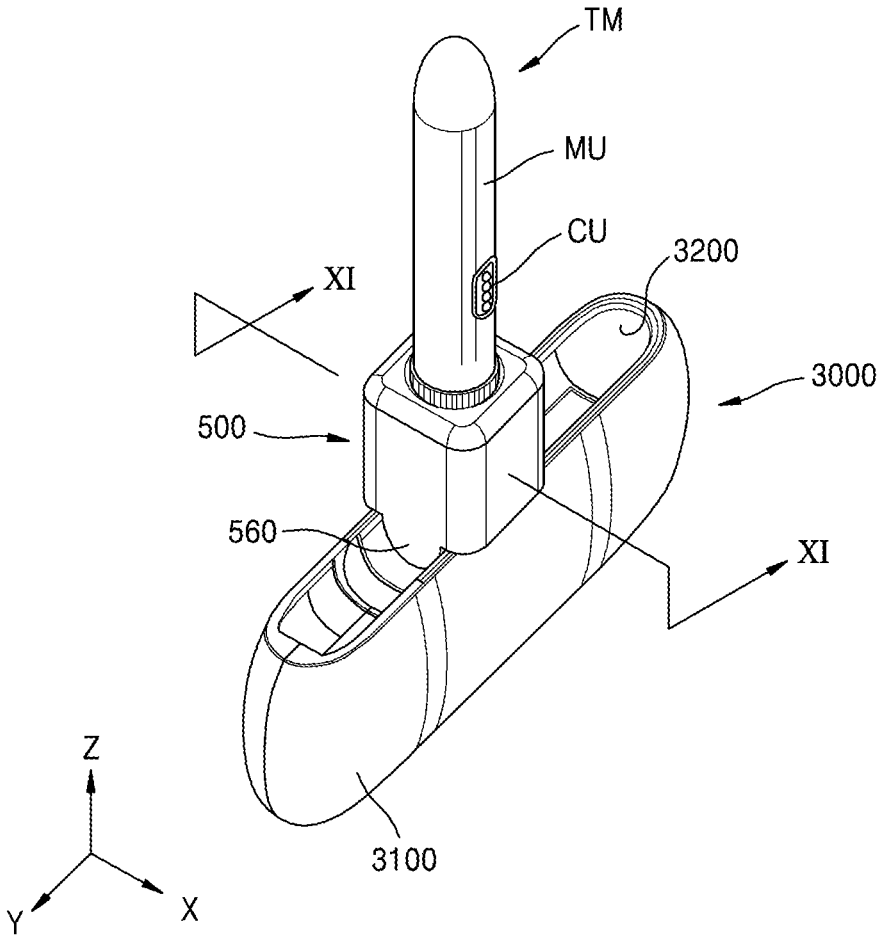
FIG. 10 is a diagram showing an example of cleaning a smoking member after the smoking member cleaning device of FIG. 9 is connected to a smoking member accommodating device.
Figure 11:
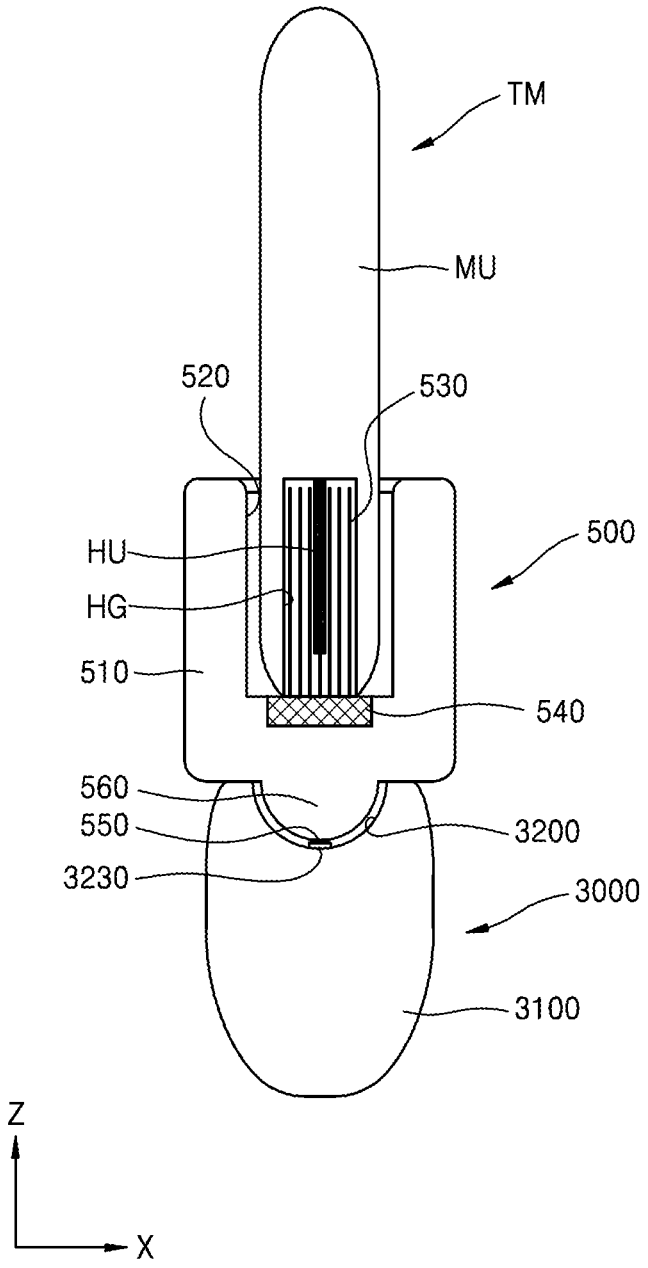
FIG. 11 is a cross-sectional view taken along line XI-XI of FIG. 10.

FIG. 9 is a diagram showing a process that a smoking member cleaning device according to an embodiment of the present disclosure is connected to a smoking member accommodating device. FIG. 10 is a diagram showing an example of cleaning a smoking member after the smoking member cleaning device of FIG. 9 is connected to a smoking member accommodating device. FIG. 11 is a cross-sectional view taken along a line XI-XI of FIG. 10.

Figure 12:
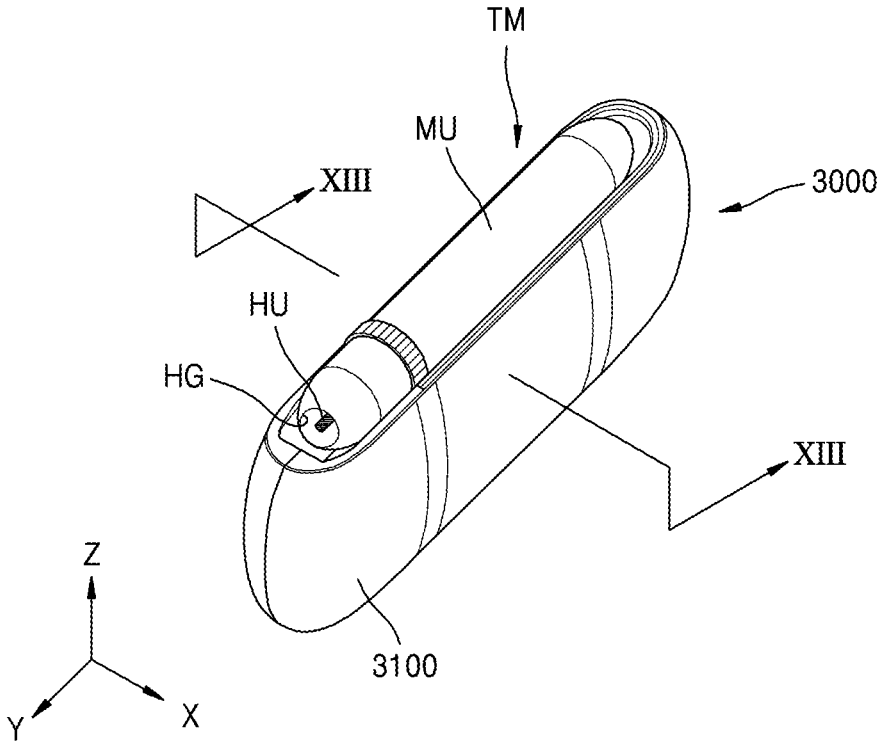
FIG. 12 is a diagram showing a state in which a smoking member accommodated in the smoking member accommodating device of FIG. 9.
Figure 13:
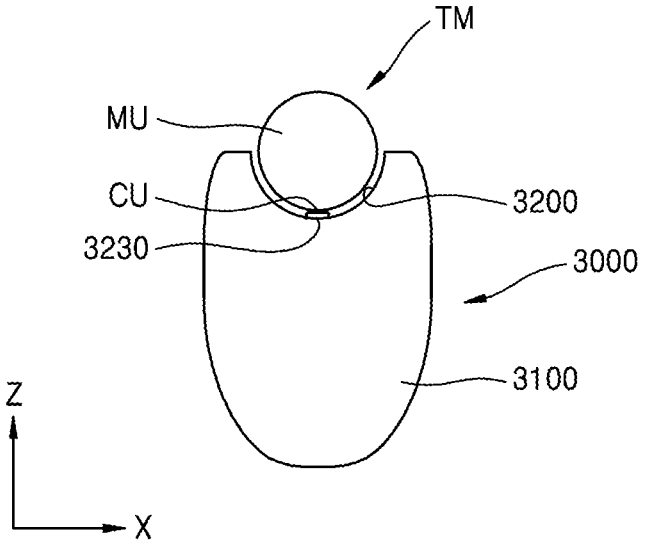
FIG. 13 is a cross-sectional view taken along line XIII-XIII of FIG. 12.

FIG. 12 is a diagram showing a state in which a smoking member accommodated to the smoking member accommodating device of FIG. 9. FIG. 13 is a cross-sectional view taken along a line XIII-XIII of FIG. 12.

Referring to FIGS. 9 to 13, the present embodiment may provide a smoking member cleaning device 500. The smoking member cleaning device 500 may be connected to the smoking member accommodating device 3000. In other words, the smoking member cleaning device 500 may be connected to the smoking member accommodating device 3000 as shown in FIG. 10 for cleaning the smoking member TM.

The smoking member cleaning device 500 according to the present embodiment may include a main body unit 510, an accommodating unit 520, a cleaning unit 530, a cleaning driving unit 540, and a power supply unit 550.

For convenience of explanation, descriptions below will focus on differences from the above-described embodiments.

The main body unit 510 constitutes the main area of the smoking member cleaning device 500 and may be formed of a durable material to facilitate handling and storage of the smoking member cleaning device 500.

In some embodiments, the main body unit 510 may have a square pillar-like shape with rounded edges.

The accommodating unit 520 may be formed to accommodate at least one region of the smoking member TM to perform a cleaning operation on the smoking member TM. The accommodating unit 520 may have a groove-like shape having a certain depth.

The cleaning unit 530 may be formed in the accommodating unit 520. The cleaning unit 530 is formed to perform cleaning on the smoking member TM.

The smoking member TM may include a main region MU and an insertion groove HG to be connected to one end of the main region MU. A heater unit HU may be disposed in the insertion groove HG.

The cleaning driving unit 530 may be connected to the cleaning unit 540, and the cleaning unit 530 may be moved by the cleaning driving unit 540. Also, the examples of FIGS. 2A to 2C regarding the driving of the cleaning driving unit 540 may be selectively applied.

The power supply unit 550 may be configured to supply energy needed for driving the cleaning driving unit 540, e.g., electrical energy.

The power supply unit 550 may be electrically connected to, for example, the cleaning driving unit 540.

In some embodiments, the smoking member cleaning device 500 may include a protruding region 560 protruding from the main body unit 510, and the power supply unit 550 may be formed in the protruding region 560.

The protruding region 560 may protrude from one surface of the main body unit 510 in a direction away from the inlet of the accommodating unit 520.

The power supply unit 550 may be connected to a connecting unit 3230 of the smoking member accommodating device 3000. Detailed descriptions thereof will be given below.

The smoking member accommodating device 3000 of the present embodiment may include an accommodation housing 3100, an accommodating region 3200, the connecting unit 3230, and a connecting member 3235.

The smoking member accommodating device 3000 may be used in various forms. For example, a user may use the smoking member accommodating device 3000 to accommodate the smoking member TM therein to carry the smoking member TM around.

The accommodation housing 3100 constitutes the main portion of the smoking member accommodating device 3000 and may include the outer appearance of the smoking member accommodating device 3000. The accommodation housing 3100 may have a size and a shape for easy grip of a user for convenient carry.

The accommodating region 3200 may have a shape for accommodating the smoking member TM to accommodate the smoking member TM therein. In some embodiments, the accommodating region 3200 may have a shape formed by removing one region from the accommodation housing 3100 and may have a groove-like shape having predetermined thickness and depth. For example, the accommodating region 3200 may have a width and a length at least corresponding to or greater than those of the smoking member TM.

For example, the accommodating region 3200 may have a length at least corresponding to or greater than that of the smoking member TM.

Also, the accommodating region 3200 may have a width at least corresponding to or greater than that of the smoking member TM.

The inlet of the accommodating region 3200, that is, a region open to the outside, may correspond to the lengthwise direction of the accommodating region 3200, which may be in correspondence to the smoking member TM.

In other words, as compared to the case where accommodating region 2200 of FIG. 8 of the above-described embodiment has an open region having a shape corresponding to the width of the smoking member TM, the accommodating region 3200 of FIG. 9 may have a larger open region.

In detail, in the present embodiment, the accommodating region 3200 may be formed on one side of the accommodation housing 3100 to have an open region corresponding to the lengthwise direction of the accommodating region 3200. Therefore, user convenience regarding space sufficiency of the accommodating region 3200 may be secured, and thus the smoking member cleaning device 500 to be described below may be easily connected.

The connecting unit 3230 may be arranged to face the smoking member TM when the smoking member TM is accommodated in the accommodating region 3200 to supply energy to the smoking member TM.

In some embodiments, when the smoking member TM is accommodated in the accommodating region 3200, the connecting unit 3230 may be formed to correspond to a terminal region (not shown) of the smoking member TM.

The connecting unit 3230 may be formed to be connected to the power supply unit 550 of the smoking member cleaning device 500.

In some embodiments, the smoking member cleaning device 500 may include a protruding region 560, and the protruding region 560 may correspond to the accommodating region 3200 of the smoking member accommodating device 3000.

This may facilitate a process for connecting the smoking member cleaning device 500 to the smoking member accommodating device 3000 and a process for maintaining a state in which the power supply unit 550 and the connecting unit 3230 are connected.

The smoking member cleaning device 500 may be approached toward the connecting unit 3230, such that the power supply unit 550 of the smoking member cleaning device 500 is connected to the connecting unit 3230.

In some embodiments, the power supply unit 550 of the smoking member cleaning device 500 may use magnetic force to facilitate maintenance of a state in which the power supply unit 550 is connected to the connecting member 3235. One region of at least one of the smoking member cleaning device 500 and the smoking member accommodating device 3000 may include a magnetic member, and one region of the other may include a magnetic material capable of interacting with the magnetic member.

For example, a magnetic member such as a permanent magnet may be used, and a magnetic material such as iron and nickel that interacts with the magnetic member may be used.

At this time, the arrangement positions of the magnetic member and the magnetic material may be adjusted between the smoking member cleaning device 500 and the smoking member accommodating device 3000, such that the connecting unit 3230 and the power supply unit 550 match each other.

For example, the magnetic member may be disposed in one of the power supply unit 550 and the connecting unit 3230, and the magnetic material may be included in the other.

The power supply unit 550 may be connected to the connecting unit 3230 and energy needed for driving the cleaning driving unit 540 may be supplied through the connecting unit 3230.

As a result, while a state in which the power supply unit 550 of the smoking member cleaning device 500 is connected to the connecting unit 3230 is easily maintained, the cleaning for the smoking member TM, e.g., the cleaning of the insertion groove HG and the heater unit HU, may be performed, specifically by the driving of the cleaning unit 530 through the cleaning driving unit 540.

Also, as shown in FIGS. 12 and 13, the connecting unit 3230 may be arranged to face the smoking member TM when the smoking member TM is accommodated in the accommodating region 3200 to supply energy to the smoking member TM.

In some embodiments, when the smoking member TM is accommodated in the accommodating region 3200, the connecting unit 3230 may be formed to correspond to the terminal region CU of the smoking member TM.

In other words, when the smoking member TM is accommodated in the accommodating region 3200, the depth of the accommodating region 3200, the position of the connecting unit 3230, and the position and the size of the terminal region CU may be controlled, such that the connecting unit 3230 corresponds to the terminal region CU without a further control of a user.

In some embodiments, magnetic force may be used to facilitate the correspondence between the connecting unit 3230 and the terminal region CU.

In some embodiments, a plurality of connecting units 3230 may be arranged in the accommodating region 3200, and the smoking member TM may also have a plurality of terminal regions CU in correspondence thereto.

In some embodiments, the smoking member accommodating device 3000 may further include a connecting unit (not shown).

The connecting unit (not shown) may be a region connected to a separate external power source when the external power source is connected to the smoking member accommodating device 3000, and a cable may be connected to the connecting unit.

An external power source and a smoking member accommodating device 3000 may be connected to each other through a connecting unit (not shown), and thus energy may be transferred through the connecting unit 3230.

In some embodiments, the smoking member accommodating device 3000 may be connected to an external power source and be charged through a connecting unit (not shown).

The operation and the action of the smoking member cleaning device of the present embodiment will be briefly described.

The smoking member cleaning device 500 of the present embodiment includes the cleaning unit 530 disposed in the accommodating unit 520, and the cleaning unit 530 may be moved by the cleaning driving unit 540. Through this, cleaning of the smoking member TM may be easily performed.

For example, the smoking member cleaning device 500 may be connected to the smoking member accommodating device 3000. More particularly, the power supply unit 550 may be connected to the connecting member 3235. While the power supply unit 550 is connected to the connecting member 3235, the smoking member TM may be accommodated in the accommodating unit 520, such that the open inlet region of the insertion groove HG of the smoking member TM corresponds to the cleaning unit 530.

At this time, the cleaning unit 530 may correspond to the insertion groove HG of the smoking member TM. For example, the entire cleaning unit 530 may be accommodated in the insertion groove HG.

The insertion groove HG and the heater unit HU of the smoking member TM may be cleaned through the cleaning unit 530.

At this time, the effect of cleaning the smoking member TM may be improved through a rotational movement, a linear movement, a lateral movement, or a vibration movement of the cleaning unit 530 by the cleaning driving unit 540.

The driving of the cleaning driving unit 540 may be based on the energy transferred through the connecting unit 3230 of the smoking member accommodating device 3000.

Also, after a cleaning operation through the cleaning unit 530, the smoking member TM may be accommodated in the accommodating region 3200 of the smoking member accommodating device 3000. When the smoking member TM is accommodated in the smoking member accommodating device 3000, the connecting unit 3230 is connected to the terminal region CU of the smoking member TM, and charging or pre-heating the smoking member TM may be performed therethrough.

For example, the smoking member TM performs a smoking operation by heating a smoking material by using the heater unit HU, wherein energy as a heating source needed for heating the heater unit HU may be charged through the connecting unit 3230.

In another example, the smoking member TM may perform a pre-heating process for smoking and receive energy for the pre-heating process from the connecting unit 3230 of the smoking member accommodating device 3000. Such a pre-heating process may be necessary before a user starts smoking. In other words, the pre-heating process may be a process for raising the temperature of a heater used for heating the smoking material to an appropriate temperature.

The cleaning operation of the cleaning unit 530 may be performed based on a selection of a user. In other words, after the smoking member TM is accommodated in the accommodating unit 520, when the power supply unit 550 is connected to the connecting unit 3230 and energy is transferred to the cleaning driving unit 540 through the connecting unit 3230, the user may press a selection button or the like to perform cleaning. Here, the selection button may be formed at the smoking member cleaning device 500 or the smoking member accommodating device 3000.

In some embodiments, the cleaning operation of the cleaning unit 530 through the cleaning driving unit 540 may be automatically performed without a selection of a user. In other words, after the smoking member TM is accommodated in the accommodating unit 520, when the power supply unit 550 is connected to the connecting unit 3230 and energy is transferred to the cleaning driving unit 540 through the connecting member 3235 and the accommodation of the smoking member TM in the accommodating unit 520 of the smoking member cleaning device 500 is detected, cleaning may be performed.

To this end, the smoking member cleaning device 500 may further include an accommodation detector (not shown), and the accommodation detector may be disposed in the accommodating unit 520 to electrically, optically, or physically detect accommodation of the smoking member TM in the accommodating unit 520.

Also, in some other embodiment, the cleaning operation of the cleaning unit 530 through the cleaning driving unit 540 may be automatically performed without a selection of a user. For example, the power supply unit 550 is connected to the connecting member 3235 and energy is transferred to the cleaning driving unit 540 through the connecting unit 3230, the movement of the cleaning driving unit 540 may be performed regardless of accommodation of the smoking member TM.

In this embodiment, the smoking member cleaning device 500 may be connected to the smoking member accommodating device 3000 for accommodating the smoking member TM and perform cleaning. Also, while the smoking member cleaning device 500 is not being used, the smoking member TM may be accommodated to the smoking member accommodating device 3000 to facilitate handling of the smoking member TM and improve the convenience of supplying energy.

While the present disclosure has been described with reference to exemplary embodiments, it is to be understood that the disclosure is not limited to the disclosed example embodiments, but, on the contrary, is intended to cover various modifications and equivalent arrangements included within the spirit and scope of the appended claims. Accordingly, the true scope of protection of the present disclosure should be determined by the technical idea of the appended claims.

On the other hand, at least one of the above embodiments may be applied to various modifications. These modifications will be described in detail.

Figure 14:
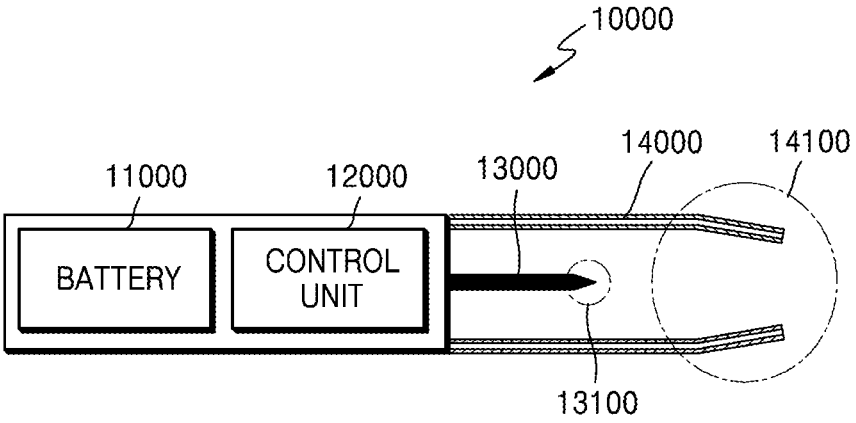
FIG. 14 is a block diagram showing an example of an aerosol generating apparatus.

Referring to FIG. 14, an aerosol generating apparatus 10000 (hereinafter referred to as a 'holder') includes a battery 11000, a control unit 12000, and a heater 13000. The holder 10000 also includes an inner space formed by a casing 14000. A cigarette may be inserted into the inner space of the holder 10000.

In some embodiments, the holder 10000 may correspond to the smoking member TM in the above-described embodiments.

Only components associated with the present embodiment are shown in the holder 10000 shown in FIG. 14. Therefore, it will be understood by one of ordinary skill in the art that general components other than the components shown in FIG. 14 may be further included in the holder 10000.

When a cigarette is inserted into the holder 10000, the holder 10000 heats the heater 13000. The temperature of an aerosol generating material in the cigarette is raised by the heated heater 13000, and thus aerosol is generated. The generated aerosol is delivered to a user through a cigarette filter. However, even when a cigarette is not inserted into the holder 10000, the holder 10000 may heat the heater 13000.

The casing 14000 may be detached from the holder 10000. For example, when a user rotates the casing 14000 clockwise or counterclockwise, the casing 14000 may be detached from the holder 10000.

The diameter of a hole formed by a terminal end 14100 of the casing 14000 may be smaller than the diameter of a space formed by the casing 14000 and the heater 13000. In this case, the hole may serve as a guide for a cigarette inserted into the holder 10000.

The battery 11000 supplies power used for the holder 10000 to operate. For example, the battery 11000 may supply power for heating the heater 13000 and supply power for operating the control unit 12000. In addition, the battery 11000 may supply power for operating a display, a sensor, a motor, and the like installed in the holder 10000.

The battery 11000 may be a lithium iron phosphate ($LiFePO_4$) battery, but is not limited to the example described above. For example, the battery 11000 may be a lithium cobalt oxide ($LiCoO_2$) battery, a lithium titanate battery, etc.

Also, the battery 11000 may have a cylindrical shape having a diameter of 10 mm and a length of 37 mm, but is not limited thereto. The capacity of the battery 11000 may be 120 mAh or more, and the battery 11000 may be a rechargeable battery or a disposable battery. For example, when the battery 11000 is rechargeable, the charging rate (C-rate) of the battery 11000 may be 10C and the discharging rate (C-rate) may be 16C to 20C. However, the present disclosure is not limited thereto. Also, for stable use, the battery 11000 may be manufactured, such that 80% or more of the total capacity may be ensured even when charging/discharging are performed 8000 times.

Here, it may be determined whether the battery 11000 is fully charged or completely discharged based on a level of power stored in the battery 11000 as compared to the entire capacity of the battery 11000. For example, when power stored in the battery 11000 is equal to or more than 95% of the total capacity, it may be determined that the battery 11000 is fully charged. Furthermore, when power stored in the battery 11000 is 10% or less of the total capacity, it may be determined that the battery 11000 is completely discharged. However, the criteria for determining whether the battery 11000 is fully charged or completely discharged are not limited to the above examples.

The heater 13000 is heated by power supplied from the battery 11000. When a cigarette is inserted into the holder 10000, the heater 13000 is located inside the cigarette. Therefore, the heated heater 13000 may raise the temperature of an aerosol generating material in the cigarette.

The shape of the heater 13000 may be a combination of a cylinderical shape and a conical shape. For example, the heater 13000 may have a cylindrical shape with a diameter of about 2 mm and a length of about 23 mm, and the terminal end 13100 of the heater 13000 may have an acute shape, but the present disclosure is not limited thereto. In other words, the heater 13000 may have any shape as long as the heater 130 may be inserted into the cigarette. In addition, only a portion of the heater 13000 may be heated. For example, assuming that the length of the heater 13000 is 23 mm, only 12 mm from the terminal end 13100 of the heater 13000 may be heated, and the remaining portion of the heater 13000 may not be heated.

The heater 13000 may be an electro-resistive heater. For example, the heater 13000 includes an electrically conductive track, and the heater 13000 may be heated as a current flows through the electrically conductive track.

For stable use, the heater 13000 may be supplied with power according to the specifications of 3.2 V, 2.4 A, and 8 W, but is not limited thereto. For example, when power is supplied to the heater 13000, the surface temperature of the heater 13000 may rise to 400° C. or higher. The surface temperature of the heater 13000 may rise to about 350° C. before 15 seconds after the power supply to the heater 13000 starts.

The holder 10000 may be provided with a separate temperature sensor. Alternatively, the holder 10000 may not be provided with a temperature sensing sensor, and the heater 13000 may serve as a temperature sensing sensor. For example, the heater 13000 may further include a second electrically conductive track for temperature sensing in addition to the first electrically conductive track for generating heat.

For example, when a voltage applied to the second electrically conductive track and a current flowing through the second electrically conductive track are measured, a resistance R may be determined. At this time, a temperature T of the second electrically conductive track may be determined by Equation 1 below.

$$R=R_0\{1\pm\alpha(T-T_0\} \quad \text{[Equation 1]}$$

In Equation 1, R denotes a current resistance value of the second electrically conductive track, $R_0$ denotes a resistance value at a temperature $T_0$ (e.g., 0° C.), and a denotes a resistance temperature coefficient of the second electrically conductive track. Since conductive materials (e.g., metals) have inherent resistance temperature coefficients, a may be determined in advance according to a conductive material constituting the second electrically conductive track. Therefore, when the resistance R of the second electrically conductive track is determined, the temperature T of the second electrically conductive track may be calculated according to Equation 1.

The heater 13000 may include at least one electrically conductive track (a first electrically conductive track and a second electrically conductive track). For example, the heater 13000 may include, but is not limited to, two first electrically conductive tracks and one or two second electrically conductive tracks.

An electrically conductive track includes an electro-resistive material. For example, an electrically conductive track may include a metal. In another example, an electrically conductive track may include an electrically conductive ceramic material, a carbon, a metal alloy, or a composite of a ceramic material and a metal.

In addition, the holder 10000 may include both an electrically conductive track, which serve as temperature sensing sensors, and a temperature sensing sensor.

The control unit 12000 controls the overall operation of the holder 10000. Specifically, the control unit 12000 controls not only operations of the battery 11000 and the heater 13000, but also operations of other components included in the holder 10000. The control unit 12000 may also check the status of each of the components of the holder 10000 and determine whether the holder 10000 is in an operable state.

The control unit 12000 includes at least one processor. A processor may be implemented as an array of a plurality of logic gates or may be implemented as a combination of a general purpose microprocessor and a memory in which a program executable in the microprocessor is stored. It will be understood by one of ordinary skill in the art that the present disclosure may be implemented in other forms of hardware.

For example, the control unit 12000 may control the operation of the heater 13000. The control unit 12000 may control an amount of power supplied to the heater 13000 and a time for supplying the power, such that the heater 13000 may be heated to a predetermined temperature or maintained at a proper temperature. The control unit 12000 may also check the status of the battery 11000 (e.g., the remaining amount of the battery 11000) and generate a notification signal as occasions demand.

Also, the control unit 12000 may check the presence or absence of a user's puff, check the strength of the puff, and count the number of puffs. Also, the control unit 12000 may continuously check the time during which the holder 10000 is operating. Also, the control unit 12000 may check whether the cradle 20000, which will be described below, is coupled with the holder 10000 and control the operation of the holder 10000 according to coupling or separation of the cradle 20000 and the holder 10000.

Meanwhile, the holder 10000 may further include general-purpose components other than the battery 11000, the control unit 12000, and the heater 13000.

For example, the holder 10000 may include a display capable of outputting visual information or a motor for outputting tactile information. For example, when a display is included in the holder 10000, the control unit 12000 may provide a user information about the state of the holder 10000 (e.g., availability of the holder, etc.), information about the heater 13000 (e.g., start of preheating, progress of preheating, completion of preheating, etc.), information about the battery 11000 (e.g., remaining power of the battery 11000, availability, etc.), information about resetting of the holder 10000 (e.g., reset timing, reset progress, reset completion, etc.), information about cleaning of the holder 10000 (e.g., cleaning timing, cleaning progress, cleaning completion, etc.), information about charging of the holder 10000 (e.g., need of charging, charging progress, charging completed, etc.), information about puff (e.g., the number of puffs, notification of expected completion of puffs, etc.), or information about safety (e.g., time of use, etc.) via the display. In another example, when a motor is included in the holder 10000, the control unit 12000 may transmit the above-described information to a user by generating a vibration signal by using the motor.

The holder 10000 may also include a terminal coupled with at least one input device (e.g., a button) and/or the cradle 20000 through which a user may control the function of the holder 10000. For example, a user may perform various functions by using the input device of the holder 10000. By adjusting the number of times a user presses the input device (e.g., once, twice, etc.) or the time during which the input device is being pressed (e.g., 0.1 second, 0.2 second, etc.), a desired function from among a plurality of functions of the holder 10000 may be executed. As a user manipulates the input device, the holder 10000 may perform a function of preheating the heater 13000, a function of regulating the temperature of the heater 13000, a function of cleaning the space in which a cigarette is inserted, a function of checking whether the battery 11000 is in an operable state, a function of displaying the remaining power (available power) of the battery 11000, a function of resetting the holder 10000, etc. However, the functions of the holder 10000 are not limited to the examples described above.

The holder 10000 may also include a puff detecting sensor, a temperature sensing sensor, and/or a cigarette insertion detecting sensor. For example, the puff detecting sensor may be implemented by a common pressure sensor, and the cigarette insertion detecting sensor may be implemented by a common capacitive sensor or a resistance sensor. Also, the holder 10000 may be fabricated to have a structure in which the outside air may flow in/out even in the state where the cigarette is inserted.

Figure 15A:
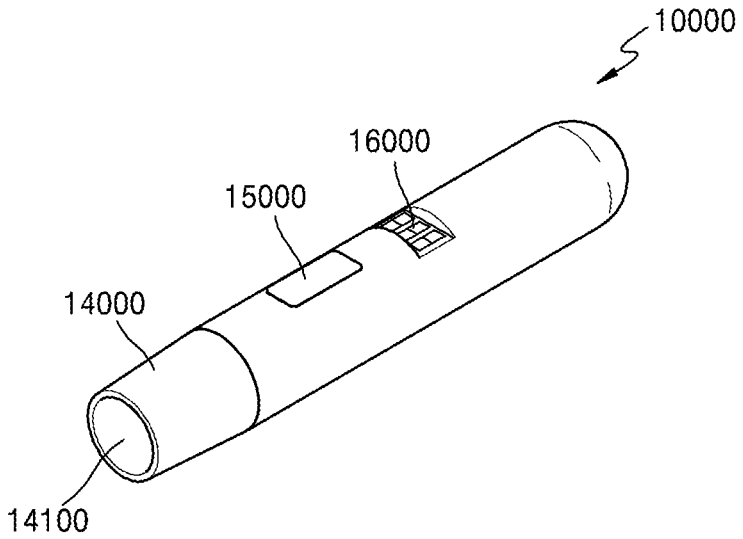
FIGS. 15A and 15B are diagrams showing various views of an example of a holder.
Figure 15B:
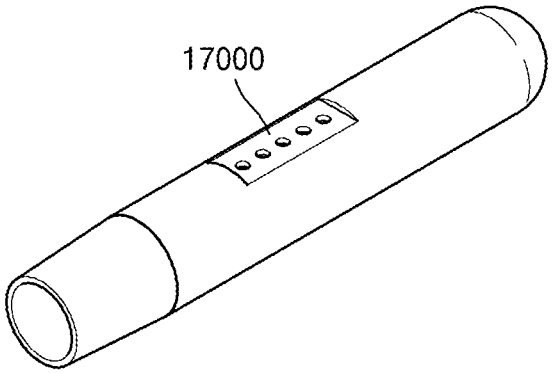

FIGS. 15A and 15B are diagrams showing various views of an example of a holder.

FIG. 15A is a diagram showing an example of the holder 10000 viewed in a first direction. As shown in FIG. 15A, the holder 10000 may be fabricated to have a cylindrical shape, but the present disclosure is not limited thereto. The casing 14000 of the holder 10000 may be separated by an action of a user and a cigarette may be inserted into a terminal end 14100 of the casing 14000. The holder 10000 may also include a button 15000 for a user to control the holder 10000 and a display 16000 for outputting an image.

FIG. 15B is a diagram showing an example of the holder 10000 viewed in a second direction. The holder 10000 may include a terminal 17000 coupled with the cradle 20000. As the terminal 17000 of the holder 10000 is coupled with the terminal 26000 of the cradle 20000, the battery 11000 of the holder 10000 may be charged by power supplied by the battery 21000 of the cradle 20000. Also, the holder 10000 may be operated by power supplied from the battery 21000 of the cradle 20000 through the terminal 17000 and the terminal 26000 and a communication (transmission/reception of signals) may be performed between the holder 10000 and the cradle 20000 through the terminal 17000 and the terminal 26000. For example, the terminal 17000 may include four micro pins, but the present disclosure is not limited thereto.

Figure 16:
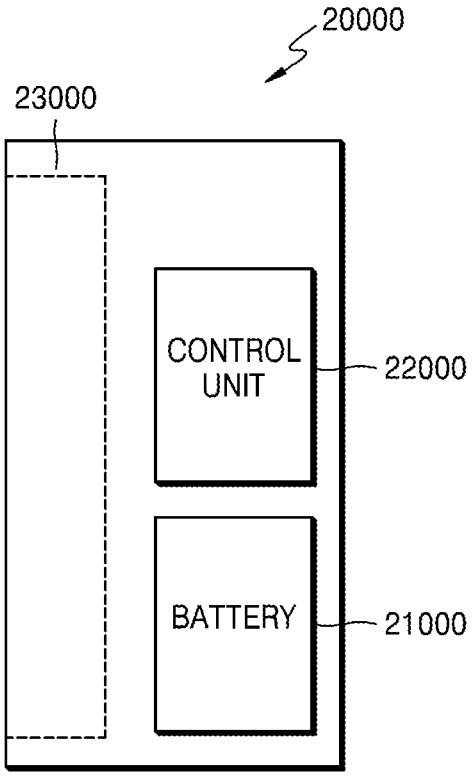
FIG. 16 is a diagram showing an example configuration of a cradle.

FIG. 16 is a diagram showing an example configuration of a cradle.

Referring to FIG. 16, the cradle 20000 includes the battery 21000 and a control unit 22000. The cradle 20000 also includes an inner space 23000 into which the holder 10000 may be inserted. For example, the inner space 23000 may be formed on one side of the cradle 20000. Therefore, the holder 10000 may be inserted and fixed in the cradle 20000 even when the cradle 20000 does not include a separate lid.

Only components associated with the present embodiment are shown in the cradle 20000 shown in FIG. 16. Therefore, it will be understood by one of ordinary skill in the art that general-purpose components other than the components shown in FIG. 16 may be further included in the cradle 20000.

In some embodiments, the cradle 20000 may correspond to a modification of the smoking member accommodation device 3000 of the above-described embodiment.

The battery 21000 provides power used to operate the cradle 20000. In addition, the battery 21000 may supply power for charging the battery 11000 of the holder 10000. For example, when the holder 10000 is inserted into the cradle 20000 and the terminal 17000 of the holder 10000 is coupled with the terminal 26000 of the cradle 20000, the battery 21000 of the cradle 20000 may supply power to the battery 11000 of the holder 10000.

Also, when the holder 10000 is coupled with the cradle 20000, the battery 21000 may supply power used for the holder 10000 to operate. For example, when the terminal 17000 of the holder 10000 is coupled with the terminal 26000 of the cradle 20000, the holder 10000 may operate by using power supplied by the battery 21000 of the cradle 20000 regardless whether the battery 11000 of the holder 10000 is discharged.

An example of the type of the battery 21000 may be the same as the example of the battery 11000 described above with reference to FIG. 14. The capacity of the battery 21000 may be greater than the capacity of the battery 11000. For example, the capacity of the battery 21000 may be, but is not limited to, 3000 mAh or greater.

The control unit 22000 generally controls the overall operation of the cradle 20000. The control unit 22000 may control the overall operation of all the configurations of the cradle 20000. The control unit 22000 may also determine whether the holder 10000 is coupled with the cradle 20000 and control the operation of the cradle 20000 according to coupling or separation of the cradle 20000 and the holder 10000.

For example, when the holder 10000 is coupled with the cradle 20000, the control unit 22000 may supply power of the battery 21000 to the holder 10000, thereby charging the battery 11000 or heating the heater 13000. Therefore, even when remaining power of the battery 11000 is low, a user may continuously smoke by coupling the holder 10000 with the cradle 20000.

The control unit 12000 includes at least one processor. A processor may be implemented as an array of a plurality of logic gates or may be implemented as a combination of a general purpose microprocessor and a memory in which a program executable in the microprocessor is stored. It will be understood by one of ordinary skill in the art that the present disclosure may be implemented in other forms of hardware.

Meanwhile, the cradle 20000 may further include general-purpose components other than the battery 21000 and the control unit 22000. For example, cradle 20000 may include a display capable of outputting visual information. For example, when the cradle 20000 includes a display, the control unit 22000 generates a signal to be displayed on the display, thereby informing a user information regarding the battery 21000 (e.g., the remaining power of the battery 21000, availability of the battery 21000, etc.), information regarding resetting of the cradle 20000 (e.g., reset timing, reset progress, reset completion, etc.), information regarding cleaning of the holder 10000 (e.g., cleaning timing, cleaning necessity, cleaning progress, cleaning completion, etc.), information regarding charging of the cradle 20000 (e.g., charging necessity, charging progress, charging completion, etc.).

The cradle 20000 may also include at least one input device (e.g., a button) for a user to control the function of the cradle 20000, a terminal 26000 to be coupled with the holder 10000, and/or an interface for charging the battery 21000 (e.g., an USB port, etc.).

For example, a user may perform various functions by using the input device of the cradle 20000. By controlling the number of times that a user presses the input device or a period of time for which the input device is pressed, a desired function from among the plurality of functions of the cradle 20000 may be executed. As a user manipulates the input device, the cradle 20000 may perform a function of preheating the heater 13000, a function of regulating the temperature of the heater 13000, a function of cleaning the space in which a cigarette is inserted, a function of checking whether the cradle 20000 is in an operable state, a function of displaying the remaining power (available power) of the battery 21000 of the cradle 20000, a function of resetting the cradle 20000, etc. However, the functions of the cradle 20000 are not limited to the examples described above.

Figure 17A:
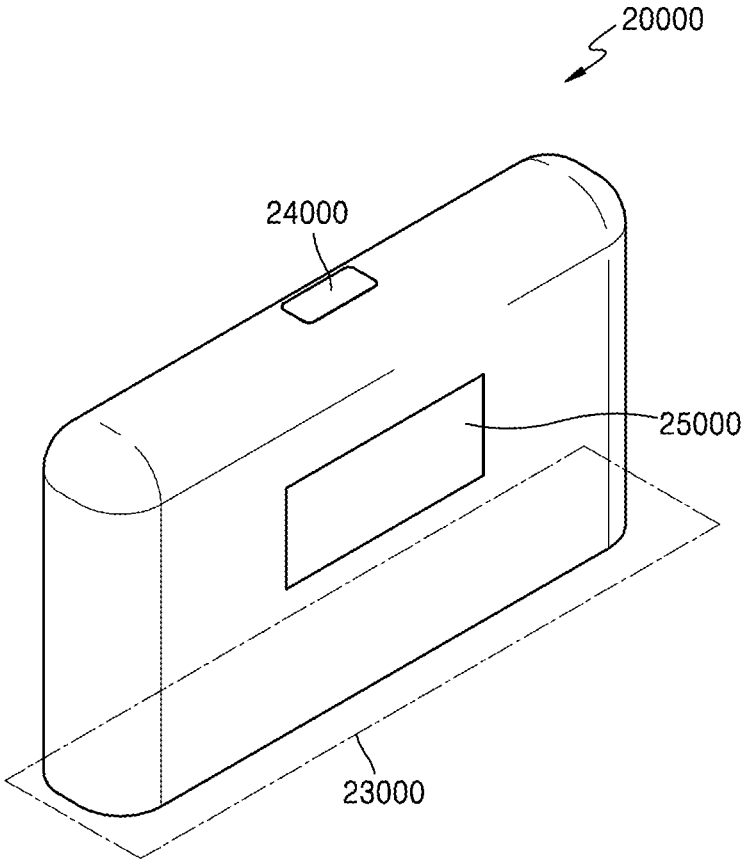
FIGS. 17A and 17B are diagrams showing various views of an example of a cradle.
Figure 17B:
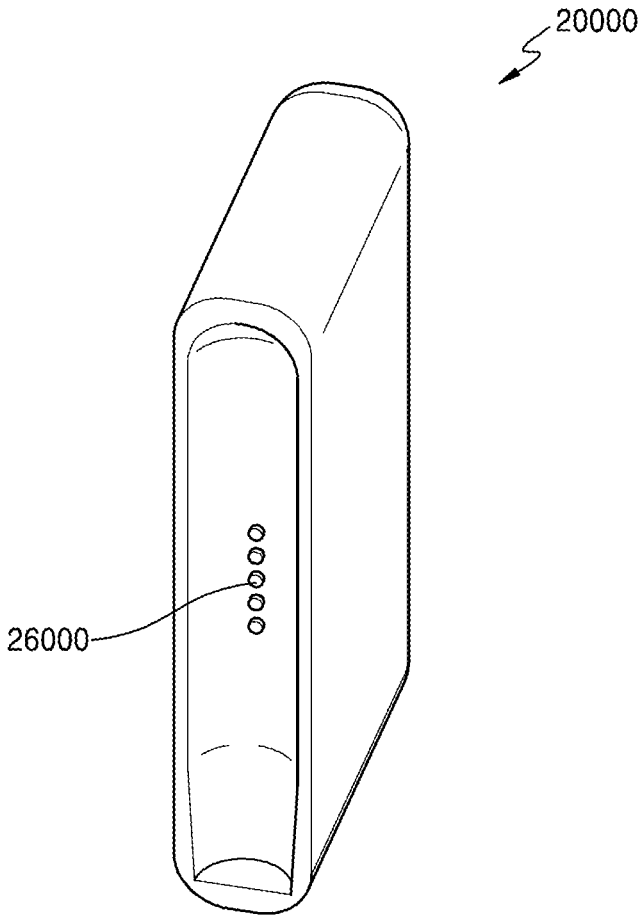

FIGS. 17A and 17B are diagrams showing various views of an example of a cradle.

FIG. 17A is a diagram showing an example of the cradle 20000 viewed in a first direction. The inner space 23000 into which the holder 10000 may be inserted may be formed on one side of the cradle 20000. Also, the holder 10000 may be inserted and fixed in the cradle 20000 even when the cradle 20000 does not include a separate fixing unit like a lid. The cradle 20000 may also include a button 24000 for a user to control the cradle 20000 and a display 25000 for outputting an image.

FIG. 17B is a diagram showing an example of the cradle 20000 viewed in a second direction. The cradle 20000 may include a terminal 26000 to be coupled with the inserted holder 10000. The battery 11000 of the holder 10000 may be charged by power supplied by the battery 21000 of the cradle 20000 as the terminal 26000 is coupled with the terminal 17000 of the holder 10000. Also, the holder 10000 may be operated by power supplied from the battery 21000 of the cradle 20000 through the terminal 17000 and the terminal 26000 and transmission/reception of signals may be performed between the holder 10000 and the cradle 20000 through the terminal 17000 and the terminal 26000. For example, the terminal 26000 may include four micro pins, but the present disclosure is not limited thereto.

The holder 10000 may be inserted into the inner space 23000 of the cradle 20000, as described above with reference to FIGS. 14 to 17B. The holder 10000 may be completely inserted into the cradle 20000 or may be tilted while being inserted into the cradle 20000. Hereinafter, examples in which the holder 10000 is inserted into the cradle 20000 will be described with reference to FIGS. 18 to 20B.

Figure 18:
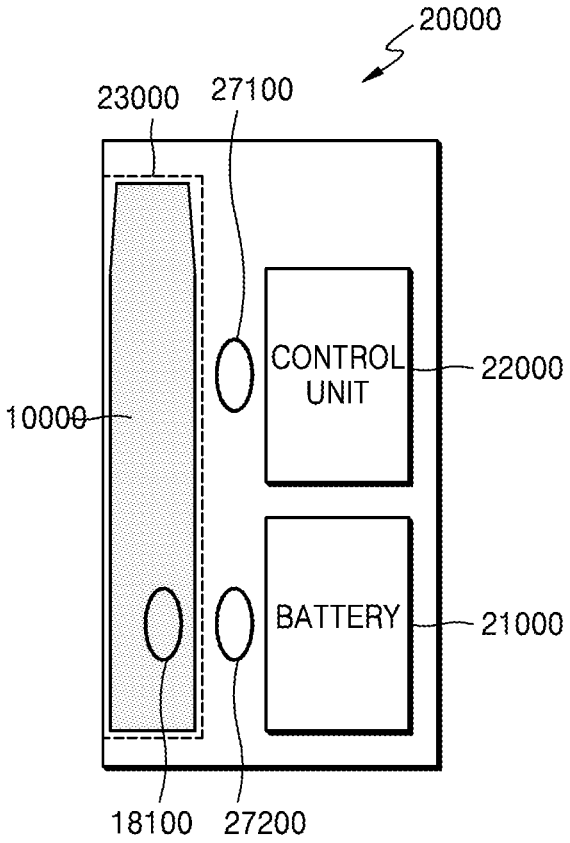
FIG. 18 is a diagram showing an example in which a holder is inserted into a cradle.

FIG. 18 is a diagram showing an example in which a holder is inserted into a cradle;

Referring to FIG. 18, an example in which the holder 10000 is inserted into the cradle 20000 is shown. Since the space 23000 into which the holder 10000 is to be inserted is present on one side surface of the cradle 20000, the inserted holder 10000 may not be exposed to the outside by the other side surfaces of the cradle 20000. Therefore, the cradle 20000 may not include another component (e.g., a lid) for not exposing the holder 10000 to the outside.

The cradle 20000 may include at least one attaching member 27100 and/or 27200 to increase attachment strength with the holder 10000. Also, at least one attaching member 18100 may be included in the holder 10000 as well. Here, attaching members 18100, 27100, and 27200 may be magnets, but are not limited thereto. Although FIG. 18 shows that the holder 10000 includes one attaching member 18100 and the cradle 20000 includes two attaching members 27100 and 27200 for convenience of explanation, the number of the attaching members 18100, 27100, and 27200 is not limited thereto.

The holder 10000 may include the attaching member 18100 at a first position and the cradle 20000 may include the attaching members 27100 and 27200 at a second position and a third position, respectively. In this case, the first position and the third position may be positions facing each other when the holder 10000 is inserted into the cradle 20000.

Since the attaching members 18100, 27100, and 27200 are included in the holder 10000 and the cradle 20000, the holder 10000 and the cradle 20000 may be attached to each other more strongly even when the holder 10000 is inserted into one side surface of the cradle 20000. In other words, as the holder 10000 and the cradle 20000 further include the attaching members 18100, 27100, and 27200 in addition to the terminals 17000 and 26000, the holder 10000 and the cradle 20000 may be attached to each other more strongly. Therefore, even when there is no separate component (e.g., a lid) in the cradle 20000, the inserted holder 10000 may not be easily separated from the cradle 20000.

Also, when the control unit 22000 also determines that the holder 10000 is completely inserted into the cradle 20000 through the terminals 17000 and 26000 and/or the attaching members 18100, 27100, and 27200, the control unit 22000 may charge the battery 11000 of the holder 10000 by using power of the battery 21000.

Figure 19:
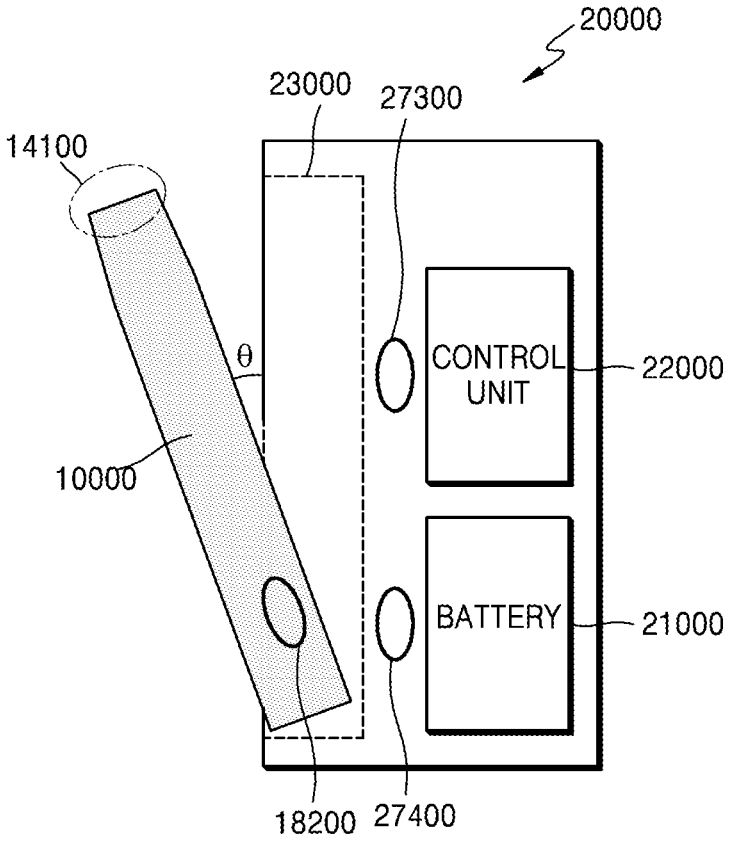
FIG. 19 is a diagram showing an example in which a holder is tilted while being inserted into a cradle.

FIG. 19 is a diagram showing an example in which a holder is tilted while being inserted into a cradle;

Referring to FIG. 19, the holder 10000 is tilted inside the cradle 20000. Here, the term 'tilting' indicates that the holder 10000 is inclined at a certain angle in a state while the holder 10000 is being inserted into the cradle 20000.

As shown in FIG. 18, when the holder 10000 is completely inserted into the cradle 20000, a user may not smoke. In other words, once the holder 10000 is completely inserted into the cradle 20000, a cigarette may not be inserted into the holder 10000. Therefore, when the holder 10000 is completely inserted into the cradle 20000, a user may not smoke.

As shown in FIG. 19, when the holder 10000 is tilted, the terminal end 14100 of the holder 10000 is exposed to the outside. Therefore, the user may insert a cigarette into the terminal end 14100 and smoke generated aerosol. A sufficient tilting angle θ may be secured to prevent a cigarette from being bent or damaged when the cigarette is inserted into the terminal end 14100 of the holder 10000. For example, the holder 10000 may be tilted to the extent that an entire cigarette insertion hole included in the terminal end 141 is exposed to the outside. For example, the range of the tilting angle θ may be greater than 0° and not greater than 180° and may preferably be not less than 10° and not greater than 90°. More preferably, the range of the tilting angle θ may be from 10° to 20°, from 10° to 30°, from 10° to 40°, from 10° to 50°, or from 10° to 60°.

Also, even when the holder 10000 is tilted, the terminal 17000 of the holder 10000 and the terminal 26000 of the cradle 20000 are coupled with each other. Therefore, the heater 13000 of the holder 10000 may be heated by power supplied by the battery 21000 of the cradle 20000. Therefore, the holder 10000 may generate aerosol by using the battery 21000 of the cradle 20000 even when the remaining power of the battery 11000 of the holder 10000 is low or the battery 11000 of the holder 10000 is completely discharged.

FIG. 19 shows an example in which the holder 10000 includes one attaching member 18200 and the cradle 20000 includes two attaching members 27300 and 27400. For example, the respective positions of the attaching members 18200, 27300, and 27400 are as described above with reference to FIG. 18. Assuming that the attaching members 18200, 27300, and 27400 are magnets, the magnetic strength of the attaching member 27400 may be greater than the magnetic strength of the attaching member 27300. Therefore, the holder 10000 may not be completely separated from the cradle 20000 due to the attaching member 18200 and the attaching member 27400 even when the holder 10000 is tilted.

Also, when it is determined that the holder 10000 titled through the terminals 17000 and 26000 and/or the attaching members 18100, 27100, and 27200, the control unit 22000 may heat the heater 13000 of the holder 10000 or charge the battery 11000 by using power of the battery 21000.

Figure 20A:
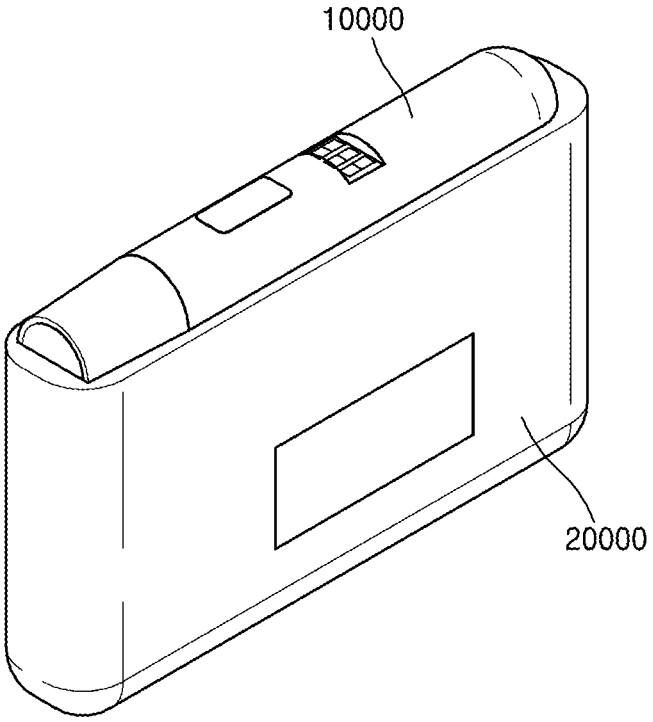

FIGS. 20A and 22B are diagrams showing examples in which a holder is inserted into a cradle.

FIG. 20A shows an example in which the holder 10000 is completely inserted into the cradle 20000. The cradle 20000 may be fabricated to provide the sufficient inner space 23000 of the cradle 20000 to minimize the contact of a user with the holder 10000 when the holder 10000 is completely inserted into the cradle 20000. When the holder 10000 is completely inserted into the cradle 20000, the control unit 22000 supplies power of the battery 21000 to the holder 10000, such that the battery 11000 of the holder 10000 is charged.

Figure 20B:
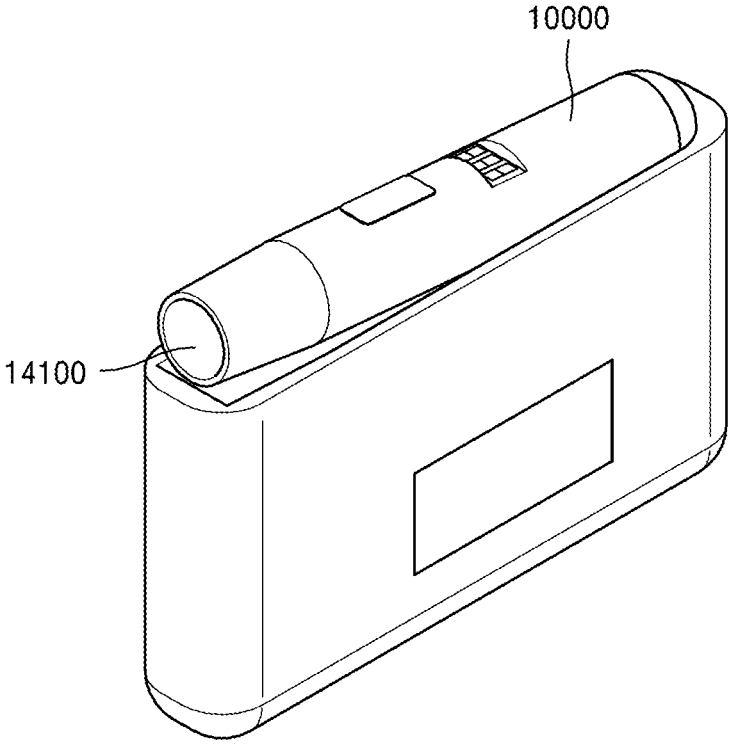

FIG. 20B shows an example in which the holder 10000 is tilted while being inserted into the cradle 20000. When the holder 10000 is tilted, the control unit 22000 supplies power of the battery 21000 to the holder 10000, such that the battery 11000 of the holder 10000 is charged or the heater 13000 of the holder 10000 is heated.

Figure 21:
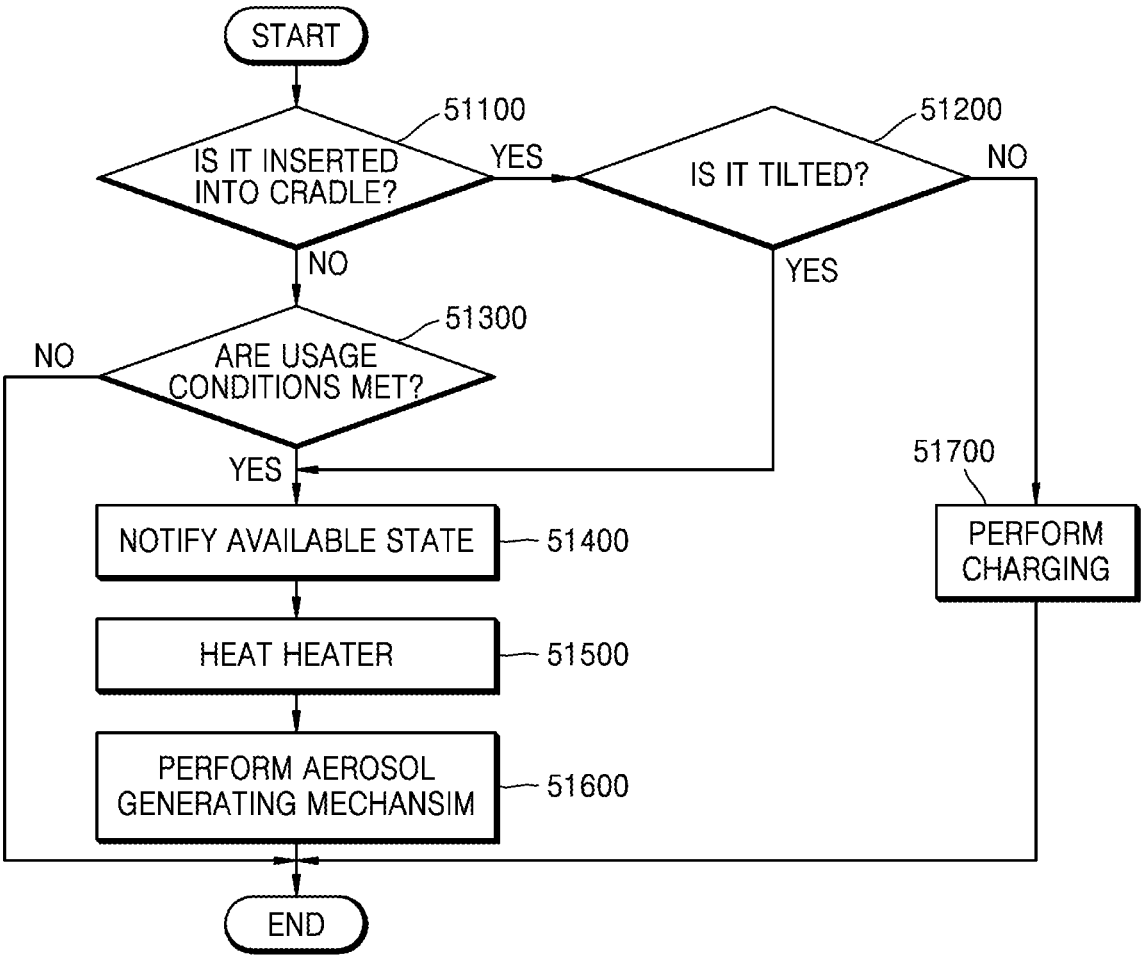
FIG. 21 is a flowchart for describing an example in which a holder and a cradle operates.

FIG. 21 is a flowchart for describing an example in which a holder and a cradle operates.

A method for generating aerosols shown in FIG. 21 includes operations that are performed in a time-series manner by the holder 10000 shown in FIG. 14 or the cradle 20000 shown in FIG. 18. Therefore, it will be understood that the descriptions given above with respect to the holder 10000 shown in FIG. 14 and the cradle 20000 shown in FIG. 18 also apply to the method of FIG. 21, even when the descriptions are omitted below.

In operation 51100, the holder 10000 determines whether it is inserted in the cradle 20000. For example, the control unit 12000 may determine whether the holder 10000 is inserted into the cradle 20000 based on whether the terminals 17000 and 26000 of the holder 10000 and the cradle 20000 are connected to each other and/or whether the attaching members 18100, 27100, and 27200 are operating.

When the holder 10000 is inserted into the cradle 20000, the method proceeds to operation 51200. When the holder 10000 is separated from the cradle 20000, the method proceeds to operation 51300.

In operation 51200, the cradle 20000 determines whether the holder 10000 is tilted. For example, the control unit 22000 may determine whether the holder 10000 is inserted into the cradle 20000 based on whether the terminals 17000 and 26000 of the holder 10000 and the cradle 20000 are connected to each other and/or whether attaching members 18200, 27300, and 27400 are operating.

Although it is described that the cradle 20000 determines whether the holder 10000 is tilted in operation 51200, the present disclosure is not limited thereto. In other words, the control unit 12000 of the holder 10000 may determine whether the holder 10000 is tilted.

When the holder 10000 is tilted, the method proceeds to operation 51400. When the holder 10000 is not tilted (i.e., the holder 10000 is completely inserted into the cradle 200), the method proceeds to operation 51700.

In operation 51300, the holder 10000 determines whether conditions of using the holder 10000 are satisfied. For example, the control unit 12000 may determine whether the conditions for using the holder 10000 are satisfied by checking whether the remaining power of the battery 11000 and whether other components of the holder 10000 may be normally operated.

When the conditions for using the holder 10000 are satisfied, the method proceeds to operation 51400. Otherwise, the method is terminated.

In operation 51400, the holder 10000 informs a user that the holder 10000 is ready to be used. For example, the control unit 12000 may output an image indicating that the holder 10000 is ready to be used on the display of the holder 10000 or may control the motor of the holder 10000 to generate a vibration signal.

In operation 51500, the heater 13000 is heated. For example, when the holder 10000 is separated from the cradle 20000, the heater 13000 may be heated by power of the battery 11000 of the holder 10000. In another example, when the holder 10000 is tilted, the heater 13000 may be heated by power of the battery 21000 of the cradle 20000.

The control unit 12000 of the holder 10000 or the control unit 22000 of the cradle 20000 may check the temperature of the heater 13000 in real time and control an amount of power supplied to the heater 13000 and a time for supplying the power to the heater 13000. For example, the control unit 12000 or 22000 may check the temperature of the heater 13000 in real time through a temperature sensor included in the holder 10000 or an electrically conductive track of the heater 13000.

In operation 51600, the holder 10000 performs an aerosol generation mechanism. For example, the control unit 12000 or 22000 may check the temperature of the heater 13000, which changes as a user performs puffs, and adjust an amount of power supplied to the heater 13000 or stop supplying power to the heater 13000. Also, the control unit 12000 or 22000 may count the number of puffs of the user and output information indicating that the holder 10000 needs to be cleaned when the number of puffs reaches a certain number of times (e.g., 1500).

In operation 51700, the cradle 20000 performs charging of the holder 10000. For example, the control unit 22000 may charge the holder 10000 by supplying power of the battery 21000 of the cradle 20000 to the battery 11000 of the holder 10000.

Meanwhile, the control unit 12000 or 22000 may stop the operation of the holder 10000 according to the number of puffs of the user or the operation time of the holder 10000. Hereinafter, an example in which the control unit 12000 or 22000 stops the operation of the holder 10000 will be described with reference to FIG. 22.

Figure 22:
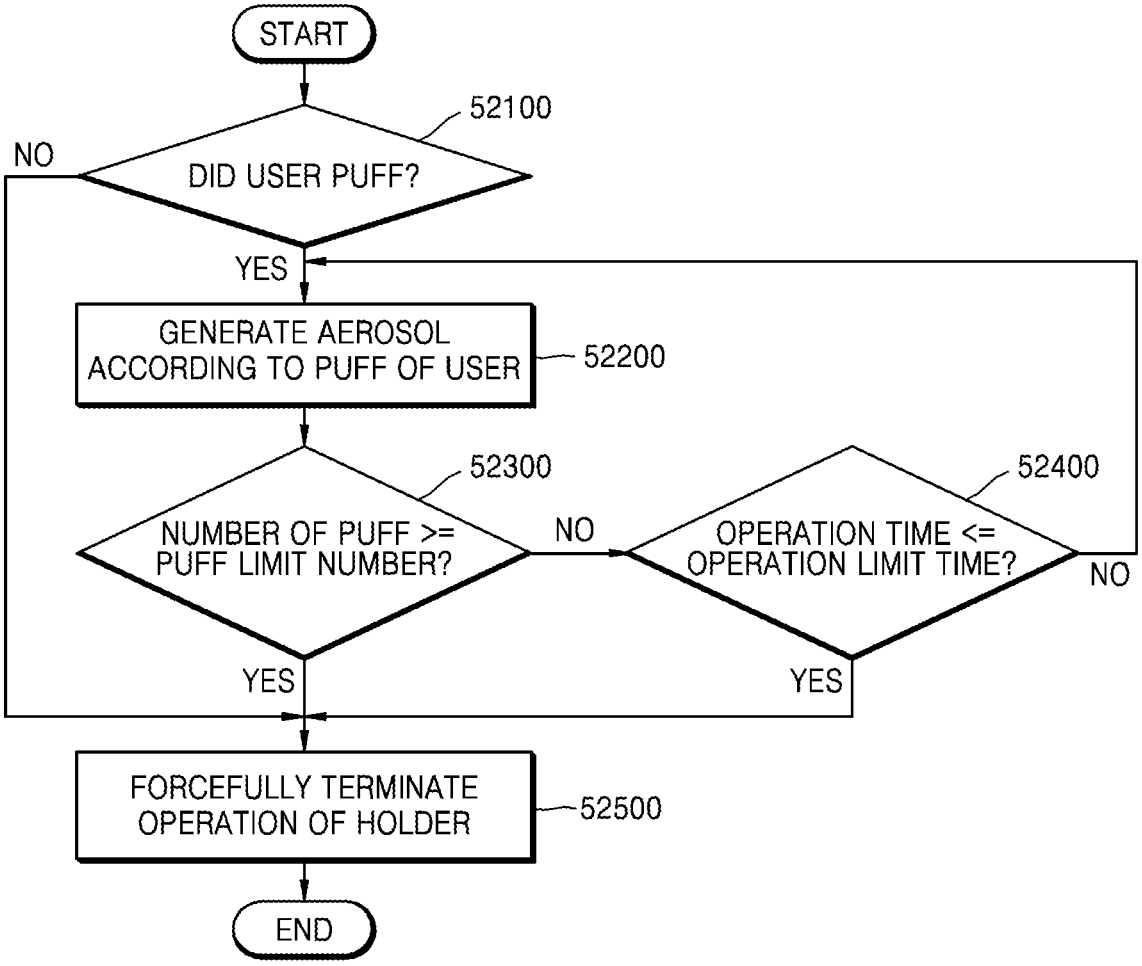
FIG. 22 is a flowchart for describing an example in which a holder operates.

FIG. 22 is a flowchart for describing another example in which a holder operates.

A method for generating aerosols shown in FIG. 22 includes operations that are performed in a time-series manner by the holder 10000 shown in FIG. 14 and the cradle 20000 shown in FIG. 18. Therefore, it will be understood that the descriptions given above with respect to the holder 10000 shown in FIG. 14 or the cradle 20000 shown in FIG. 18 also apply to the method of FIG. 22, even when the descriptions are omitted below.

In operation 52100, the control unit 12000 or 22000 determines whether a user puffed. For example, the control unit 12000 or 22000 may determine whether the user puffed through the puff detecting sensor included in the holder 10000.

In operation 52200, aerosol is generated according to the puff of the user. The control unit 12000 or 22000 may adjust power supplied to the heater 13000 according to the puff of the user the temperature of the heater 13000, as described above with reference to FIG. 21. Also, the control unit 12000 or 22000 counts the number of puffs of the user.

In operation 52300, the control unit 12000 or 22000 determines whether the number of puffs of the user equal to or greater than a puff limit number. For example, assuming that the puff limit number is set to 14, the control unit 12000 or 22000 determines whether the number of counted puffs is 14 or more.

On the other hand, when the number of puffs of the user is close to the puff limit number (e.g., when the number of puffs of the user is 12), the control unit 12000 or 22000 may output a warning signal through a display or a vibration motor.

When the number of puffs of the user is equal to or greater than the puff limit number, the method proceeds to operation 52500. When the number of puffs of the user is less than the puff limit number, the method proceeds to operation 52400.

In operation 52400, the control unit 12000 or 22000 determines whether the operation time of the holder 10000 is equal to or greater than an operation limit time. Here, the operation time of the holder 10000 refers to accumulated time from a time point at which the holder 10000 started its operation to a current time point. For example, assuming that the operation limit time is set to 10 minutes, the control unit 12000 or 22000 determines whether the holder 10000 is operating for 10 minutes or longer.

On the other hand, when the operation time of the holder 10000 is close to the operation limit time (e.g., when the holder 10000 is operating for 8 minutes), the control unit 12000 or 22000 may output a warning signal through a display or a vibration motor.

When the holder 10000 is operating for the operation limit time or longer, the method proceeds to operation 52500. When the operation time of the holder 10000 is less than the operation limit time, the method proceeds to operation 52200.

In operation 52500, the control unit 12000 or 22000 forcefully terminates the operation of the holder 10000. In other words, the control unit 12000 or 22000 terminates the aerosol generation mechanism of the holder 10000. For example, the control unit 12000 or 22000 may forcibly terminate the operation of the holder 10000 by interrupting the power supplied to the heater 13000.

Figure 23:
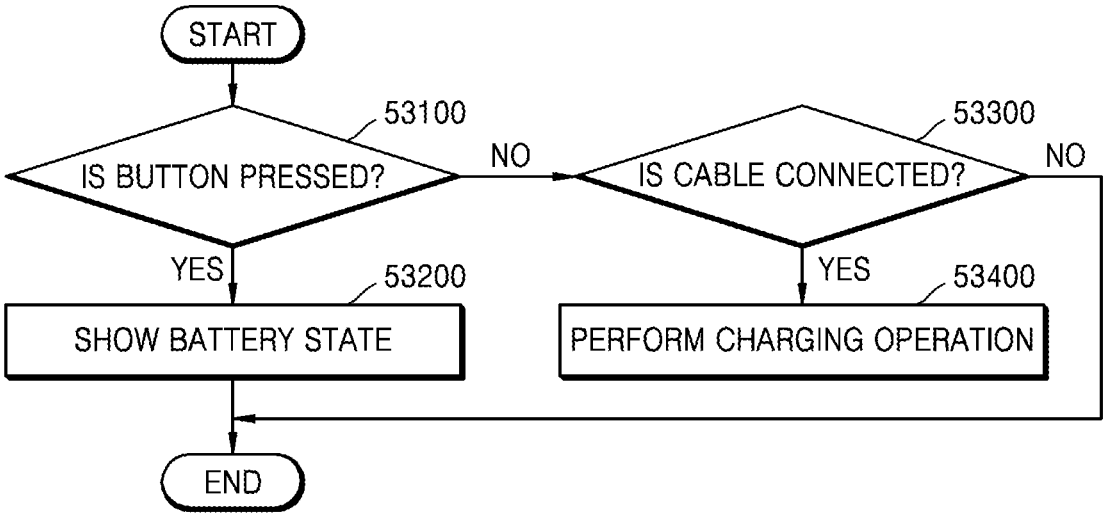
FIG. 23 is a flowchart for describing an example in which a cradle operates.

FIG. 23 is a flowchart for describing an example in which a cradle operates.

The flowchart shown in FIG. 25 includes operations that are performed in a time-series manner by the cradle 20000 shown in FIG. 23. Therefore, it will be understood that the descriptions given above with respect to the cradle 20000 shown in FIG. 18 also apply to the method of FIG. 23, even when the descriptions are omitted below.

Although not shown in FIG. 23, the operation of the cradle 20000 to be described below may be performed regardless of whether the holder 10000 is inserted into the cradle 20000.

In operation 53100, the control unit 22000 of the cradle 20000 determines whether the button 24000 is pressed. When the button 24000 is pressed, the method proceeds to operation 53200. When the button 24000 is not pressed, the method proceeds to operation 53300.

In operation 53200, the cradle 20000 indicates the status of the battery 21000. For example, the control unit 22000 may output information regarding the current state of the battery 21000 (e.g., remaining power, etc.) on the display 250.

In operation 53300, the control unit 22000 of the cradle 20000 determines whether a cable is connected to the cradle 20000. For example, the control unit 22000 determines whether a cable is connected to an interface (e.g., a USB port, etc.) included in the cradle 20000. When a cable is connected to the cradle 20000, the method proceeds to operation 53400. Otherwise, the method is terminated.

In operation 53400, the cradle 20000 performs a charging operation. For example, the cradle 20000 charges the battery 21000 by using power supplied through a connected cable.

As described above with reference to FIG. 14, a cigarette may be inserted into the holder 10000. The cigarette includes an aerosol generating material and aerosol is generated by the heated heater 13000.

Hereinafter, an example of a cigarette that may be inserted into the holder 10000 will be described with reference to FIGS. 24 to 26F.

Figure 24:
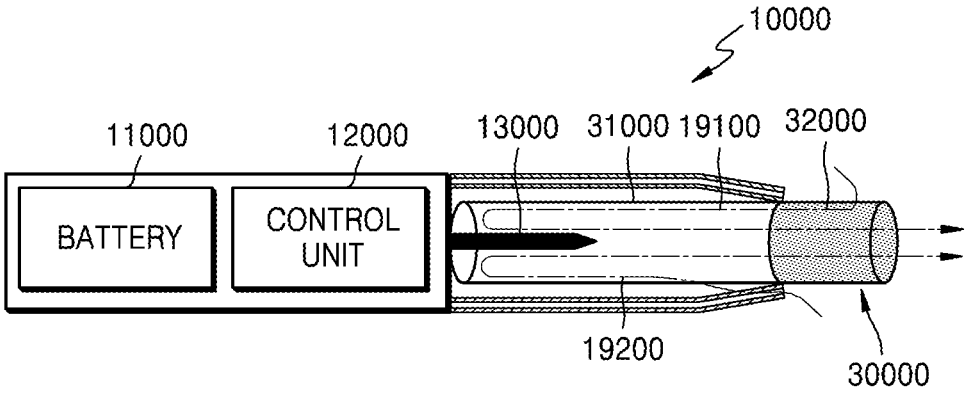
FIG. 24 is a diagram showing an example in which a cigarette is inserted into a holder.

FIG. 24 is a diagram showing an example in which a cigarette is inserted into a holder.

Referring to FIG. 24, the cigarette 30000 may be inserted into the holder 10000 through the terminal end 14100 of the casing 14000. When the cigarette 30000 is inserted into the holder 10000, the heater 13000 is located inside the cigarette 30000. Therefore, the heated heater 13000 heats the aerosol generating material of the cigarette 30000, thereby generating aerosol.

The cigarette 30000 may be similar to a typical burning cigarette. For example, the cigarette 30000 may include a first portion 31000 containing an aerosol generating material and a second portion 32000 including a filter and the like. Meanwhile, the cigarette 30000 according to one embodiment may also include an aerosol generating material in the second portion 32000. For example, an aerosol generating material in the form of granules or capsules may be inserted into the second portion 32000.

The entire first portion 31000 may be inserted into the holder 10000 and the second portion 32000 may be exposed to the outside. Alternatively, only a portion of the first portion 31000 may be inserted into the holder 10000 or the entire first portion 31000 and a portion the second portion 32000 may be inserted into the holder 10000.

A user may inhale the aerosol while holding the second portion 32000 by his/her lips. At this time, the aerosol is mixed with the outside air and delivered to the user's mouth. As shown in FIG. 24, the outside air may be introduced 19100 through at least one hole formed in the surface of the cigarette 30000 or introduced 19200 through at least one air passage formed in the holder 10000. For example, the air passage formed in the holder 10000 may be formed to be opened and closed by a user.

Figure 25A:
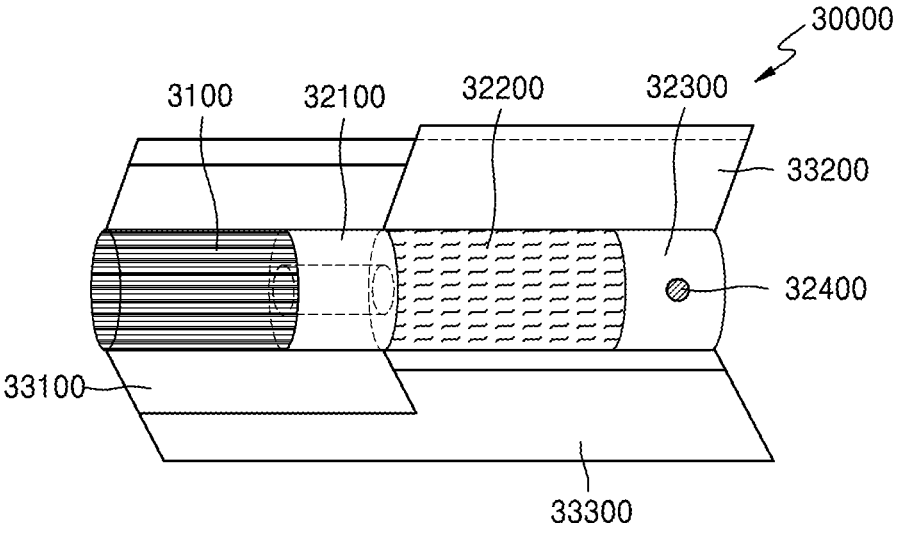
FIGS. 25A and 25B are block diagrams showing examples of a cigarette.
Figure 25B:
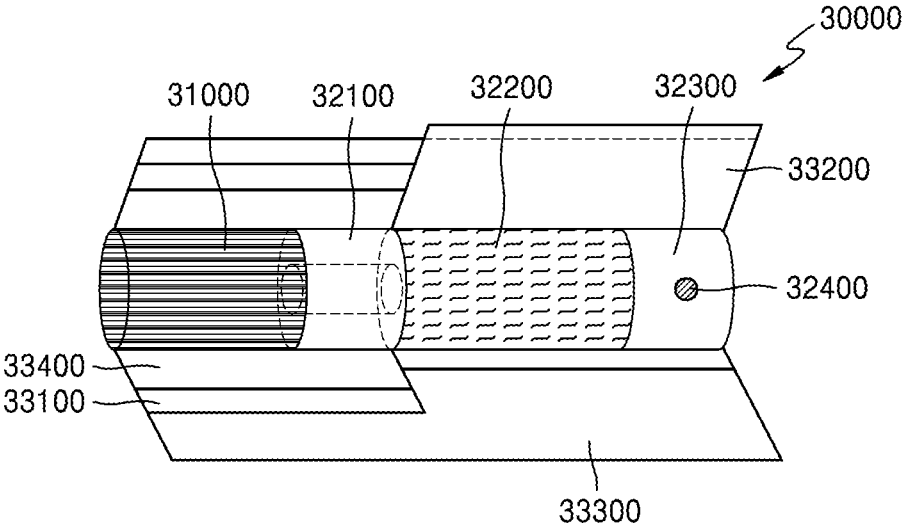

FIGS. 25A and 25B are block diagrams showing examples of a cigarette; and Referring to FIGS. 25A and 25B, the cigarette 30000 includes a tobacco rod 31000, a first filter segment 32100, a cooling structure 32200, and a second filter segment 32300. The first portion 31000 described above with reference to FIG. 24 includes the tobacco rod 31000 and the second portion 32000 includes the first filter segment 32100, the cooling structure 32200, and the second filter segment 32300.

Meanwhile, comparing FIGS. 25A and 25B, the cigarette 30000 of FIG. 25B further includes a fourth wrapper 33400 as compared to the cigarette 30000 of FIG. 25A.

However, the structures of the cigarette 30000 shown in FIGS. 25A and 25B are merely examples, and some of the components may be omitted. For example, the cigarette 30000 may not include one or more of the first filter segment 32100, the cooling structure 32200, and the second filter segment 32300.

The tobacco rod 31000 includes an aerosol generating material. For example, the aerosol generating material may include at least one of glycerine, propylene glycol, ethylene glycol, dipropylene glycol, diethylene glycol, triethylene glycol, tetraethylene glycol, and oleyl alcohol. The length of the tobacco rod 31000 may be from about 7 mm to about 15 mm or may preferably be about 12 mm. Alternatively, the length of the tobacco rod 31000 may be from about 7 mm to about 9 mm or may preferably be about 7.9 mm. The length and diameter of the tobacco rod 31000 are not limited to the numerical ranges described above.

In addition, the tobacco rod 31000 may include other additive materials like a flavoring agent, a wetting agent, and/or an acetate compound. For example, the flavouring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang, salvia, spearmint, ginger, coriander, coffee, etc. In addition, the wetting agent may include glycerine or propylene glycol.

For example, the tobacco rod 31000 may be filled with cut tobacco leaves. Here, cut tobacco leaves may be formed by pulverizing a tobacco sheet.

For a large wide tobacco sheet to be filled within the tobacco rod 31000 having a narrow space, an operation for facilitating folding of the tobacco sheet is further needed. Therefore, it is easier to fill the tobacco rod 31000 with cut tobacco leaves compared to filling the tobacco rod 31000 with a tobacco sheet, and thus the productivity and the efficiency of the process for producing the tobacco rod 31000 may be improved.

In another example, the tobacco rod 31000 may be filled with a plurality of cigarette strands formed by fine-cutting a tobacco sheet. For example, the tobacco rod 31000 may be formed by combining a plurality of tobacco strands in the same direction (parallel to one another) or randomly. One tobacco strand may be fabricated to have a cuboidal shape having the horizontal length of 1 mm, the vertical length of 12 mm, and the thickness (height) of 0.1 mm, but the present disclosure is not limited thereto.

Compared to the tobacco rod 31000 filled with a cigarette sheet, the tobacco rod 31000 filled with tobacco strands may generate a greater amount of aerosol. In the case of filling the same space, compared to a tobacco sheet, tobacco strands ensure a wider surface area. A wider surface area indicates that an aerosol generating material has a greater chance of contacting the outside air. Therefore, when the tobacco rod 31000 is filled with tobacco strands, more aerosol may be generated as compared to the tobacco rod 31000 filled with a tobacco sheet.

Furthermore, when the cigarette 30000 is separated from the holder 10000, the tobacco rod 31000 filled with tobacco strands may be separated more easily than the tobacco rod 31000 filled with a tobacco sheet. Compared to a tobacco sheet, tobacco strands generate less frictional force in contact with the heater 13000. Therefore, when the tobacco rod 31000 is filled with tobacco strands, the tobacco rod 31000 may be more easily separated from the holder 10000 than the tobacco sheet 31000 filled with a tobacco sheet.

A tobacco sheet may be formed by pulverizing a tobacco raw material into the form of slurry and drying the slurry. For example, from 15% to 30% of an aerosol generating material may be added to the slurry. The raw tobacco material may be tobacco leaf fragments, tobacco stems, fine tobacco powders formed during treatment of tobacco, and/or major leaf fragment strips of tobacco leaves. The tobacco sheet may also include other additives like wood cellulose fibers.

The first filter segment 32100 may be a cellulose acetate filter. For example, the first filter segment 32100 may have a tubular structure including a hollowness therein. The length of the first filter segment 32100 may be from about 7 mm to about 15 mm or may preferably be about 7 mm. The length of the first filter segment 32100 may be smaller than about 7 mm, but may have a length sufficient to not to compromise the function of at least one cigarette element (e.g., a cooling element, a capsule, an acetate filter, etc.). The length of the first filter segment 32100 is not limited to the numerical range described above. Meanwhile, the length of the first filter segment 32100 may be extended, and the length of the entire cigarette 30000 may be adjusted according to the length of the first filter segment 32100.

The second filter segment 32300 may also be a cellulose acetate filter. For example, the second filter segment 323 may be fabricated as a recess filter including a hollowness therein, but is not limited thereto. The length of the second filter segment 32100 may be from about 5 mm to about 15 mm or may preferably be about 12 mm. The length of the second filter segment 32300 is not limited to the numerical range described above.

Also, the second filter segment 32300 may include at least one capsule 32400. Here, the capsule 32400 may have a structure in which a content liquid containing a flavoring material is wrapped with a film. For example, the capsule 32400 may have a spherical or cylindrical shape. The diameter of the capsule 32400 may be about 2 mm or greater or may preferably be from about 2 mm to about 4 mm.

The material constituting the film of the capsule 32400 may be a starch and/or a gelling agent. For example, gelling gum or gelatin may be used as the gelling agent. Furthermore, a gelling agent may be further used as a material for forming the film of the capsule 32400. Here, as the gelling agent, for example, a calcium chloride group may be used. Furthermore, a plasticizer may be further used as a material for forming the film of the capsule 32400. As the plasticizer, glycerine and/or sorbitol may be used. Furthermore, a coloring agent may be further used as a material for forming the film of the capsule 32400.

For example, as a flavouring material included in the content liquid of the capsule 324, menthol, plant essential oil, and the like may be used. As a solvent of the flavouring material included in the content liquid, for example, a medium chain fatty acid triglyceride (MCT) may be used. Also, the content liquid may include other additives like a figment, an emulsifying agent, a thickening agent, etc.

The cooling structure 32200 cools aerosol generated as the heater 13000 heats the tobacco rod 31000. Therefore, a user may inhale aerosol cooled to a suitable temperature. The length of the cooling structure 32200 may be from about 10 mm to about 20 mm or may preferably be about 14 mm. The length of the cooling structure 32200 is not limited to the numerical range described above.

For example, the cooling structure 32200 may be formed of polylactic acid. The cooling structure 32200 may be fabricated in various forms to increase the surface area per unit area (that is, a surface area in which the cooling structure 32200 contacts the aerosol). Various examples of the cooling structure 32200 are described below with reference to FIGS. 26A to 26F.

The tobacco rod 31000 and the first filter segment 32100 may be wrapped by a first wrapper 33100. For example, the first wrapper 33100 may be made of a paper packaging material having oil resistance.

The cooling structure 32200 and the second filter segment 32300 may be wrapped by a second wrapper 33200. In addition, the entire cigarette 30000 may be repackaged by a third wrapper 33300. For example, the second wrapper 33200 and the third wrapper 33300 may be made of a general paper wrapping material. Optionally, the second wrapper 33200 may be an oil resistant hard wrap or a PLA fragrance-added paper. Also, the second wrapper 33200 may wrap a portion of the second filter segment 32300, and may further wrap the second filter segment 32300 and the cooling structure 32200.

Referring to FIG. 25B, the cigarette 30000 may include a fourth wrapper 33400. At least one of the tobacco rod 31000 and the first filter segment 32100 may be wrapped by the fourth wrapper 33400. In other words, only the tobacco rod 31000 may be wrapped by the fourth wrapper 33400, or the tobacco rod 31000 and the first filter segment 32100 may be wrapped by the fourth wrapper 33400. For example, the fourth wrapper 33400 may be made of a paper packaging material.

The fourth wrapper 33400 may be formed by applying (or coating) a predetermined material to one or both surfaces of a paper packaging material. Here, an example of the predetermined material may be, but is not limited to, silicon. Silicon exhibits characteristics like heat resistance with little change due to the temperature, oxidation resistance, resistances to various chemicals, water repellency, electrical insulation, etc. However, any material having the above-described characteristics other than silicon may be applied (or coated) to the fourth wrapper 33400 without limitation.

Meanwhile, although FIG. 25B shows that the cigarette 30000 includes both the first wrapper 33100 and the fourth wrapper 33400, but the present disclosure is not limited thereto. In other words, the cigarette 30000 may include only one of the first wrapper 33100 and the fourth wrapper 33400.

The fourth wrapper 33400 may prevent the cigarette 30000 from burning. For example, when the tobacco rod 31000 is heated by the heater 13000, there is a possibility that the cigarette 30000 is burned. In detail, when the temperature is raised to a temperature above the ignition point of any one of materials included in the tobacco rod 31000, the cigarette 30000 may be burned. Even in this case, since the fourth wrapper 33400 includes a non-combustible material, the cigarette 30000 may be prevented from burning.

Also, the fourth wrapper 33400 may prevent the holder 10000 from being contaminated by materials generated by the cigarette 30000. Through puffs of a user, liquid substances may be formed in the cigarette 30000. For example, as the aerosol formed by the cigarette 30000 is cooled by the outside air, liquid materials (e.g., moisture, etc.) may be formed. As the fourth wrapper 33400 packs the tobacco rod 31000 and/or the first filter segment 32100, liquid substances produced in the cigarette 30000 may be prevented from being leaked out of the cigarette 30000. Accordingly, the casing 14000 of the holder 10000 and the like may be prevented from being contaminated by the liquid materials formed by the cigarette 30000.

FIGS. 26A to 26F are diagrams showing examples of a cooling structure of a cigarette.

For example, the cooling structures shown in FIGS. 26A to 26F may be fabricated by using fibers made of pure polylactic acid (PLA).

For example, when a cooling structure is manufactured by filling a film (sheet), the film (sheet) may be broken by an external impact. In this case, the aerosol cooling effect of the cooling structure is deteriorated.

In another example, when a cooling structure is manufactured through extrusion molding or the like, the efficiency of the process is lowered due to the addition of operations like cutting of a structure. Also, there are limits in manufacturing a cooling structure in various shapes.

As the cooling structure according to an embodiment is fabricated by using polylactic acid fibers (e.g., weaving), the risk of the cooling structure being deformed or losing function by an external impact may be reduced. Also, by changing the way of combining fibers, the cooling structure having various shapes may be fabricated.

Furthermore, by fabricating the cooling structure by using fibers, the surface area contacting with aerosol is increased. Therefore, the aerosol cooling effect of the cooling structure may be further improved.

Figure 26A:
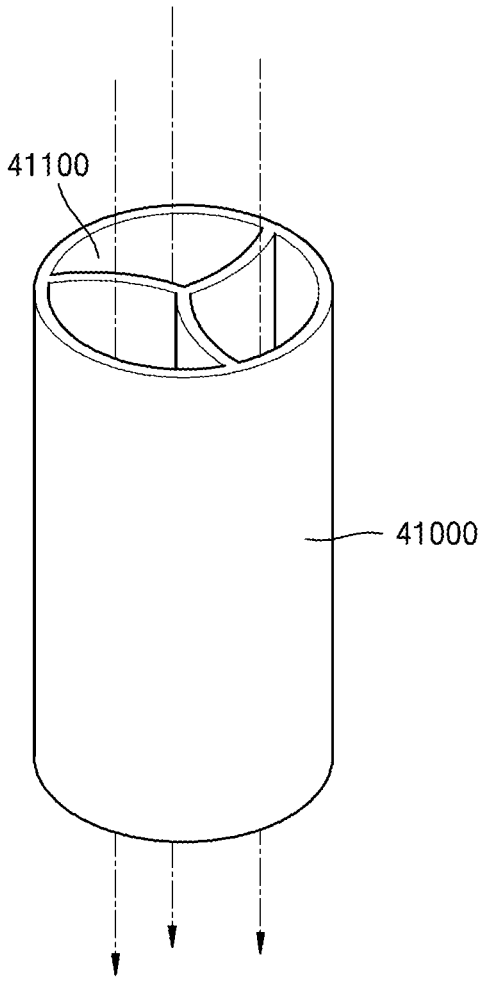
FIGS. 26A to 26F are diagrams showing examples of a cooling structure of a cigarette.

Referring to FIG. 26A, the cooling structure 41000 may be formed to have a cylindrical shape, and at least one air passage 41100 may be formed in a cross-section of the cooling structure 41000.

Figure 26B:
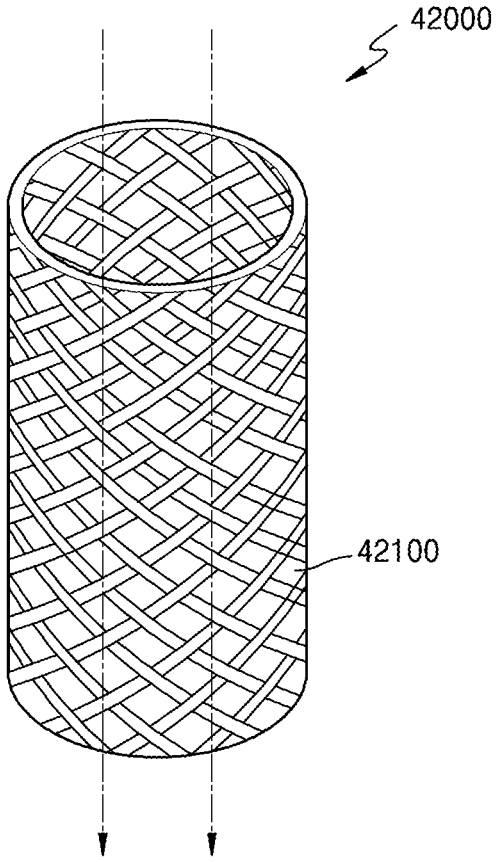

Referring to FIG. 26B, the cooling structure 42000 may be manufactured as a structure in which a plurality of fibers are entangled with one another. At this time, the aerosol may flow between the fibers, and a vortex may be formed according to the shape of the cooling structure 42000. The vortex expands an area of contact of the aerosol in the cooling structure 42000 and increases the time that the aerosol stays in the cooling structure 42000. Therefore, heated aerosol may be effectively cooled.

Figure 26C:
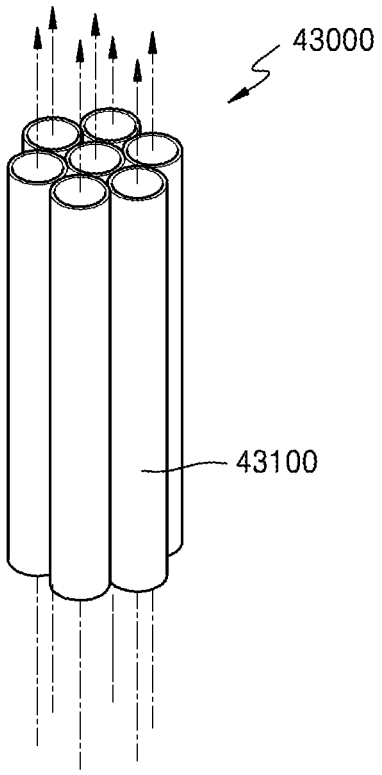

Referring to FIG. 26C, the cooling structure 43000 may be manufactured in the form in which a plurality of bundles 43100 are gathered.

Figure 26D:
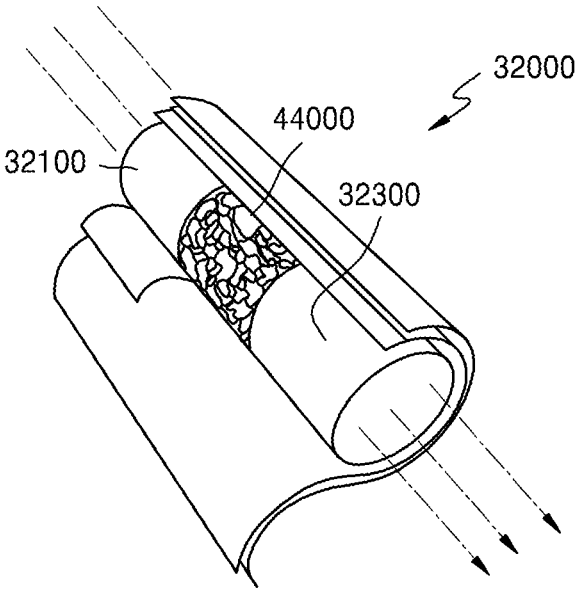

Referring to FIG. 26D, a cooling structure 44000 may be filled with granules formed of polylactic acid, cut leaves, or charcoal. Also, the granules may be fabricated by using a mixture of polylactic acid, cut leaves, and charcoal. On the other hand, the granules may further include an element capable of increasing the aerosol cooling effect other than polylactic acid, the cut leaves, and/or charcoal.

Figure 26E:
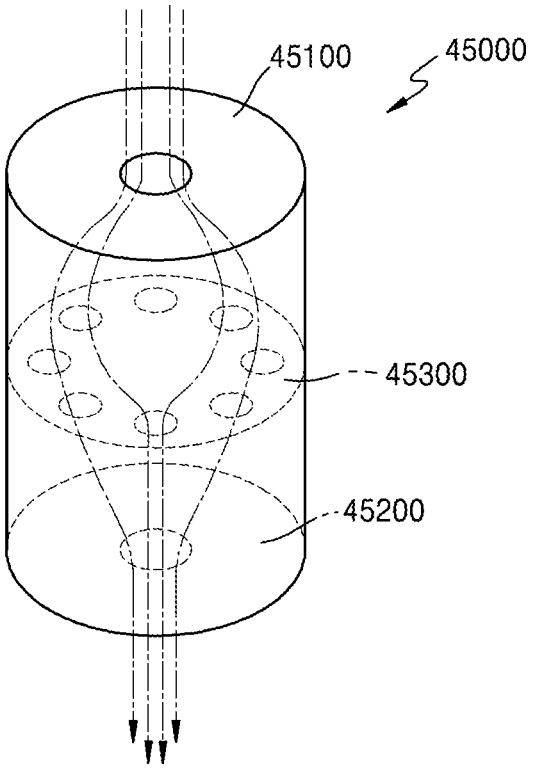

Referring to FIG. 26E, a cooling structure 45000 may include a first cross-section 45100 and a second cross-section 45200.

The first cross-section 45100 borders on the first filter segment 32100 and may include gaps into which an aerosol may be introduced. The second cross-section 45200 borders the second filter segment 32300 and may include gaps through which an aerosol may be discharged. For example, each of the first cross-section 45100 and the second cross-section 45200 may include a single gap having the same diameter, but the diameters and the numbers of the gaps included in the first cross-section 45100 and the second cross-section 45200 are not limited thereto.

In addition, the cooling structure 45000 may include a third cross-section 45300 that includes a plurality of gaps and is between the first cross-section 45100 and the second cross-section 45200. For example, the diameters of the plurality of gaps included in the third cross-section 45300 may be smaller than the diameters of the gaps included in the first cross-section 45100 and the second cross-section 45200. Also, the number of gaps included in the third cross-section 45300 may be greater than the number of gaps included in the first cross-section 45100 and the second cross-section 45200.

Figure 26F:
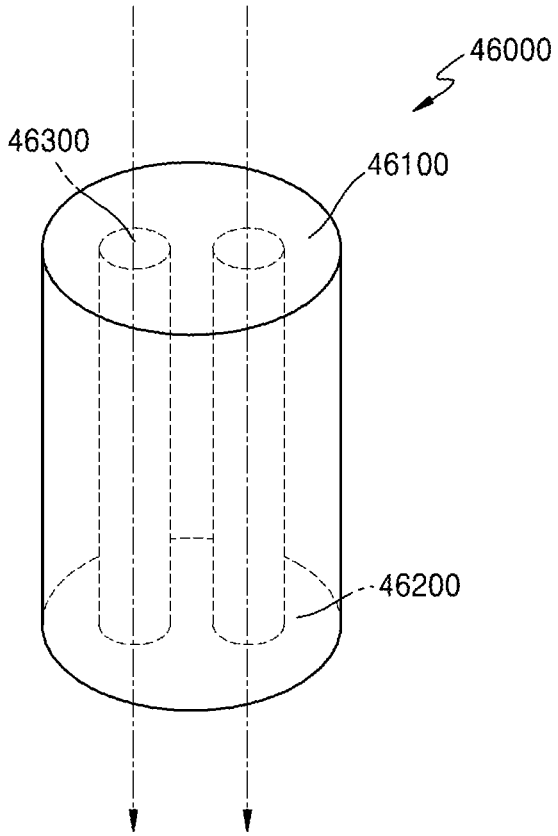

Referring to FIG. 26F, a cooling structure 46000 may include a first cross-section 46100 that borders on the first filter segment 32100 and a second cross-section 46200 that borders on the second filter segment 32300. Also, the cooling structure 46000 may include one or more tubular element 46300. For example, the tubular element 46300 may penetrate through the first cross-section 46100 and the second cross-section 46200. Also, the tubular element 46300 may be packaged with a microporous packaging material and filled with a filler material (e.g., the granules described above with reference to FIG. 26D) that may increase the aerosol cooling effect.

As described above, a holder may generate aerosol by heating a cigarette. Also, aerosol may be generated independently by the holder or even when the holder is inserted into a cradle and is tilted. Particularly, when the holder is tilted, a heater may be heated by power of a battery of the cradle.

Specific implementations described in the embodiments are examples, and do not limit the scope of the embodiments in any way. Moreover, no item or component is essential to the practice of the disclosure unless the element is specifically described as "essential" or "critical".

The use of the terms "a" and "an" and "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the steps of all methods described herein can be performed in any suitable order unless otherwise indicated herein or otherwise clearly contradicted by context. The present disclosure is not limited to the described order of the steps. The use of any and all examples, or exemplary language (e.g., "such as") provided herein, is intended merely to better illuminate the disclosure and does not pose a limitation on the scope of the disclosure unless otherwise claimed. Numerous modifications and adaptations will be readily apparent to one of ordinary skill in the art without departing from the spirit and scope of the present disclosure.

The embodiments of the present disclosure may be written as computer programs and can be implemented in general-use digital computers that execute the programs using a computer readable recording medium. In addition, the structure of the data used in the above-described method may be recorded on a computer-readable recording medium through various means. Examples of the computer readable recording medium include magnetic storage media (e.g., ROM, RAM, USB drives, floppy disks, hard disks, etc.), optical recording media (e.g., CD-ROMs, or DVDs), etc.

What is claimed is:

1. An apparatus for cleaning a smoking member comprising:

a main body;

an accommodating unit formed in the main body to accommodate the smoking member;

a cleaning unit formed in the accommodating unit and configured to clean the smoking member;

a driving unit connected to the cleaning unit and configured to control the cleaning unit to move, thereby to clean the smoking member; and a power supply unit configured to supply power to the driving unit.

2. The apparatus of claim 1, wherein the power supply unit is connected to an external power supply.

3. The apparatus of claim 1, wherein the smoking member comprises a main region and an insertion groove on one end of the main region, and the cleaning unit is configured to be inserted into the insertion groove during cleaning of the smoking member.

4. The apparatus of claim 3, wherein the smoking member further comprises a heater arranged in the insertion groove to heat a smoking material, and the cleaning unit contacts the heater during the cleaning of the smoking member.

5. The apparatus of claim 1, wherein the cleaning unit has a brush-like form comprising a plurality of fiber strands.

6. The apparatus of claim 1, wherein the power supply unit is configured to be connected to a connecting unit arranged in an external apparatus comprising a mounting unit for mounting the smoking member, the connecting unit is configured to charge the smoking member when connected to the smoking member, and the smoking member is cleaned based on power transfer from the connecting unit to the driving unit through the power supply unit.

7. The apparatus of claim 1, wherein the power supply unit is configured to connect to a connecting member arranged in an external apparatus comprising a mounting unit for mounting the smoking member and a connecting unit configured to charge the smoking member when connected to the smoking member, the connecting member is separated from the connecting unit, and the smoking member is cleaned based on power transfer from the connecting member to the driving unit through the power supply unit.

8. The apparatus of claim 1, wherein the power supply unit is configured to be connected to a connecting unit arranged in an external apparatus comprising an accommodating region for accommodating the smoking member, the connecting unit is configured to charge the smoking member when connected to the smoking member, and the smoking member is cleaned as power is transferred from the connecting unit to the driving unit through the power supply unit.

9. The apparatus of claim 1, wherein the power supply unit is configured to be connected to a connecting member arranged in an external apparatus comprising an accommodating region for accommodating the smoking member and a connecting unit configured to charge the smoking member when connected to the smoking member, the connecting member is separated from the connecting unit, and the smoking member is cleaned as power is transferred from the connecting member to the driving unit through the power supply unit.

10. The apparatus of claim 1, further comprising a protruding region protruding from the main body, wherein the power supply unit is formed in the protruding region.

11. A smoking member system comprising:

a smoking member cleaning device comprising:

a main body;

an accommodating unit formed in the main body to accommodate the smoking member;

a cleaning unit formed in the accommodating unit and configured to clean the smoking member;

a driving unit connected to the cleaning unit and configured to control the cleaning unit to move, thereby cleaning the smoking member; and a power supply unit configured to supply power to the driving unit; and a smoking member supporting device comprising:

a base unit;

a mounting unit formed in the base unit and configured to mount the smoking member thereon; and a connecting unit configured to be connected to the power supply unit, wherein the smoking member is cleaned as power is transferred from the connecting unit to the driving unit through the power supply unit.

12. A smoking member system comprising:

a smoking member cleaning device comprising:

a main body;

an accommodating unit formed in the main body to accommodate the smoking member;

a cleaning unit formed in the accommodating unit and configured to clean the smoking member;

a driving unit connected to the cleaning unit and configured to control the cleaning unit to move, thereby cleaning the smoking member; and a power supply unit configured to supply power to the driving unit; and a smoking member accommodating device comprising:

an accommodation housing;

an accommodating region formed in the accommodation housing and configured to accommodate the smoking member; and a connecting unit configured to be connected to the power supply unit, wherein the smoking member is cleaned as power is transferred from the connecting unit to the driving unit through the power supply unit.

* * * * *